US009605412B2

(12) United States Patent
Ikegami et al.

(10) Patent No.: US 9,605,412 B2
(45) **Date of Patent: *Mar. 28, 2017**

(54) CONSTRUCTION MACHINE CONTROL SYSTEM, CONSTRUCTION MACHINE, AND CONSTRUCTION MACHINE CONTROL METHOD

(71) Applicant: Komatsu Ltd., Tokyo (JP)

(72) Inventors: Katsuhiro Ikegami, Hiratsuka (JP); Yoshiki Kami, Hadano (JP); Akinori Baba, Hiratsuka (JP); Takeshi Takaura, Minou (JP)

(73) Assignee: Komatsu Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/760,876

(22) PCT Filed: Mar. 24, 2015

(86) PCT No.: PCT/JP2015/058998

§ 371 (c)(1),
(2) Date: Jul. 14, 2015

(87) PCT Pub. No.: WO2015/137524

PCT Pub. Date: Sep. 17, 2015

(65) Prior Publication Data

US 2016/0281331 A1 Sep. 29, 2016

(30) Foreign Application Priority Data

Jun. 4, 2014 (JP) ..... PCT/JP2014/064890

(51) Int. Cl.
*G06F 7/70* (2006.01)
*E02F 9/22* (2006.01)
(Continued)

(52) U.S. Cl.
CPC ..... *E02F 9/2228* (2013.01); *E02F 3/32* (2013.01); *E02F 3/435* (2013.01); *E02F 3/438* (2013.01);
(Continued)

(58) Field of Classification Search
CPC ..... E02F 9/20; E02F 9/22; E02F 3/43
(Continued)

(56) References Cited

U.S. PATENT DOCUMENTS 5,968,104 A 10/1999 Egawa et al.
6,275,757 B1 8/2001 Watanabe et al.
(Continued)

FOREIGN PATENT DOCUMENTS

CN 1069721 C 8/2001
DE 69821754 T2 1/2005
(Continued)

OTHER PUBLICATIONS

International Search Report and Written Opinion dated Jun. 16, 2015, issued for PCT/JP2015/058998.

*Primary Examiner* — Thomas G Black
*Assistant Examiner* — Luke Huynh
(74) *Attorney, Agent, or Firm* — Locke Lord LLP

(57) ABSTRACT

A control system includes: a data acquisition unit that acquires an operation command value and data on a cylinder speed in a state where an operation command of operating a hydraulic cylinder is output; a deriving unit that derives an operation start operation command value when the hydraulic cylinder in a stopped state starts operating and slow-speed operation characteristics indicating a relation between the operation command value and the cylinder speed in a slow-speed area based on the data acquired by the data acquisition unit; a storage unit that stores the operation start operation command value and the slow-speed operation
(Continued)

characteristics derived by the deriving unit; and a work machine control unit that controls a work machine based on information stored in the storage unit.

11 Claims, 42 Drawing Sheets

(51) Int. Cl.

| | |
|---|---|
| ***E02F 3/43*** | (2006.01) |
| ***E02F 9/26*** | (2006.01) |
| ***E02F 9/20*** | (2006.01) |
| ***E02F 3/32*** | (2006.01) |

(52) U.S. Cl.
CPC ..... *E02F 9/2004* (2013.01); *E02F 9/2029* (2013.01); *E02F 9/2033* (2013.01); *E02F 9/2041* (2013.01); *E02F 9/2203* (2013.01); *E02F 9/2271* (2013.01); *E02F 9/2285* (2013.01); *E02F 9/26* (2013.01); *E02F 9/264* (2013.01)

(58) Field of Classification Search
USPC ..... 701/50, 33.9, 34.4; 60/445; 172/3
See application file for complete search history.

(56) References Cited

U.S. PATENT DOCUMENTS

| | | | | |
|---|---|---|---|---|
| 2012/0185141 | A1* | 7/2012 | Kamado ..... | E02F 9/2066 701/50 |
| 2014/0290237 | A1* | 10/2014 | Yoshida ..... | F02D 41/029 60/452 |
| 2015/0345113 | A1* | 12/2015 | Lim ..... | E02F 9/2253 701/50 |

FOREIGN PATENT DOCUMENTS

| | | | |
|---|---|---|---|
| EP | 0816573 | A2 | 1/1998 |
| JP | 06-117404 | A | 4/1994 |
| JP | 10-008489 | A | 1/1998 |
| JP | 11-350537 | A | 12/1999 |
| JP | 11-351007 | A | 12/1999 |
| JP | 2002-349505 | A | 12/2002 |
| JP | 2012-237339 | A | 12/2012 |

* cited by examiner

FIG.33

32(322)

BOOM RAISING PRESSURE-REDUCTION CONTROL MAP CALIBRATION

| EPC CURRENT | PPC PRESSURE | SPOOL STROKE |
|---|---|---|
| Ia | PPCa | Ta |
| Ib | - | - |
| Ic | - | - |
| Id | - | - |

CLEAR NEXT

FIG.35

32(322)

BOOM RAISING PRESSURE-REDUCTION CONTROL MAP CALIBRATION

| EPC CURRENT | PPC PRESSURE | SPOOL STROKE |
|---|---|---|
| Ia | PPCa | Ta |
| Ib | PPCb | Tb |
| Ic | PPCc | Tc |
| Id | PPCd | Td |

CLEAR

321P

CONSTRUCTION MACHINE CONTROL SYSTEM, CONSTRUCTION MACHINE, AND CONSTRUCTION MACHINE CONTROL METHOD

FIELD

The present invention relates to a construction machine control system, a construction machine, and a construction machine control method.

BACKGROUND

A construction machine like an excavator includes a work machine that includes a boom, an arm, and a bucket. As disclosed in Patent Literature 1, a work machine is driven by a hydraulic actuator (hydraulic cylinder).

CITATION LIST

Patent Literature

Patent Literature 1: Japanese Laid-open Patent Publication No. 11-350537

SUMMARY

Technical Problem

In a case of controlling a work machine, if operation characteristics of a hydraulic cylinder, particularly, accurate characteristics of activation of the hydraulic cylinder are not sufficiently understood, the activation is not accurately understood, and for example, the excavation accuracy of the work machine may be decreased. For this reason, a technique capable of smoothly deriving the operation characteristics of the hydraulic cylinder is required to contrive.

An object of aspects of the present invention is to provide a construction machine control system, a construction machine, and a construction machine control method which are capable of smoothly deriving operation characteristics of a hydraulic cylinder.

Solution to Problem

A first aspect of the present invention provides a construction machine control system that includes a work machine including a boom, an arm, and a bucket, the construction machine control system including: a hydraulic cylinder that drives the work machine; a direction control valve that has a movable spool and that supplies operating oil to the hydraulic cylinder with movement of the spool to operate the hydraulic cylinder; a control valve that is capable of adjusting pressure of pilot oil for moving the spool; a cylinder speed sensor that detects a cylinder speed of the hydraulic cylinder; a data acquisition unit that acquires the operation command value and data on the sensor controller in a state where an operation command of operating the hydraulic cylinder; a deriving unit that derives an operation start operation command value when the hydraulic cylinder in a stopped state starts operating and slow-speed operation characteristics indicating a relation between the operation command value and the cylinder speed in a slow-speed area based on the data acquired by the data acquisition unit; a storage unit that stores the operation start operation command value and the slow-speed operation characteristics derived by the deriving unit; and a work machine control unit that controls the work machine based on information stored in the storage unit.

It is preferable that the construction machine control system further include: a control valve control unit that determines a current value to be supplied to the control valve; a pressure sensor that detects a pressure value of the pilot oil; and a spool stroke sensor that detects a movement amount value of the spool, wherein the operation command value includes at least one of the current value, the pressure value, and the movement amount value.

It is preferable that the deriving unit derive normal-speed operation characteristics indicating a relation between the operation command value and the cylinder speed in the normal-speed area that is a speed area where an amount of change in the cylinder speed with respect to the operation command value is larger than that in the slow-speed area and the cylinder speed is higher than that in the slow-speed area based on the data acquired by the data acquisition unit, and the storage unit store the normal-speed operation characteristics.

It is preferable that the hydraulic cylinder include a boom cylinder that drives the boom, wherein the construction machine control system further includes: a boom raising oil passage which is connected to one pressure receiving chamber of the direction control valve and through which pilot oil for allowing the boom to perform a raising operation flows; and a boom lowering oil passage which is connected to the other pressure receiving chamber of the direction control valve and through which pilot oil for allowing the boom to perform a lowering operation flows, wherein the work machine control unit determines, based on a target excavation landform indicating a target shape of an excavation object and bucket position data indicating a position of the bucket, a speed limit according to a distance between the target excavation landform and the bucket and executes intervention control of limiting a speed of the boom so that the speed in a direction where the bucket approaches the target excavation landform is equal to or lower than the speed limit, wherein the boom raising oil passage includes an operating oil passage through which the pilot oil of which pressure is adjusted according to an amount of operation of an operating device flows and an intervention oil passage which is connected to the operating oil passage via a shuttle valve and through which the pilot oil of which pressure is adjusted in the intervention control flows, wherein the control valve includes a pressure-reducing valve disposed in the operating oil passage and an intervention valve disposed in the intervention oil passage, wherein with respect to the intervention valve, the operation start operation command value and the slow-speed operation characteristics are derived, and wherein with respect to the pressure-reducing valve, the operation start operation command value is derived.

It is preferable that the operating device be a pilot hydraulic-type operating device, and the boom raising oil passage is connected to the pilot hydraulic-type operating device.

It is preferable that the hydraulic cylinder include an arm cylinder that drives the arm and a boom cylinder that drives the bucket, wherein the construction machine control system further includes: an arm oil passage through which pilot oil for operating the arm flows; and a bucket oil passage through pilot oil for operating the bucket flows, wherein the control valve includes pressure-reducing valves disposed in the arm oil passage and the bucket oil passage, and wherein with respect to the pressure-reducing valves, the operation start operation command value is derived.

It is preferable that the construction machine control system further include: a man machine interface that includes an input unit and a display unit, wherein the display unit displays attitude adjustment request information of requesting adjustment of an attitude of the work machine, and wherein the input unit generates a command signal for outputting the operation command signal for operating the hydraulic cylinder.

A second aspect of the present invention provides a construction machine comprising: a lower traveling structure; an upper swinging structure that is supported by the lower traveling structure; a work machine that includes a boom, an arm and a bucket and is supported by the upper swinging structure; and the control system of the first aspect of the present invention.

A third aspect of the present invention provides a construction machine control method for a construction machine that includes a work machine including a boom, an arm, and a bucket, wherein the construction machine includes: a hydraulic cylinder that drives the work machine; a direction control valve that has a movable spool and that supplies operating oil to the hydraulic cylinder with movement of the spool to operate the hydraulic cylinder; a control valve that is capable of adjusting pressure of pilot oil for moving the spool; a cylinder speed sensor that detects a cylinder speed of the hydraulic cylinder; and a man machine interface that includes an input unit and a display unit, wherein the construction machine control method includes: displaying attitude adjustment request information on the display unit and adjusting an attitude of the work machine; after adjusting the attitude of the work machine, generating a command signal for outputting an operation command of operating the hydraulic cylinder by operation of the input unit; acquiring the operation command value and data on the sensor controller in a state where the operation command is output; deriving the operation start operation command value when the hydraulic cylinder in a stopped state starts operating based on the acquired data; after deriving the operation start operation command value, acquiring the operation command value and the data on the cylinder speed in a state where the operation command of which the operation command value is larger than the operation start operation command value is output; deriving slow-speed operation characteristics indicating a relation between the operation command value and the sensor controller in a slow-speed area based on the acquired data; storing the derived operation start operation command value and the derived slow-speed operation characteristics; and controlling the work machine based on the stored information.

Advantageous Effects of Invention

According to the aspects of the present invention, it is possible to smoothly derive operation characteristics of a hydraulic cylinder.

BRIEF DESCRIPTION OF DRAWINGS

FIG. 33 is a diagram illustrating an example of the display unit.

FIG. 35 is a diagram illustrating an example of the display unit.

DESCRIPTION OF EMBODIMENTS

Hereinafter, an embodiment according to the present invention is described with reference to the drawings, and the present invention is not limited thereto. Requirements of the embodiment described hereinafter can be appropriately combined with each other. Moreover, some constituent components may not be used.

[Overall Configuration of Excavator]

Figure 1:
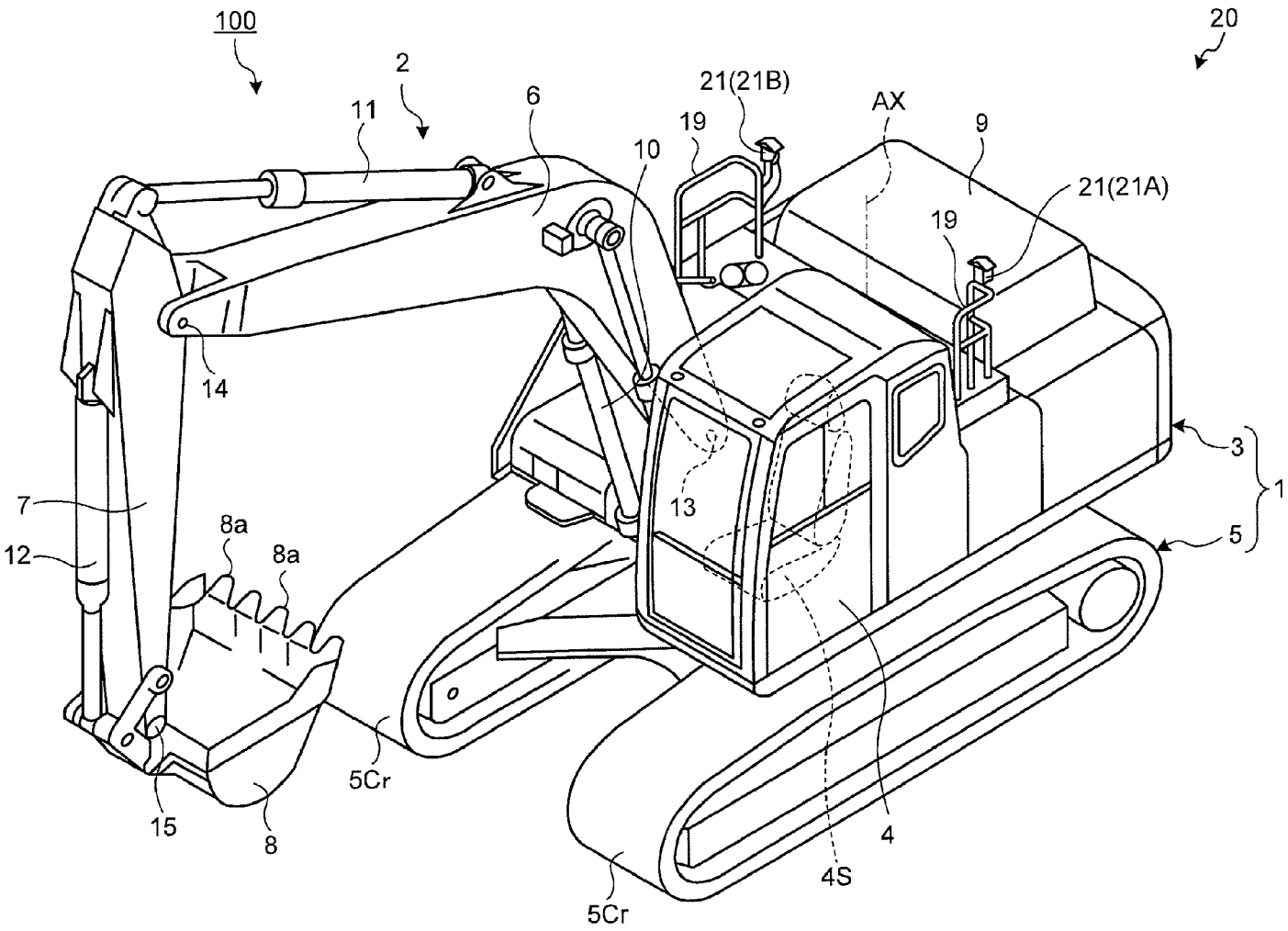
FIG. 1 is a perspective view illustrating an example of a construction machine.

FIG. 1 is a perspective view illustrating an example of a construction machine 100 according to the present embodiment. In the present embodiment, an example in which the construction machine 100 is an excavator 100 that includes a work machine 2 operating with hydraulic pressure.

As illustrated in FIG. 1, the excavator 100 includes a vehicle body 1, the work machine 2, and a hydraulic cylinder (a boom cylinder 10, an arm cylinder 11, and a bucket cylinder 12) that drives the work machine 2. As will be described later, a control system 200 that executes excavation control is mounted on the excavator 100.

The vehicle body 1 includes a swinging structure 3, a cab 4, and a traveling device 5. The swinging structure 3 is disposed on the traveling device 5. The traveling device 5 supports the swinging structure 3. The swinging structure 3 may be referred to as an upper swinging structure 3. The traveling device 5 may be referred to as a lower traveling structure 5. The swinging structure 3 is capable of swinging about a swing axis AX. A driver's seat 4S on which an operator sits is provided in the cab 4. The operator operates the excavator 100 in the cab 4. The traveling device 5 includes a pair of crawler belts 5Cr. By rotation of the crawler belts 5Cr, the excavator 100 travels. Note that the traveling device 5 may include wheels (tires).

In the present invention, a positional relation of respective portions is described based on the driver's seat 4S. A front-rear direction refers to a front-rear direction based on the driver's seat 4S. A left-right direction refers to a left-right direction based on the driver's seat 4S. A direction in which the driver's seat 4S faces the front is defined as a front direction, and a direction opposite to the front direction is defined as a rear direction. The one direction (right side) and the other direction (left side) of lateral directions when the driver's seat 4S faces the front are defined as a right direction and a left direction.

The swinging structure 3 includes an engine room 9 that accommodates an engine, and a counterweight provided at a rear portion of the swinging structure 3. A handrail 19 is provided in the swinging structure 3 on the front side of the engine room 9. An engine, a hydraulic pump, and the like are disposed in the engine room 9.

The work machine 2 is supported by the swinging structure 3. The work machine 2 includes a boom 6 connected to the swinging structure 3, an arm 7 connected to the boom 6, and a bucket 8 connected to the arm 7. The work machine 2 is driven by the hydraulic cylinder. The hydraulic cylinder for driving the work machine 2 includes a boom cylinder 10 driving the boom 6, an arm cylinder 11 driving the arm 7, and a bucket cylinder 12 driving the bucket 8. Each of the boom cylinder 10, the arm cylinder 11, and the bucket cylinder 12 is driven with operating oil.

A base end of the boom 6 is connected to the swinging structure 3 with a boom pin 13 interposed. A base end of the arm 7 is connected to a distal end of the boom 6 with an arm pin 14 interposed. The bucket 8 is connected to a distal end of the arm 7 with a bucket pin 15 interposed. The boom 6 is capable of rotating about the boom pin 13. The arm 7 is capable of rotating about the arm pin 14. The bucket 8 is capable of rotating about the bucket pin 15. Each of the arm 7 and the bucket 8 is a movable member capable of moving on the distal end side of the boom 6.

Figure 2:
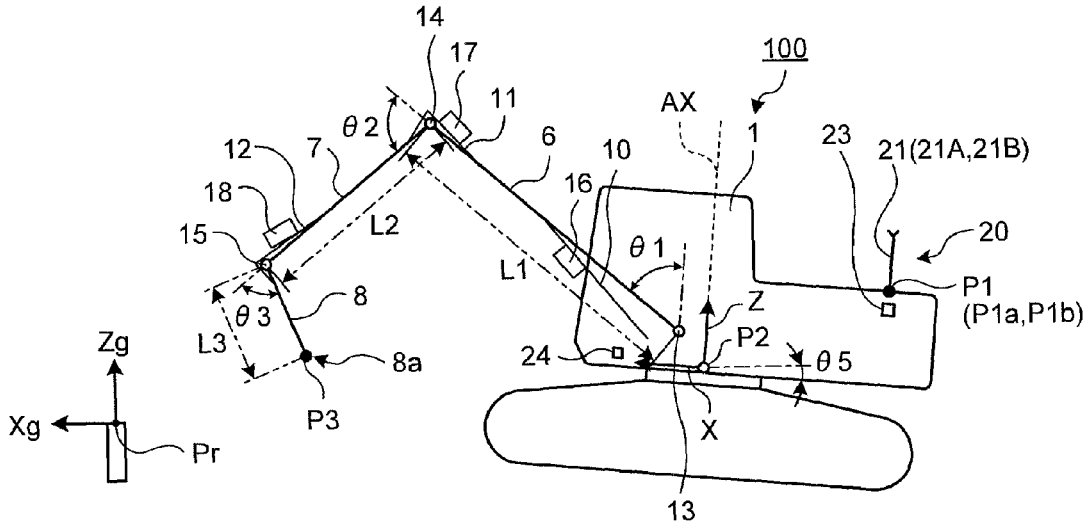
FIG. 2 is a side view schematically illustrating an example of the construction machine.
Figure 3:
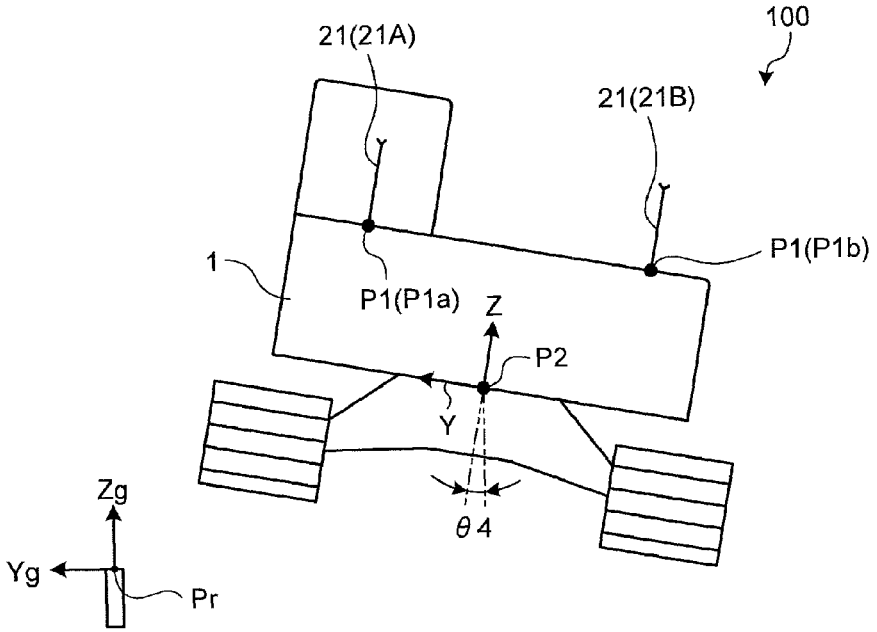
FIG. 3 is a rear view schematically illustrating an example of the construction machine.

FIG. 2 is a side view schematically illustrating the excavator 100 according to the present embodiment. FIG. 3 is a rear view schematically illustrating the excavator 100 according to the present embodiment. As illustrated in FIG. 2, the length L1 of the boom 6 is a distance between the boom pin 13 and the arm pin 14. The length L2 of the arm 7 is a distance between the arm pin 14 and the bucket pin 15. The length L3 of the bucket 8 is a distance between the bucket pin 15 and a distal end 8*a* of the bucket 8. In the present embodiment, the bucket 8 has a plurality of teeth. In the following description, the distal end 8*a* of the bucket 8 will be appropriately referred to as a cutting edge 8*a*.

Note that the bucket 8 may not have teeth. The distal end of the bucket 8 may be formed of a straight steel plate.

As illustrated in FIG. 2, the excavator 100 includes a boom cylinder stroke sensor 16 disposed in the boom cylinder 10, an arm cylinder stroke sensor 17 disposed in the arm cylinder 11, and a bucket cylinder stroke sensor 18 disposed in the bucket cylinder 12. A stroke length of the boom cylinder 10 is obtained based on a detection result of the boom cylinder stroke sensor 16. A stroke length of the arm cylinder 11 is obtained based on a detection result of the arm cylinder stroke sensor 17. A stroke length of the bucket cylinder 12 is obtained based on a detection result of the bucket cylinder stroke sensor 18.

In the following description, the stroke length of the boom cylinder 10 will be appropriately referred to as a boom cylinder length, the stroke length of the arm cylinder 11 will be appropriately referred to as an arm cylinder length, and the stroke length of the bucket cylinder 12 will be appropriately referred to as a bucket cylinder length. Moreover, in the following description, the boom cylinder length, the arm cylinder length, and the bucket cylinder length will be appropriately collectively referred to as cylinder length data L.

The excavator 100 includes a position detection device 20 capable of detecting a position of the excavator 100. The position detection device 20 includes an antenna 21, a global coordinate calculating unit 23, and an inertial measurement unit (IMU) 24.

The antenna 21 is a global navigation satellite systems (GNSS) antenna. The antenna 21 is a real time kinematic-global navigation satellite systems (RTK-GNSS) antenna. The antenna 21 is provided in the swinging structure 3. In the present embodiment, the antenna 21 is provided in the handrail 19 of the swinging structure 3. Note that the antenna 21 may be provided in the rear direction of the engine room 9. For example, the antenna 21 may be provided in the counterweight of the swinging structure 3. The antenna 21 outputs a signal corresponding to a received radio wave (GNSS radio wave) to the global coordinate calculating unit 23.

The global coordinate calculating unit 23 detects an installed position P1 of the antenna 21 in a global coordinate system. The global coordinate system is a three-dimensional coordinate system (Xg, Yg, Zg) based on a reference position Pr installed in a work area. As illustrated in FIGS. 2 and 3, in the present embodiment, the reference position Pr is a position of a distal end of a reference post set in the work area. Moreover, a local coordinate system refers to a three-dimensional coordinate system indicated by (X, Y, Z) based on the excavator 100. A reference position of the local coordinate system is data indicating a reference position P2 positioned at the swing axis (swing center) AX of the swinging structure 3.

In the present embodiment, the antenna 21 includes a first antenna 21A and a second antenna 21B provided in the swinging structure 3 so as to be separated in a vehicle width direction. The global coordinate calculating unit 23 detects an installed position P1*a* of the first antenna 21A and an installed position P1*b* of the second antenna 21B.

The global coordinate calculating unit 23 acquires reference position data P represented by a global coordinate. In the present embodiment, the reference position data P is data indicating the reference position P2 positioned at the swing axis (swing center) AX of the swinging structure 3. In addition, the reference position data P may be data indicating the installed position P1. In the present embodiment, the global coordinate calculating unit 23 generates swinging structure direction data Q based on the two installed positions P1*a* and P1*b*. The swinging structure direction data Q is determined based on an angle between a line determined by the installed positions P1*a* and P1*b* and a reference direction (for example, the north) of the global coordinate. The swinging structure direction data Q indicates direction in which the swinging structure 3 (the work machine 2) faces. The global coordinate calculating unit 23 outputs the reference position data P and the swinging structure direction data Q to a display controller 28 described later.

The IMU 24 is provided in the swinging structure 3. In the present embodiment, the IMU 24 is disposed under the cab 4. A high-rigidity frame is disposed in the swinging structure 3 under the cab 4. The IMU 24 is disposed on the frame. Note that the IMU 24 may be disposed on a lateral side (right side or left side) of the swing axis AX (the reference position P2) of the swinging structure 3. The IMU 24 detects a tilt angle θ4 with respect to the left-right direction of the vehicle body 1 and a tilt angle θ5 with respect to the front-rear direction of the vehicle body 1.

[Configuration of Control System]

Figure 4:
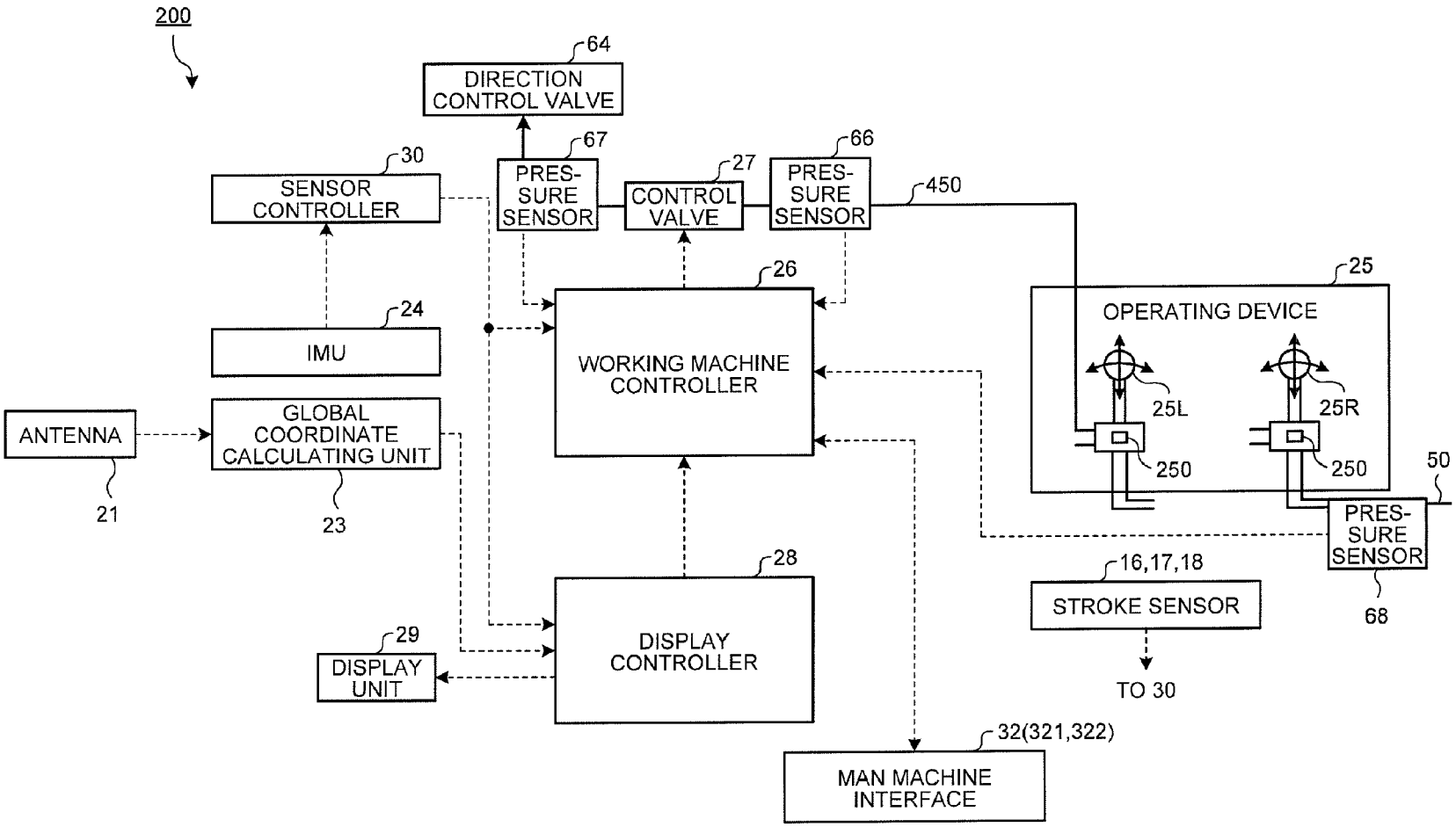
FIG. 4 is a block diagram illustrating an example of a control system.

Next, an overview of the control system 200 according to the present embodiment will be described. FIG. 4 is a block diagram illustrating a functional configuration of the control system 200 according to the present embodiment.

The control system 200 controls an excavation process using the work machine 2. The control of the excavation process includes limited excavation control. As illustrated in FIG. 4, the control system 200 includes the boom cylinder stroke sensor 16, the arm cylinder stroke sensor 17, the bucket cylinder stroke sensor 18, the antenna 21, the global coordinate calculating unit 23, the IMU 24, an operating device 25, a work machine controller 26, a pressure sensor 66, a pressure sensor 67, a pressure sensor 68, a control valve 27, a direction control valve 64, a display controller 28, a display unit 29, a sensor controller 30, a man machine interface 32.

The operating device 25 is disposed in the cab 4. The operating device 25 is operated by an operator. The operating device 25 receives an input of an operator's operation command for driving the work machine 2. In the present embodiment, the operating device 25 is a pilot hydraulic-type operating device.

In the following description, oil supplied to a hydraulic cylinder (the boom cylinder 10, the arm cylinder 11, and the bucket cylinder 12) in order to operate the hydraulic cylinder will be appropriately referred to as operating oil. In the present embodiment, the amount of operating oil supplied to the hydraulic cylinder is adjusted by the direction control valve 64. The direction control valve 64 operates with oil supplied. In the following description, oil supplied to the direction control valve 64 in order to operate the direction control valve 64 will be appropriately referred to as pilot oil. Moreover, the pressure of pilot oil will be appropriately referred to as pilot pressure.

The operating oil and the pilot oil may be delivered from the same hydraulic pump. For example, a portion of the operating oil delivered from a main hydraulic pump is decompressed by a pressure-reducing valve and the decompressed operating oil may be used as the pilot oil. Moreover, a hydraulic pump (main hydraulic pump) that delivers operating oil and a hydraulic pump (pilot hydraulic pump) that delivers pilot oil may be different hydraulic pumps.

The operating device 25 includes a pressure adjustment valve 250 which is connected to a pilot oil passage 50 and a pilot oil passage 450 through which the pilot oil flows and which is capable of adjusting the pilot pressure according to the amount of operation. The operating device 25 includes a first operating lever 25R and a second operating lever 25L. In the present embodiment, the amount of operation of the operating device 25 includes an angle at which the operating lever (25R and 25L) is tilted. When the operator operates the operating lever (25R and 25L), the pilot pressure is adjusted according to the amount of operation (angle) of the operating lever and the pilot oil of the pilot oil passage 50 is supplied to the pilot oil passage 450.

The first operating lever 25R is disposed on the right side of the driver's seat 4S, for example. The second operating lever 25L is disposed on the left side of the driver's seat 4S, for example. In the first and second operating levers 25R and 25L, the front-rear and left-right operations correspond to two-axis operations.

The boom 6 and the bucket 8 are operated by the first operating lever 25R. The operation in the front-rear direction of the first operating lever 25R corresponds to an operation in the up-down direction of the boom 6. When the first operating lever 25R is operated in the front-rear direction, a lowering operation and a raising operation of the boom 6 are executed. The detection pressure generated in the pressure sensor 66 when the first operating lever 25R is operated in order to operate the boom 6 and the pilot oil is supplied to the pilot oil passage 450 will be referred to as detection pressure MB. The operation in the left-right direction of the first operating lever 25R corresponds to an operation in the up-down direction of the bucket 8. When the first operating lever 25R is operated in the left-right direction, a lowering operation and a raising operation of the bucket 8 are executed. The detection pressure generated in the pressure sensor 66 when the first operating lever 25R is operated in order to operate the bucket 8 and the pilot oil is supplied to the pilot oil passage 450 will be referred to as detection pressure MT.

The arm 7 and the swinging structure 3 are operated by the second operating lever 25L. The operation in the front-rear direction of the second operating lever 25L corresponds to an operation in the up-down direction of the arm 7. When the second operating lever 25L is operated in the front-rear direction, a lowering operation and a raising operation of the arm 7 are executed. The detection pressure generated in the pressure sensor 66 when the second operating lever 25L is operated in order to operate the arm 7 and the pilot oil is supplied to the pilot oil passage 450 will be referred to as detection pressure MA. The operation in the left-right direction of the second operating lever 25L corresponds to a swinging operation of the swinging structure 3. When the second operating lever 25L is operated in the left-right direction, a right swinging operation and a left swinging operation of the swinging structure 3 are executed.

In the present embodiment, the raising operation of the boom 6 corresponds to a dumping operation. The lowering operation of the boom 6 corresponds to an excavating operation. The raising operation of the arm 7 corresponds to the dumping operation. The lowering operation of the arm 7 corresponds to the excavating operation. The raising operation of the bucket 8 corresponds to the dumping operation. The lowering operation of the bucket 8 corresponds to the excavating operation. Note that the lowering operation of the arm 7 may be referred to as a bending operation. The raising operation of the arm 7 may be referred to as an extending operation.

The pilot oil which has been delivered from the main hydraulic pump and decompressed to pilot pressure by the pressure-reducing valve is supplied to the operating device 25. The pilot pressure is adjusted based on the amount of operation of the operating device 25, and the direction control valve 64 via which operating oil supplied to the hydraulic cylinder (the boom cylinder 10, the arm cylinder 11, and the bucket cylinder 12) flows is driven according to the pilot pressure.

The first operating lever 25R is operated in the front-rear direction in order to drive the boom 6. The direction control valve 64 via which the operating oil supplied to the boom cylinder 10 for driving the boom 6 flows is driven according to an amount of operation (amount of boom operation) of the first operating lever 25R in relation to the front-rear direction.

The first operating lever 25R is operated in the left-right direction in order to drive the bucket 8. The direction control valve 64 via which the operating oil supplied to the bucket cylinder 12 for driving the bucket 8 flows is driven according to an amount of operation (amount of bucket operation) of the first operating lever 25R in relation to the left-right direction.

The second operating lever 25L is operated in the front-rear direction in order to drive the arm 7. The direction control valve 64 via which the operating oil supplied to the arm cylinder 11 for driving the arm 7 flows is driven according to an amount of operation (amount of arm operation) of the second operating lever 25L in relation to the front-rear direction.

The second operating lever 25L is operated in the left-right direction in order to drive the swinging structure 3. The direction control valve 64 via which the operating oil supplied to a hydraulic actuator for driving the swinging structure 3 flows is driven according to an amount of operation of the second operating lever 25L in relation to the left-right direction.

The first operating lever 25R is operated by the operator so as to be in at least one state of a neutral state, a forward position where the lever is operated so as to be tilted forward from the neutral state, a backward position where the lever is operated so as to be tilted backward from the neutral state, a right position where the lever is operated so as to be tilted rightward from the neutral state, and a left position where the lever is operated so as to be tilted leftward from the neutral state. When the first operating lever 25R is operated to at least one of the forward position and the backward position, the direction control valve 64 of the boom cylinder 10 is driven. When the first operating lever 25R is operated to the right position and the left position, the direction control valve 64 of the bucket cylinder 12 is driven. When the first operating lever 25R is maintained at the neutral state, the direction control valve 64 of the boom cylinder 10 and the direction control valve 64 of the bucket cylinder 12 are not driven.

The second operating lever 25L is operated by the operator so as to be in at least one state of a neutral state, a forward position where the lever is operated so as to be tilted forward from the neutral state, a backward position where the lever is operated so as to be tilted backward from the neutral state, a right position where the lever is operated so as to be tilted rightward from the neutral state, and a left position where the lever is operated so as to be tilted leftward from the neutral state. When the second operating lever 25L is operated to at least one of the forward position and the backward position, the direction control valve 64 of the arm cylinder 11 is driven. When the second operating lever 25L is operated to the right position and the left position, a hydraulic actuator for driving the swinging structure 3 is driven. When the second operating lever 25L is maintained at the neutral state, the direction control valve 64 of the arm cylinder 11 and the hydraulic actuator for driving the swinging structure 3 are not driven.

When the first operating lever 25R is operated to a frontmost end or a rearmost end in the movable range in the front-rear direction, the cylinder speed of the boom cylinder 10 reaches its largest value. When the first operating lever 25R is operated to a rightmost end or a leftmost end in the movable range in the left-right direction, the cylinder speed of the bucket cylinder 12 reaches its largest value. When the first operating lever 25R is maintained at the neutral state, the cylinder speed of the boom cylinder 10 and the cylinder speed of the bucket cylinder 12 reach its smallest value (zero).

When the second operating lever 25L is operated to a frontmost end or a rearmost end in the movable range in the front-rear direction, the cylinder speed of the arm cylinder 11 reaches its largest value. When the second operating lever 25L is operated to a rightmost end or a leftmost end in the movable range in the left-right direction, the driving speed of the hydraulic actuator for driving the swinging structure 3 reaches its largest value. When the second operating lever 25L is maintained at the neutral state, the cylinder speed of the arm cylinder 11 and the driving speed of the hydraulic actuator for driving the swinging structure 3 reach its smallest value (zero).

In the following description, a state where the first operating lever 25R and the second operating lever 25L are disposed at the end of the movable range will be appropriately referred to as a full-lever state. In the full-lever state, the cylinder speed of the hydraulic cylinder (the boom cylinder 10, the arm cylinder 11, and the bucket cylinder 12) reaches its largest value.

Note that the operation in the left-right direction of the first operating lever 25R may correspond to the operation of the boom 6, and the operation in the front-rear direction may correspond to the operation of the bucket 8. Note that the operation in the left-right direction of the second operating lever 25L may correspond to the operation of the arm 7, and the operation in the front-rear direction may correspond to the operation of the swinging structure 3.

The pressure sensors 66 and 67 are disposed in the pilot oil passage 450. The pressure sensors 66 and 67 detect the pilot pressure. The detection results of the pressure sensors 66 and 67 are output to the work machine controller 26.

The control valve 27 is disposed in the pilot oil passage 450. The control valve 27 is capable of adjusting the pilot pressure. The control valve 27 operates based on a control signal from the work machine controller 26. When the control valve 27 operates, the pilot pressure adjusted by the control valve 27 acts on the direction control valve 64. The direction control valve 64 operates based on the pilot pressure to adjust the amount of operating oil supplied to the hydraulic cylinder (the boom cylinder 10, the arm cylinder 11, and the bucket cylinder 12).

That is, in the present embodiment, the pilot pressure is adjusted by the control valve 27 as well as the operating device 25. When the pilot pressure is adjusted, the amount of operating oil supplied to the hydraulic cylinder is adjusted by direction control valve 64.

The man machine interface 32 includes an input unit 31 and a display unit (monitor) 322. In the present embodiment, an input unit 321 includes operation buttons arranged around the display unit 322. In addition, the input unit 321 may include a touch panel. The man machine interface 32 may be referred to as a multi-monitor 32. The input unit 321 is operated by an operator. A command signal generated according to an operation of the input unit 321 is output to the work machine controller 26. The work machine controller 26 controls the display unit 322 to display predetermined information on the display unit 322.

A locking lever (not illustrated) is operated by an operator in order to mechanically block the pilot oil passage 50. The locking lever is disposed in the cab 4. The pilot oil passage 50 is closed according to the operation of the locking lever. When the locking lever is operated and the pilot oil passage 50 is blocked, the detection pressure of the pressure sensor 68 installed in the pilot oil passage 50 decreases, the decreased detection value of the pressure sensor 68 is output to the work machine controller 26, and it is determined that the pilot oil passage 50 is in a blocked state. For example, when the operator leaves from the cab 4, the locking lever is operated so that the pilot oil passage 50 is closed. In this way, it is possible to suppress the pilot pressure from acting on the direction control valve 64 and the work machine 2 from moving even though the operator is not present in the cab 4. When the work machine 2 (the excavator 100) is operated, the blocking of the pilot oil passage 50 by the locking lever is released and the pilot oil passage 50 is opened. In this way, the work machine 2 enters into a drivable state. Moreover, the blocked state may be determined by an electrical signal of a switch or the like that detects the operation of the locking lever.

Figure 5:
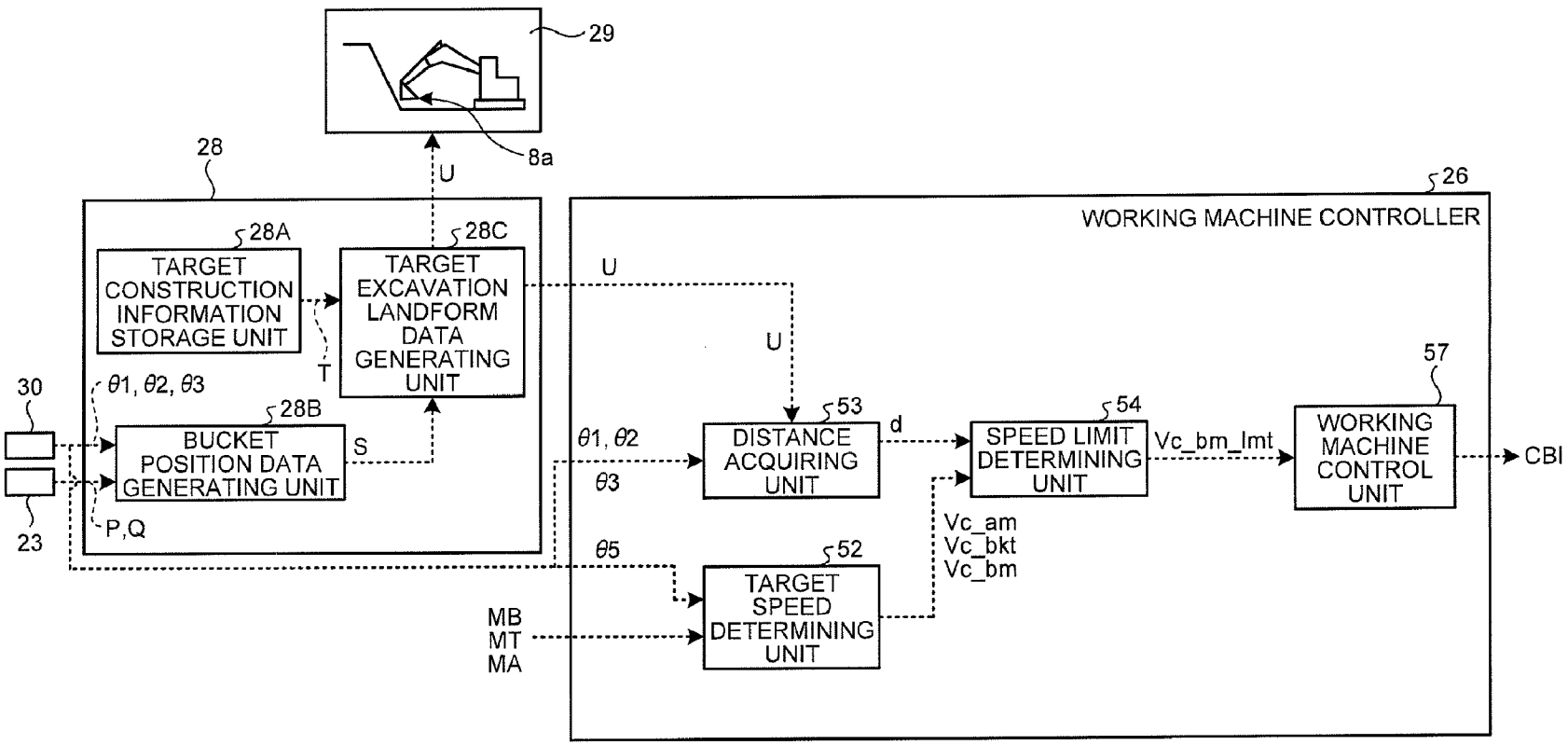
FIG. 5 is a block diagram illustrating an example of the control system.

FIG. 5 is a block diagram illustrating the work machine controller 26, the display controller 28, and the sensor controller 30. The sensor controller 30 calculates a boom cylinder length based on a detection result of the boom cylinder stroke sensor 16. The boom cylinder stroke sensor 16 outputs a phase shift pulse associated with a swinging operation to the sensor controller 30. The sensor controller 30 calculates the boom cylinder length based on the phase shift pulse output from the boom cylinder stroke sensor 16. Similarly, the sensor controller 30 calculates the arm cylinder length based on a detection result of the arm cylinder stroke sensor 17. The sensor controller 30 calculates the bucket cylinder length based on a detection result of the bucket cylinder stroke sensor 18.

The sensor controller 30 calculates a tilt angle θ1 (see FIG. 2) of the boom 6 with respect to the vertical direction of the swinging structure 3 from the boom cylinder length acquired based on the detection result of the boom cylinder stroke sensor 16. The sensor controller 30 calculates a tilt angle θ2 (see FIG. 2) of the arm 7 with respect to the boom 6 from the arm cylinder length acquired based on the detection result of the arm cylinder stroke sensor 17. The sensor controller 30 calculates a tilt angle θ3 (see FIG. 2) of the cutting edge 8*a* of the bucket 8 with respect to the arm 7 from the bucket cylinder length acquired based on the detection result of the bucket cylinder stroke sensor 18.

Note that the tilt angle θ1 of the boom 6, the tilt angle θ2 of the arm 7, and the tilt angle θ3 of the bucket 8 may not be detected by the cylinder stroke sensors. The tilt angle θ1 of the boom 6 may be detected by an angle detector such as a rotary encoder. The angle detector detects a bending angle of the boom 6 with respect to the swinging structure 3 to detect the tilt angle θ1. Similarly, the tilt angle θ2 of the arm 7 may be detected by an angle detector attached to the arm 7. The tilt angle θ3 of the bucket 8 may be detected by an angle detector attached to the bucket 8.

The sensor controller 30 acquires cylinder length data L from the detection result of each of the cylinder stroke sensors 16, 17, and 18. The sensor controller 30 outputs data of the tilt angle θ4 and data of the tilt angle θ5 output from the IMU 24. The sensor controller 30 outputs the cylinder length data L, the data of the tilt angle θ4, and the data of the tilt angle θ5 to the display controller 28 and the work machine controller 26, respectively.

As described above, in the present embodiment, the detection results of the cylinder stroke sensors (16, 17, and 18) and the detection result of the IMU 24 are output to the sensor controller 30, and the sensor controller 30 performs a predetermined calculating process. In the present embodiment, the functions of the sensor controller 30 may be performed by the work machine controller 26. For example, the detection results of the cylinder stroke sensors (16, 17, and 18) may be output to the work machine controller 26, and the work machine controller 26 may calculate the cylinder lengths (the boom cylinder length, the arm cylinder length, and the bucket cylinder length) based on the detection results of the cylinder stroke sensors (16, 17, and 18). The detection result of the IMU 24 may be output to the work machine controller 26.

The display controller 28 includes a target construction information storage unit 28A, a bucket position data generating unit 28B, and a target excavation landform data generating unit 28C. The display controller 28 acquires the reference position data P and the swinging structure direction data Q from the global coordinate calculating unit 23. The display controller 28 acquires cylinder tilt data indicating tilt angles θ1, θ2, and θ3 from the sensor controller 30.

The work machine controller 26 acquires the reference position data P, the swinging structure direction data Q, and the cylinder length data L from the display controller 28. The work machine controller 26 generates bucket position data indicating a three-dimensional position P3 of the bucket 8 based on the reference position data P, the swinging structure direction data Q, and the tilt angles θ1, θ2, and θ3. In the present embodiment, the bucket position data is cutting edge position data S indicating a three-dimensional position of the cutting edge 8*a*.

The bucket position data generating unit 28B generates the bucket position data (cutting edge position data S) indicating a three-dimensional position of the bucket 8 based on the reference position data P, the swinging structure direction data Q, the tilt angles θ1, θ2, and θ3. That is, in the present embodiment, each of the work machine controller 26 and the display controller 28 generates the cutting edge position data S. In addition, the display controller 28 may acquire the cutting edge position data S from the work machine controller 26.

The bucket position data generating unit 28B generates a target excavation landform U indicating a target shape of an excavation object using the cutting edge position data S and target construction information T to be described later stored in the target construction information storage unit 28A. Moreover, the display controller 28 displays the target excavation landform U and the cutting edge position data S on the display unit 29. The display unit 29 is a monitor, for example, and displays various types of information of the excavator 100. In the present embodiment, the display unit 29 includes a human machine interface (HMI) monitor as an information-oriented construction guidance monitor.

The target construction information storage unit 28A stores the target construction information (three-dimensional designed landform data) T indicating a three-dimensional designed landform which is a target shape of a work area. The target construction information T includes coordinate data and angle data necessary for generating the target excavation landform (designed landform data) U indicating a designed landform which is a target shape of an excavation object. The target construction information T may be supplied to the display controller 28 via a radio communication device, for example. Note that the position information of the cutting edge 8*a* may be transferred from a connection-type recording device such as a memory.

Figure 6:
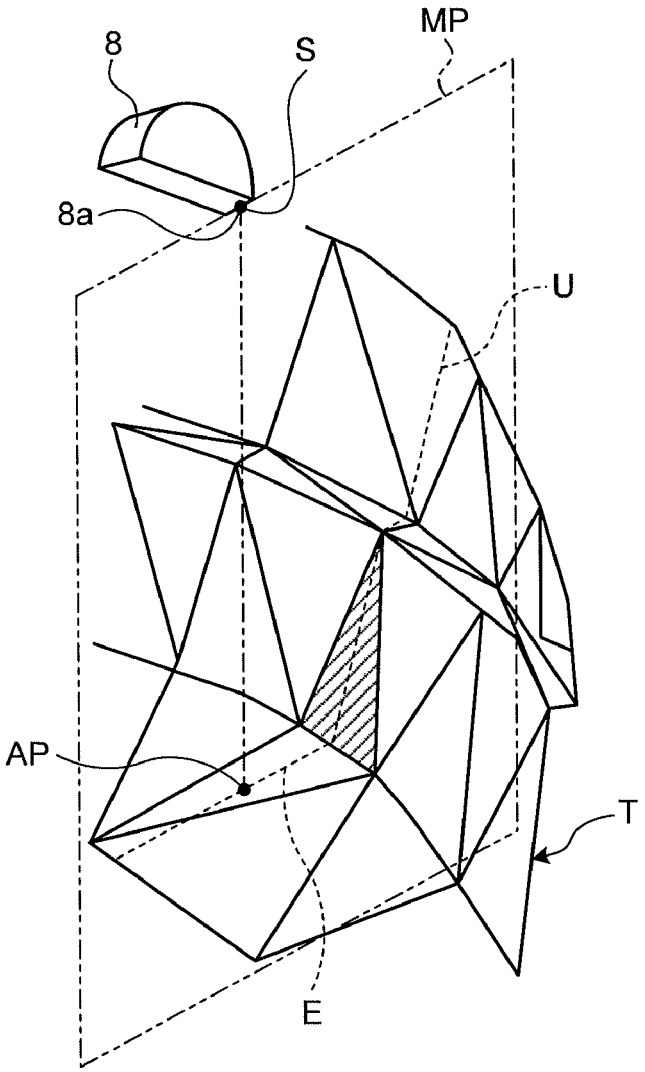
FIG. 6 is a schematic view illustrating an example of target construction information.

The target excavation landform data generating unit 28C acquires a nodal line E between a working plane MP of the work machine 2 defined in the front-rear direction of the swinging structure 3 and the three-dimensional designed landform as illustrated in FIG. 6 as a candidate line of the target excavation landform U based on the target construction information T and the cutting edge position data S. The target excavation landform data generating unit 28C sets a point located immediately below the bucket cutting edge 8*a* in the candidate line of the target excavation landform U as a reference point AP of the target excavation landform U. The display controller 28 determines one or more inflection points appearing before and after the reference point AP of the target excavation landform U and lines appearing before and after the inflection points as the target excavation landform U which serves as an excavation object. The target excavation landform data generating unit 28C generates the target excavation landform U indicating a designed landform which is a target shape of the excavation object. The target excavation landform data generating unit 28C displays the target excavation landform U on the display unit 29 based on the target excavation landform U. The target excavation landform U is work data used for excavation work. The target excavation landform U is displayed on the display unit 29 based on display designed landform data used for displaying on the display unit 29.

The display controller 28 is capable of calculating the local coordinate position when seen in the global coordinate system based on the detection result of the position detection device 20. The local coordinate system is a three-dimensional coordinate system based on the excavator 100. The reference position of the local coordinate system is the reference position P2 positioned at the swing center AX of the swinging structure 3, for example.

The work machine controller 26 includes a target speed determining unit 52, a distance acquiring unit 53, a speed limit determining unit 54, and a work machine control unit 57. The work machine controller 26 acquires the detection pressure MB, MA, and MT, acquires the tilt angles θ1, θ2, θ3, and θ5 from the sensor controller 30, acquires the target excavation landform U from the display controller 28, and outputs a control signal CBI to the control valve 27.

The target speed determining unit 52 calculates the tilt angle θ5 with respect to the front-rear direction of the vehicle body 1 and the detection pressure MB, MA, and MT acquired from the pressure sensor 66 as target speeds Vc_bm, Vc_am, and Vc_bk corresponding to the lever operations for driving the respective work machines of the the boom 6, the arm 7, and the bucket 8.

When the distance acquiring unit 53 corrects the pitch of the distance of the cutting edge 8*a* of the bucket 8 in a cycle (for example, every 10 msec) shorter than that used in the display controller 28, the distance acquiring unit 53 uses the angle θ5 output from the IMU 24 in addition to the tilt angles θ1, θ2, and θ3. The position relation between the reference position P2 of the local coordinate system and the installed position P1 of the antenna 21 is known. The work machine controller 26 calculates the cutting edge position data S indicating a position P3 of the cutting edge 8*a* in the local coordinate system from the detection result of the position detection device 20 and the position information of the antenna 21.

The distance calculating unit 53 acquires the target excavation landform U from the display controller 28. The work machine controller 26 calculates a distance d between the cutting edge 8*a* of the bucket 8 in the direction vertical to the target excavation landform U and the target excavation landform U based on the acquired cutting edge position data S indicating the position P3 of the cutting edge 8*a* in the local coordinate system and the target excavation landform U.

The speed limit determining unit 54 acquires a speed limit in the vertical direction with respect to the target excavation landform U corresponding to the distance d. The speed limit includes table information or graph information stored in advance in a storage unit 26G (see FIG. 24) of the work machine controller 26. Moreover, the speed limit determining unit 54 calculates a relative speed of the cutting edge 8*a* in the vertical direction with respect to the target excavation landform U based on the target speeds Vc_bm, Vc_am, and Vc_bk of the cutting edge 8*a* acquired from the target speed determining unit 52. The work machine controller 26 calculates a speed limit Vc_lmt of the cutting edge 8*a* based on the distance d. The speed limit determining unit 54 calculates a boom speed limit Vc_bm_lmt for limiting the movement of the boom 6 based on the distance d, the target speeds Vc_bm, Vc_am, and Vc_bk, and the speed limit Vc_lmt.

The work machine control unit 57 acquires the boom speed limit Vc_bm_lmt and generates a control signal CBI to a control valve 27C for outputting a raising command to the boom cylinder 10 based on the boom speed limit Vc_bm_lmt so that the relative speed of the cutting edge 8*a* becomes equal to or less than the speed limit. The work machine controller 26 outputs a control signal for limiting the speed of the boom 6 to the control valve 27C connected to the boom cylinder 10.

Figure 7:
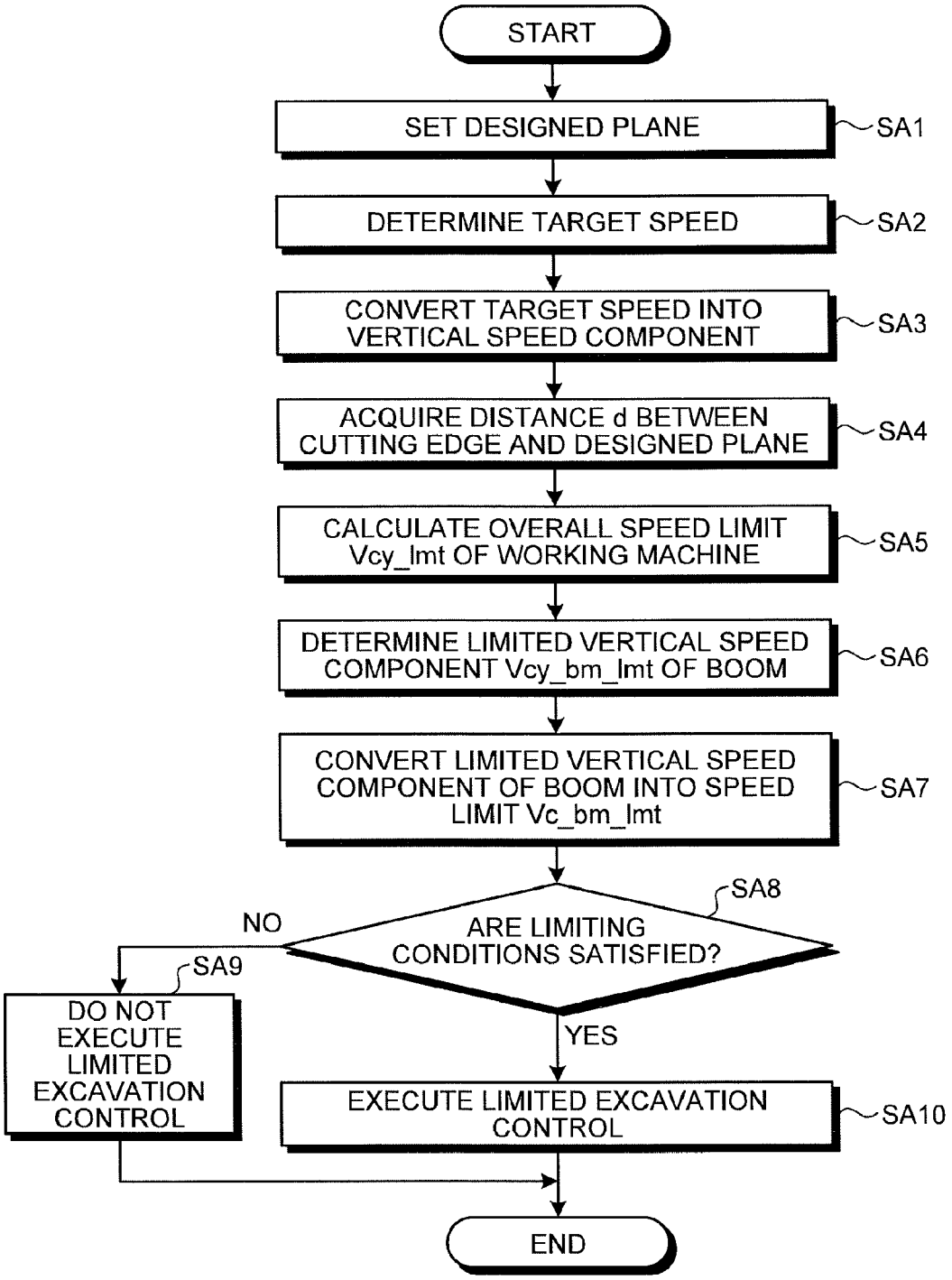
FIG. 7 is a flowchart illustrating an example of limited excavation control.

Hereinafter, an example of limited excavation control according to the present embodiment will be described with reference to the flowchart of FIG. 7 and the schematic diagrams of FIGS. 8 to 15. FIG. 7 is a flowchart illustrating an example of the limited excavation control according to the present embodiment.

As described above, the target excavation landform U is set (step SA1). After the target excavation landform U is set, the work machine controller 26 determines a target speed Vc of the work machine 2 (step SA2). The target speed Vc of the work machine 2 includes the boom target speed Vc_bm, the arm target speed Vc_am, and a bucket target speed Vc_bkt. The boom target speed Vc_bm is a speed of the cutting edge 8*a* when the boom cylinder 10 only is driven. The arm target speed Vc_am is a speed of the cutting edge 8*a* when the arm cylinder 11 only is driven. The bucket target speed Vc_bkt is a speed of the cutting edge 8*a* when the bucket cylinder 12 only is driven. The boom target speed Vc_bm is calculated based on an amount of boom operation. The arm target speed Vc_am is calculated based on an amount of arm operation. The bucket target speed Vc_bkt is calculated based on an amount of bucket operation.

Target speed information that defines the relation between the amount of boom operation and the boom target speed Vc_bm is stored in the storage unit 26G of the work machine controller 26. The work machine controller 26 determines the boom target speed Vc_bm corresponding to the amount of boom operation based on the target speed information. The target speed information is, for example, a map in which the magnitude of the boom target speed Vc_bm with respect to the amount of boom operation is described. The target speed information may be in a form of a table, a numerical expression, or the like. The target speed information includes information that defines the relation between the amount of arm operation and the arm target speed Vc_am. The target speed information includes information that defines the relation between the amount of bucket operation and the bucket target speed Vc_bkt. The work machine controller 26 determines the arm target speed Vc_am corresponding to the amount of arm operation based on the target speed information. The work machine controller 26 determines the bucket target speed Vc_bkt corresponding to the amount of bucket operation based on the target speed information.

Figure 8:
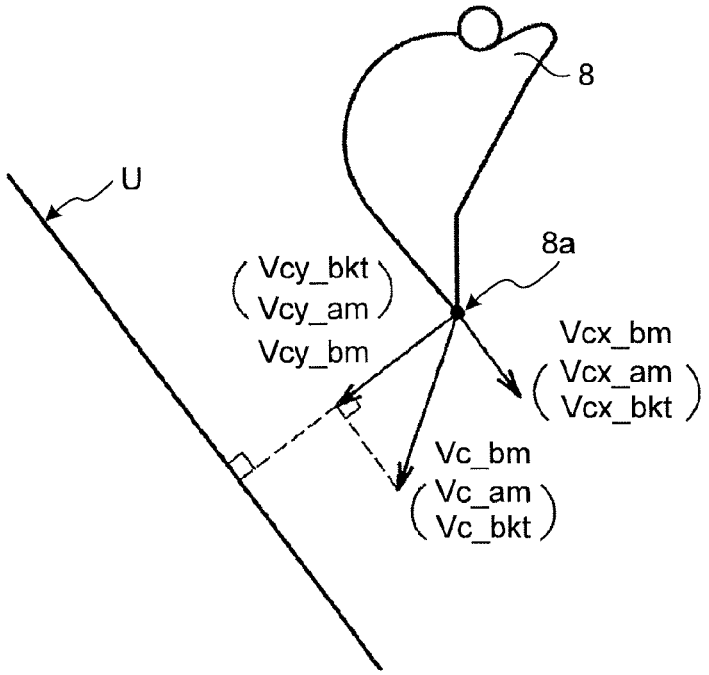
FIG. 8 is a diagram for describing an example of the limited excavation control.

As illustrated in FIG. 8, the work machine controller 26 converts the boom target speed Vc_bm into a speed component (vertical speed component) Vcy_bm in the direction vertical to a surface of the target excavation landform U and a speed component (horizontal speed component) Vcx_bm in the direction parallel to the surface of the target excavation landform U (step SA3).

The work machine controller 26 obtains an inclination of the vertical axis (the swing axis AX of the swinging structure 3) of the local coordinate system with respect to the vertical axis of the global coordinate system and an inclination in the vertical direction of the surface of the target excavation landform U with respect to the vertical axis of the global coordinate system from the reference position data P, the target excavation landform U, and the like. The work machine controller 26 obtains an angle β1 representing the inclination between the vertical axis of the local coordinate system and the vertical direction of the surface of the target excavation landform U from these inclinations.

Figure 9:
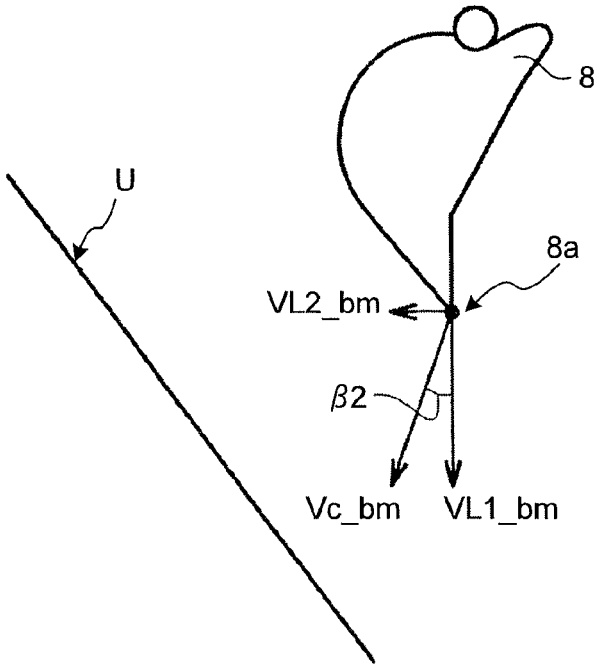
FIG. 9 is a diagram for describing an example of the limited excavation control.

As illustrated in FIG. 9, the work machine controller 26 converts the boom target speed Vc_bm into a speed component VL1_*bm* in the vertical axis direction of the local coordinate system and a speed component VL2_*bm* in the horizontal axis direction by a trigonometric function from an angle β2 between the vertical axis of the local coordinate system and the direction of the boom target speed Vc_bm.

Figure 10:
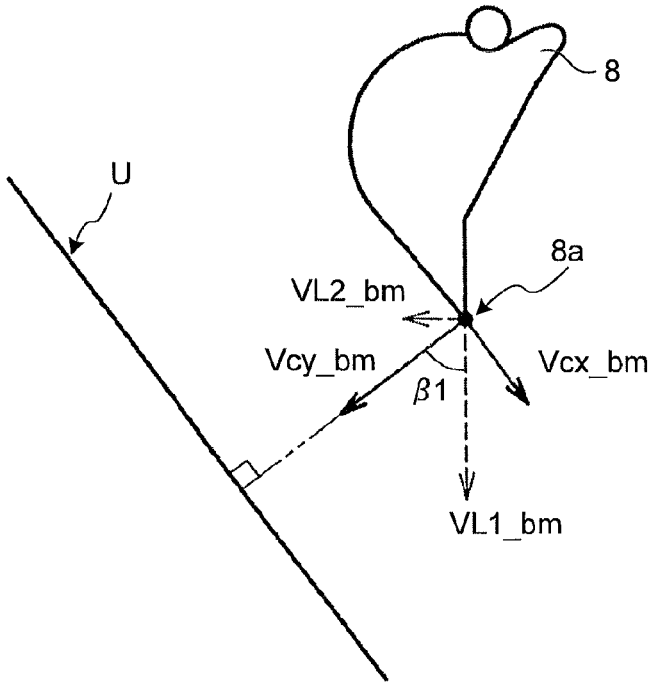
FIG. 10 is a diagram for describing an example of the limited excavation control.

As illustrated in FIG. 10, the work machine controller 26 converts the speed component VL1_*bm* in the vertical axis direction of the local coordinate system and the speed component VL2_*bm* in the horizontal axis direction into a vertical speed component Vcy_bm and a horizontal speed component Vcx_bm with respect to the target excavation landform U by a trigonometric function from the inclination β1 between the vertical axis of the local coordinate system and the vertical direction of the surface of the target excavation landform U. Similarly, the work machine controller 26 converts the arm target speed Vc_am into a vertical speed component Vcy_am and a horizontal speed component Vcx_am in the vertical axis direction of the local coordinate system. The work machine controller 26 converts the bucket target speed Vc_bkt into a vertical speed component Vcy_bkt and a horizontal speed component Vcx_bkt in the vertical axis direction of the local coordinate system.

Figure 11:
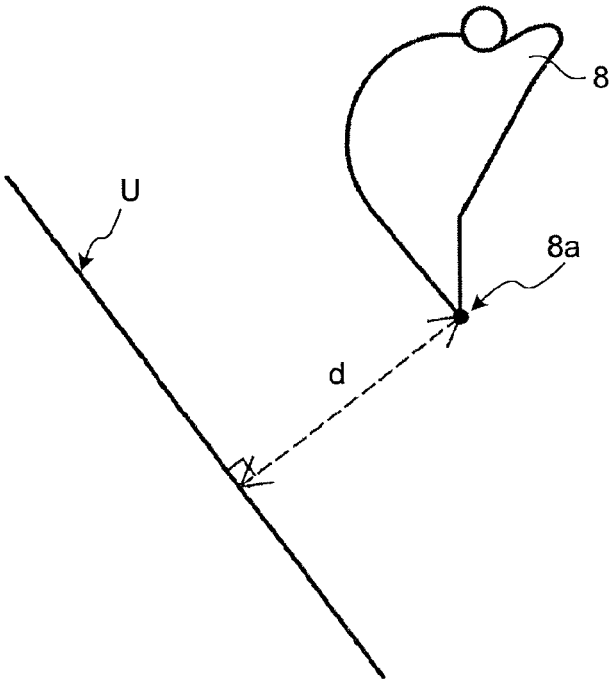
FIG. 11 is a diagram for describing an example of the limited excavation control.

As illustrated in FIG. 11, the work machine controller 26 acquires the distance d between the cutting edge 8*a* of the bucket 8 and the target excavation landform U (step SA4). The work machine controller 26 calculates the shortest distance d between the cutting edge 8*a* of the bucket 8 and the surface of the target excavation landform U from the position information of the cutting edge 8*a*, the target excavation landform U, and the like. In the present embodiment, the limited excavation control is executed based on the shortest distance d between the cutting edge 8*a* of the bucket 8 and the surface of the target excavation landform U.

The work machine controller 26 calculates an overall speed limit Vcy_lmt of the work machine 2 based on the distance d between the cutting edge 8*a* of the bucket 8 and the surface of the target excavation landform U (step SA5). The overall speed limit Vcy_lmt of the work machine 2 is an allowable moving speed of the cutting edge 8*a* in the direction in which the cutting edge 8*a* of the bucket 8 approaches the target excavation landform U. Speed limit information that defines the relation between the distance d and the speed limit Vcy_lmt is stored in a storage unit 261 of the work machine controller 26.

Figure 12:
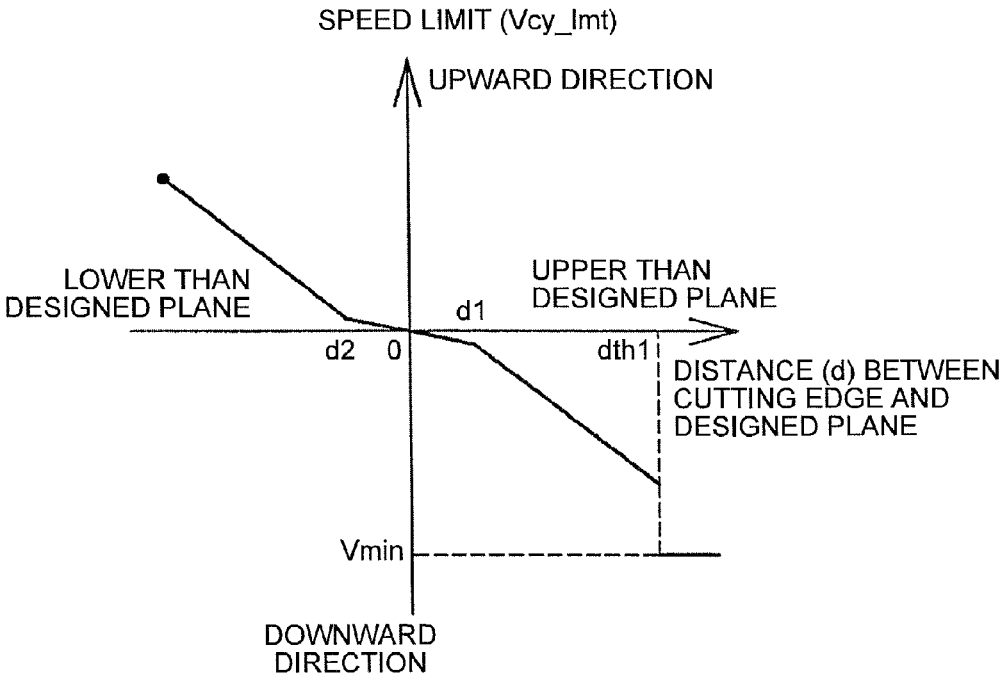
FIG. 12 is a diagram for describing an example of limited excavation control.

FIG. 12 illustrates an example of the speed limit information according to the present embodiment. In the present embodiment, the distance d has a positive value when the cutting edge 8*a* is positioned on the outer side of the surface of the target excavation landform U, that is, on the side close to the work machine 2 of the excavator 100, and the distance d has a negative value when the cutting edge 8*a* is positioned on the inner side of the surface of the target excavation landform U, that is, on the inner side of the excavation object than the target excavation landform U. As illustrated in FIG. 11, the distance d has a positive value when the cutting edge 8*a* is positioned above the surface of the target excavation landform U. The distance d has a negative value when the cutting edge 8*a* is positioned under the surface of the target excavation landform U. Moreover, the distance d has a positive value when the cutting edge 8*a* is positioned at such a position that the cutting edge 8*a* does not dig into the target excavation landform U. The distance d has a negative value when the cutting edge 8*a* is positioned at such a position that the cutting edge 8*a* digs into the target excavation landform U. The distance d is zero when the cutting edge 8*a* is positioned on the target excavation landform U, that is, when the cutting edge 8*a* is in contact with the target excavation landform U.

In the present embodiment, the speed has a positive value when the cutting edge 8*a* moves from the inner side of the target excavation landform U toward the outer side, and the speed has a negative value when the cutting edge 8*a* moves from the outer side of the target excavation landform U toward the inner side. That is, the speed has a positive value when the cutting edge 8*a* moves toward the upper side of the target excavation landform U, and the speed has a negative value when the cutting edge 8*a* moves toward the lower side of the target excavation landform U.

In the speed limit information, an inclination of the speed limit Vcy_lmt when the distance d is between d1 and d2 is smaller than an inclination when the distance d is equal to or more than d1 or equal to or less than d2. d1 is larger than zero. d2 is smaller than zero. In operations near the surface of the target excavation landform U, in order to set the speed limit more accurately, the inclination when the distance d is between d1 and d2 is made smaller than the inclination when the distance d is equal to or more than d1 or equal to or less than d2. The speed limit Vcy_lmt has a negative value when the distance d is equal to or more than d1, and the larger the distance d, the smaller the speed limit Vcy_lmt. That is, when the distance d is equal to or more than d1, the farther the cutting edge 8*a* above the target excavation landform U from the surface of the target excavation landform U, the larger the speed of moving toward the lower side of the target excavation landform U and the larger the absolute value of the speed limit Vcy_lmt. When the distance d is equal to or less than zero, the speed limit Vcy_lmt has a positive value, and the smaller the distance d, the larger the speed limit Vcy_lmt. That is, when the distance d of the cutting edge 8*a* of the bucket 8 from the target excavation landform U is equal to or less than zero, the farther the cutting edge 8*a* on the lower side of the target excavation landform U from the target excavation landform U, the larger the speed of moving toward the upper side of the target excavation landform U, and the larger the absolute value of the speed limit Vcy_lmt.

When the distance d is equal to or more than a predetermined value dth1, the speed limit Vcy_lmt becomes Vmin. The predetermined value dth1 is a positive value and is larger than d1. Vmin is smaller than the smallest value of the target speed. That is, when the distance d is equal to or more than the predetermined value dth1, the operation of the work machine 2 is not limited. Thus, when the cutting edge 8*a* is separated greatly from the target excavation landform U on the upper side of the target excavation landform U, the operation of the work machine 2 is not limited, that is, the limited excavation control is not performed. When the distance d is smaller than the predetermined value dth1, the operation of the work machine 2 is limited. When the distance d is smaller than the predetermined value dth1, the operation of the boom 6 is limited.

The work machine controller 26 calculates a vertical speed component (limited vertical speed component) Vcy_bm_lmt of the speed limit of the boom 6 from the overall speed limit Vcy_lmt of the work machine 2, the arm target speed Vc_am, and the bucket target speed Vc_bkt (step SA6).

Figure 13:
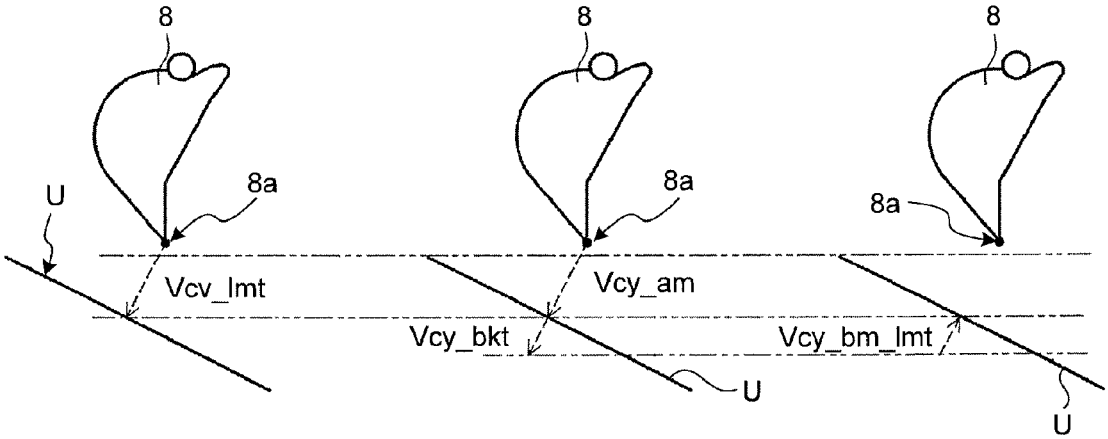
FIG. 13 is a diagram for describing an example of the limited excavation control.

As illustrated in FIG. 13, the work machine controller 26 calculates the limited vertical speed component Vcy_bm_lmt of the boom 6 by subtracting the vertical speed component Vcy_am of the arm target speed and the vertical speed component Vcy_bkt of the bucket target speed from the overall speed limit Vcy_lmt of the work machine 2.

Figure 14:
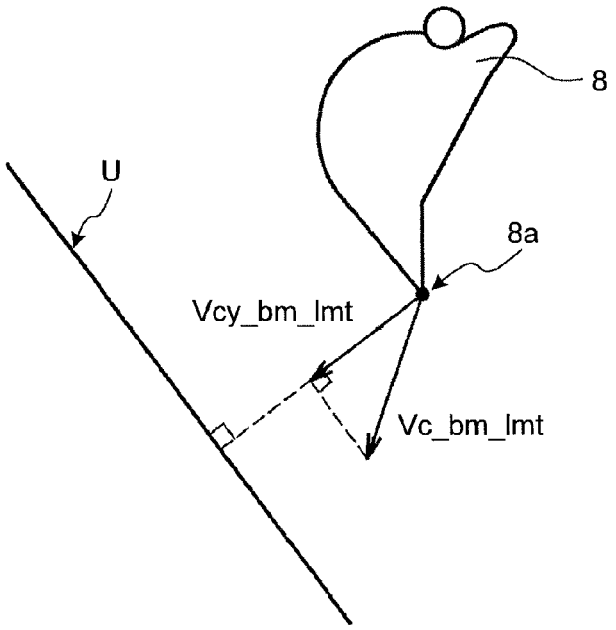
FIG. 14 is a diagram for describing an example of the limited excavation control.

As illustrated in FIG. 14, the work machine controller 26 converts the limited vertical speed component Vcy_bm_lmt of the boom 6 into a speed limit (boom speed limit) Vc_bm_lmt of the boom 6 (step SA7). The work machine controller 26 obtains the relation between a direction vertical to the surface of the target excavation landform U and the direction of the boom speed limit Vc_bm_lmt from the tilt angle θ1 of the boom 6, the tilt angle θ2 of the arm 7, the tilt angle θ3 of the bucket 8, the vehicle body position data P, the target excavation landform U, and the like and converts the limited vertical speed component Vcy_bm_lmt of the boom 6 into the boom speed limit Vc_bm_lmt. The calculation in this case is performed in a reverse order to that of the above-described calculation of obtaining the vertical speed component Vcy_bm in the direction vertical to the surface of the target excavation landform U from the boom target speed Vc_bm. After that, a cylinder speed corresponding to a boom intervention amount is determined, and an opening command corresponding to the cylinder speed is output to the control valve 27C.

The pilot pressure based on the lever operation is filled in an oil passage 451B and the pilot pressure based on boom intervention is filled in an oil passage 502. A shuttle valve 51 selects the oil passage having the larger pressure (step SA8).

For example, in a case of lowering the boom 6, when the magnitude of the boom speed limit Vc_bm_lmt in the downward direction of the boom 6 is smaller than the magnitude of the boom target speed Vc_bm in the downward direction, limiting conditions are satisfied. Moreover, in a case of raising the boom 6, when the magnitude of the boom speed limit Vc_bm_lmt in the upward direction of the boom 6 is larger than the magnitude of the boom target speed Vc_bm in the upward direction, the limiting conditions are satisfied.

The work machine controller 26 controls the work machine 2. When controlling the boom 6, the work machine controller 26 controls the boom cylinder 10 by transmitting a boom command signal to the control valve 27C. The boom command signal has a current value corresponding to a boom command speed. If necessary, the work machine controller 26 controls the arm 7 and the bucket 8. The work machine controller 26 controls the arm cylinder 11 by transmitting an arm command signal to the control valve 27. The arm command signal has a current value corresponding to an arm command speed. The work machine controller 26 controls the bucket cylinder 12 by transmitting a bucket command signal to the control valve 27. The bucket command signal has a current value corresponding to a bucket command speed.

When the limiting conditions are not satisfied, the shuttle valve 51 selects the supply of operating oil from the oil passage 451B, and a normal operation is performed (step SA9). The work machine controller 26 operates the boom cylinder 10, the arm cylinder 11, and the bucket cylinder 12 according to the amount of boom operation, the amount of arm operation, and the amount of bucket operation. The boom cylinder 10 operates at the boom target speed Vc_bm. The arm cylinder 11 operates at the arm target speed Vc_am. The bucket cylinder 12 operates at the bucket target speed Vc_bkt.

When the limiting conditions are satisfied, the shuttle valve 51 selects the supply of operating oil from the oil passage 502, and the limited excavation control is executed (step SA10).

The limited vertical speed component Vcy_bm_lmt of the boom 6 is calculated by subtracting the vertical speed component Vcy_am of the arm target speed and the vertical speed component Vcy_bkt of the bucket target speed from the overall speed limit Vcy_lmt of the work machine 2. Thus, when the overall speed limit Vcy_lmt of the work machine 2 is smaller than the sum of the vertical speed component Vcy_am of the arm target speed and the vertical speed component Vcy_bkt of the bucket target speed, the limited vertical speed component Vcy_bm_lmt of the boom 6 becomes such a negative value that the boom is raised.

Thus, the boom speed limit Vc_bm_lmt becomes a negative value. In this case, the work machine controller 27 lowers the boom 6 at a speed lower than the boom target speed Vc_bm. For this reason, it is possible to prevent the bucket 8 from digging into the target excavation landform U while suppressing the sense of incongruity the operator might feel.

When the overall speed limit Vcy_lmt of the work machine 2 is larger than the sum of the vertical speed component Vcy_am of the arm target speed and the vertical speed component Vcy_bkt of the bucket target speed, the limited vertical speed component Vcy_bm_lmt of the boom 6 becomes a positive value. Thus, the boom speed limit Vc_bm_lmt becomes a positive value. In this case, even when the operating device 25 is operated in a direction in which the boom 6 is lowered, the work machine controller 26 raises the boom 6. For this reason, it is possible to quickly suppress expansion of a dug area of the target excavation landform U.

When the cutting edge 8*a* is positioned above the target excavation landform U, the closer the cutting edge 8*a* to the target excavation landform U, the smaller the absolute value of the limited vertical speed component Vcy_bm_lmt of the boom 6, and also the smaller the absolute value of a speed component (limited horizontal speed component) Vcx_bm_lmt of the speed limit of the boom 6 in the direction parallel to the surface of the target excavation landform U. Thus, when the cutting edge 8*a* is positioned above the target excavation landform U, the closer the cutting edge 8*a* to the target excavation landform U, the more both the speed of the boom 6 in the direction vertical to the surface of the target excavation landform U and the speed of the boom 6 in the direction parallel to the surface of the target excavation landform U are reduced. When the left operating lever 25L and the right operating lever 25R are operated simultaneously by the operator of the excavator 100, the boom 6, the arm 7, and the bucket 8 are operated simultaneously. In this case, the above-described control when the target speeds Vc_bm, Vc_am, and Vc_bkt of the boom 6, the arm 7, and the bucket 8 are input will be described below.

Figure 15:
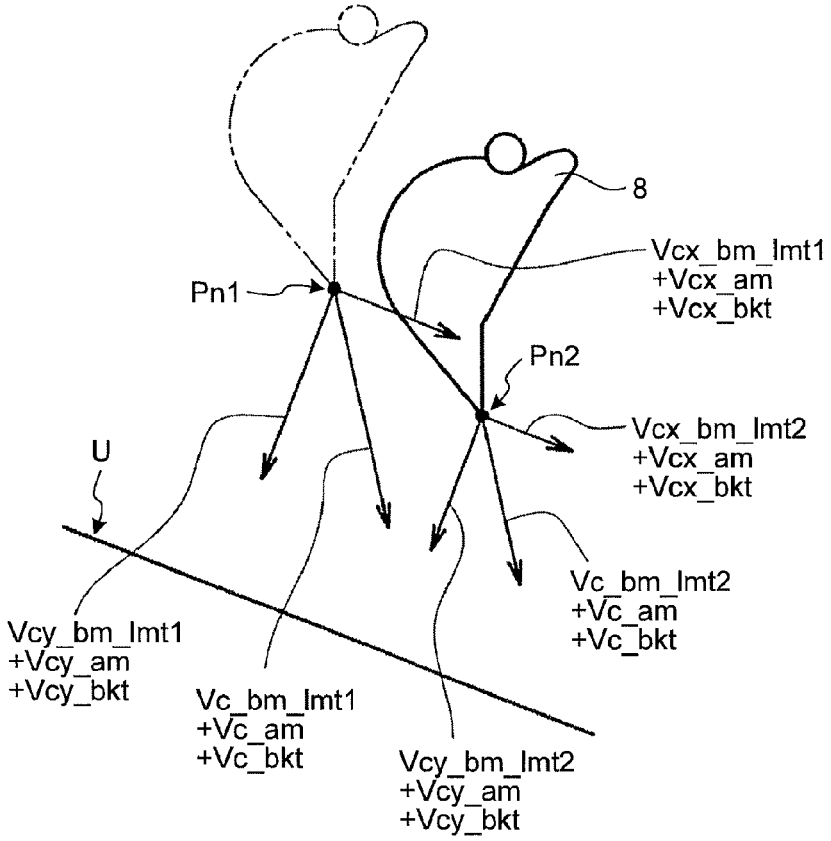
FIG. 15 is a diagram for describing an example of the limited excavation control.

FIG. 15 illustrates an example of a change in the speed limit of the boom 6 when the distance d between the target excavation landform U and the cutting edge 8*a* of the bucket 8 is smaller than the predetermined value dth1 and the cutting edge 8*a* of the bucket 8 moves from the position Pn1 to the position Pn2. The distance between the cutting edge 8*a* at the position Pn2 and the target excavation landform U is smaller than the distance between the cutting edge 8*a* at the position Pn1 and the target excavation landform U. For this reason, a limited vertical speed component Vcy_bm_lmt2 of the boom 6 at the position Pn2 is smaller than a limited vertical speed component Vcy_bm_lmt1 of the boom 6 at the position Pn1. Thus, a boom speed limit Vc_bm_lmt2 at the position Pn2 becomes smaller than a boom speed limit Vc_bm_lmt1 at the position Pn1. Moreover, a limited horizontal speed component Vcx_bm_lmt2 of the boom 6 at the position Pn2 becomes smaller than a limited horizontal speed component Vcx_bm_lmt1 of the boom 6 at the position Pn1. However, in this case, the arm target speed Vc_am and the bucket target speed Vc_bkt are not limited. For this reason, the vertical speed component Vcy_am and the horizontal speed component Vcx_am of the arm target speed and the vertical speed component Vcy_bkt and the horizontal speed component Vcx_bkt of the bucket target speed are not limited.

As described above, since no limitation is applied to the arm 7, a change in the amount of arm operation corresponding to the operator's intention to excavate is reflected as a change in the speed of the cutting edge 8*a* of the bucket 8. For this reason, the present embodiment can suppress the sense of incongruity during the excavation operation of the operator while suppressing expansion of a dug area of the target excavation landform U.

In this manner, in the present embodiment, the work machine controller 26 limits the speed of the boom 6 based on the target excavation landform U indicating the designed landform which is a target shape of an excavation object and the cutting edge position data S indicating the position of the cutting edge 8*a* of the bucket 8 so that a relative speed at which the bucket 8 approaches the target excavation landform U decreases according to the distance d between the target excavation landform U and the cutting edge 8*a* of the bucket 8. The work machine controller 26 determines the speed limit according to the distance d between the target excavation landform U and the cutting edge 8*a* of the bucket 8 based on the target excavation landform U indicating the designed landform which is a target shape of an excavation object and the cutting edge position data S indicating the position of the cutting edge 8*a* of the bucket 8 and controls the work machine 2 so that the speed in the direction in which the work machine 2 approaches the target excavation landform U is equal to or less than the speed limit. In this way, the limited excavation control on the cutting edge 8*a* is executed, and the position of the cutting edge 8*a* with respect to the target excavation landform U is controlled.

In the following description, outputting the control signal to the control valve 27 connected to the boom cylinder 10 to control the position of the boom 6 so that digging of the cutting edge 8*a* into the target excavation landform U is suppressed is referred to as intervention control.

The intervention control is executed when the relative speed of the cutting edge 8*a* in the vertical direction with respect to the target excavation landform U is larger than the speed limit. The intervention control is not executed when the relative speed of the cutting edge 8*a* is smaller than the speed limit. The fact that the relative speed of the cutting edge 8*a* is smaller than the speed limit includes the fact that the bucket 8 moves with respect to the target excavation landform U so that the bucket 8 is separated from the target excavation landform U.

[Cylinder Stroke Sensor]

Figure 16:
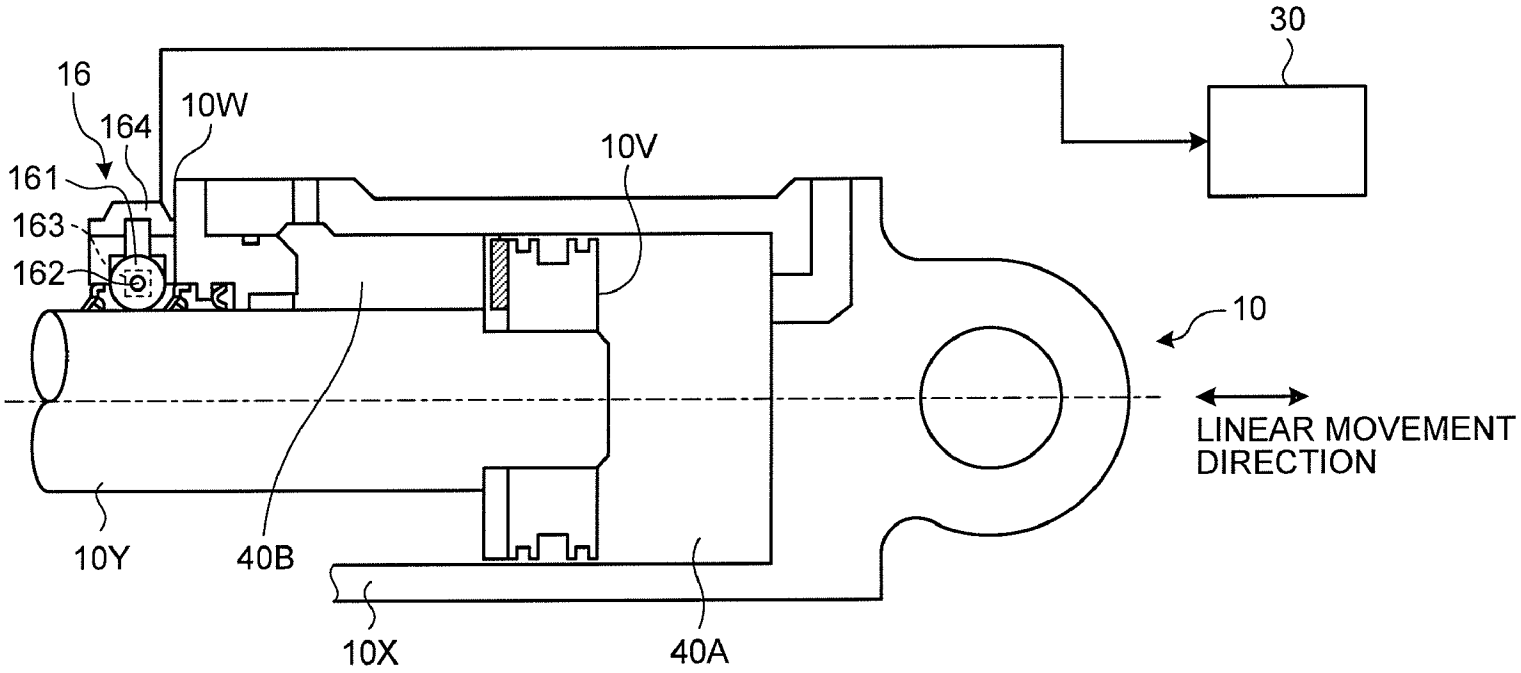
FIG. 16 is a diagram illustrating an example of a hydraulic cylinder.

Next, the boom cylinder stroke sensor 16 will be described with reference to FIGS. 16 and 17. In the following description, the boom cylinder stroke sensor 16 attached to the boom cylinder 10 will be described. The arm cylinder stroke sensor 17 and the like attached to the arm cylinder 11 have the same configuration as the cylinder stroke sensor 16.

The boom cylinder stroke sensor 16 is attached to the boom cylinder 10. The boom cylinder stroke sensor 16 measures the stroke of a piston. As illustrated in FIG. 16, the boom cylinder 10 includes a cylinder tube 10X and a cylinder rod 10Y capable of movement relative to the cylinder tube 10X within the cylinder tube 10X. A piston 10V is slidably provided in the cylinder tube 10X. The cylinder rod 10Y is attached to the piston 10V. The cylinder rod 10Y is slidably provided in a cylinder head 10W. A chamber defined by the cylinder head 10W, the piston 10V, and a cylinder inner wall is a rod-side oil chamber 40B. An oil chamber on the opposite side of the rod-side oil chamber 40B with the piston 10V interposed is a cap-side oil chamber 40A. Note that a seal member is provided in the cylinder head 10W so as to seal the gap between the cylinder head 10W and the cylinder rod 10Y so that dust or the like does not enter the rod-side oil chamber 40B.

The cylinder rod 10Y retracts when operating oil is supplied to the rod-side oil chamber 40B and the operating oil is discharged from the cap-side oil chamber 40A. Moreover, the cylinder rod 10Y extends when operating oil is discharged from the rod-side oil chamber 40B and the operating oil is supplied to the cap-side oil chamber 40A. That is, the cylinder rod 10Y moves linearly in the left-right direction in the figure.

A case 164 that covers the boom cylinder stroke sensor 16 and accommodates the boom cylinder stroke sensor 16 is provided at a location outside the rod-side oil chamber 40B in the proximity of the cylinder head 10W. The case 164 is fixed to the cylinder head 10W by being fastened to the cylinder head 10W by a bolt or the like.

The boom cylinder stroke sensor 16 includes a rotation roller 161, a rotation center shaft 162, and a rotation sensor portion 163. The rotation roller 161 has a surface in contact with the surface of the cylinder rod 10Y and is provided so as to rotate according to linear movement of the cylinder rod 10Y. That is, linear movement of the cylinder rod 10Y is converted into rotational movement by the rotation roller 161. The rotation center shaft 162 is disposed so as to be orthogonal to the direction of linear movement of the cylinder rod 10Y.

The rotation sensor portion 163 is configured to be capable of detecting the amount of rotation (rotation angle) of the rotation roller 161 as an electrical signal. The electrical signal indicating the amount of rotation (rotation angle) of the rotation roller 161 detected by the rotation sensor portion 163 is output to the sensor controller 30 via an electrical signal line. The sensor controller 30 converts the electrical signal into the position (stroke position) of the cylinder rod 10Y of the boom cylinder 10.

Figure 17:
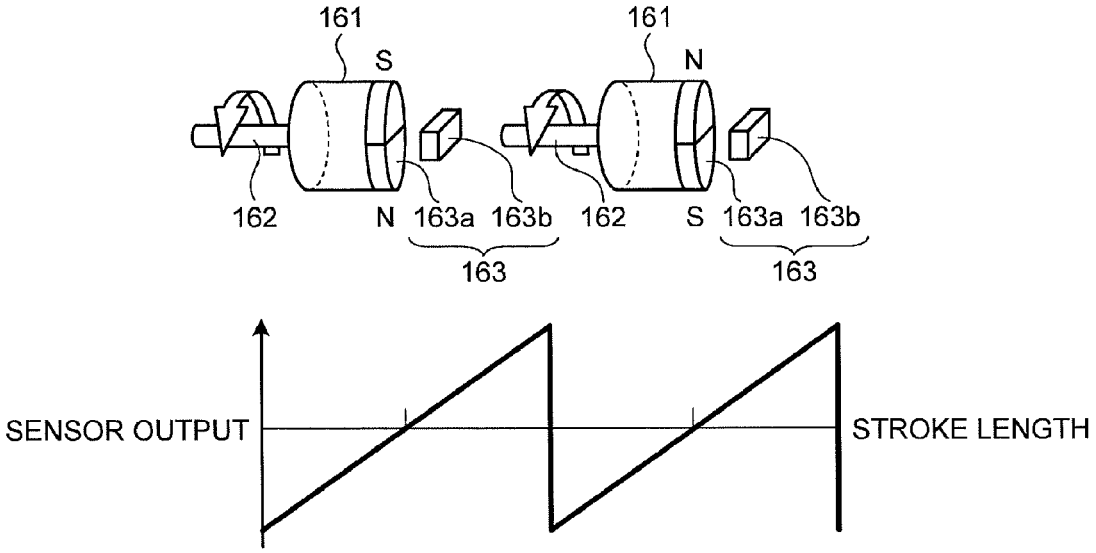
FIG. 17 is a diagram illustrating an example of a stroke sensor.

As illustrated in FIG. 17, the rotation sensor portion 163 includes a magnet 163*a* and a hall IC 163*b*. The magnet 163*a* which is a detecting medium is attached to the rotation roller 161 so as to rotate integrally with the rotation roller 161. The magnet 163*a* rotates according to rotation of the rotation roller 161 around the rotation center shaft 162. The magnet 163*a* is configured such that the N pole and the S pole alternate according to the rotation angle of the rotation roller 161. The magnet 163*a* is configured such that magnetic force (magnetic flux density) detected by the hall IC 163*b* changes periodically every rotation of the rotation roller 161.

The hall IC 163*b* is a magnetic force sensor that detects the magnetic force (magnetic flux density) generated by the magnet 163*a* as an electrical signal. The hall IC 163*b* is provided along the axial direction of the rotation center shaft 162 at a position separated by a predetermined distance from the magnet 163*a*.

The electrical signal (phase shift pulse) detected by the hall IC 163*b* is output to the sensor controller 30. The sensor controller 30 converts the electrical signal from the hall IC 163*b* into an amount of rotation of the rotation roller 161, that is, a displacement amount (boom cylinder length) of the cylinder rod 10Y of the boom cylinder 10.

Here, the relation between the rotation angle of the rotation roller 161 and the electrical signal (voltage) detected by the hall IC 163*b* will be described with reference to FIG. 17. When the rotation roller 161 rotates and the magnet 163*a* rotates according to the rotation of the rotation roller 161, the magnetic force (magnetic flux density) that passes through the hall IC 163*b* changes periodically according to the rotation angle and the electrical signal (voltage) which is the sensor output changes periodically. The rotation angle of the rotation roller 161 can be measured from the magnitude of the voltage output from the hall IC 163*b*.

Moreover, by counting the number of repetitions of one cycle of the electrical signal (voltage) output from the hall IC 163*b*, it is possible to measure the number of rotations of the rotation roller 161. Then, the displacement amount (boom cylinder length) of the cylinder rod 10Y of the boom cylinder 10 is calculated based on the rotation angle of the rotation roller 161 and the number of rotations of the rotation roller 161.

Moreover, the sensor controller 30 can calculate the moving speed (cylinder speed) of the cylinder rod 10Y based on the rotation angle of the rotation roller 161 and the number of rotations of the rotation roller 161.

In this manner, in the present embodiment, each cylinder stroke sensor (16, 17, and 18) functions as a cylinder speed sensor that detects the cylinder speed of the hydraulic cylinder. The boom cylinder stroke sensor 16 attached to the boom cylinder 10 functions as a boom cylinder speed sensor that detects the cylinder speed of the boom cylinder 10. The arm cylinder stroke sensor 17 attached to the arm cylinder 11 functions as an arm cylinder speed sensor that detects the cylinder speed of the arm cylinder 11. The bucket cylinder stroke sensor 18 attached to the bucket cylinder 12 functions as a bucket cylinder speed sensor that detects the cylinder speed of the bucket cylinder 12.

[Hydraulic Cylinder]

Next, the hydraulic cylinder according to the present embodiment will be described. The boom cylinder 10, the arm cylinder 11, and the bucket cylinder 12 are hydraulic cylinders. In the following description, the boom cylinder 10, the arm cylinder 11, and the bucket cylinder 12 will be appropriately collectively referred to as a hydraulic cylinder 60.

Figure 18:
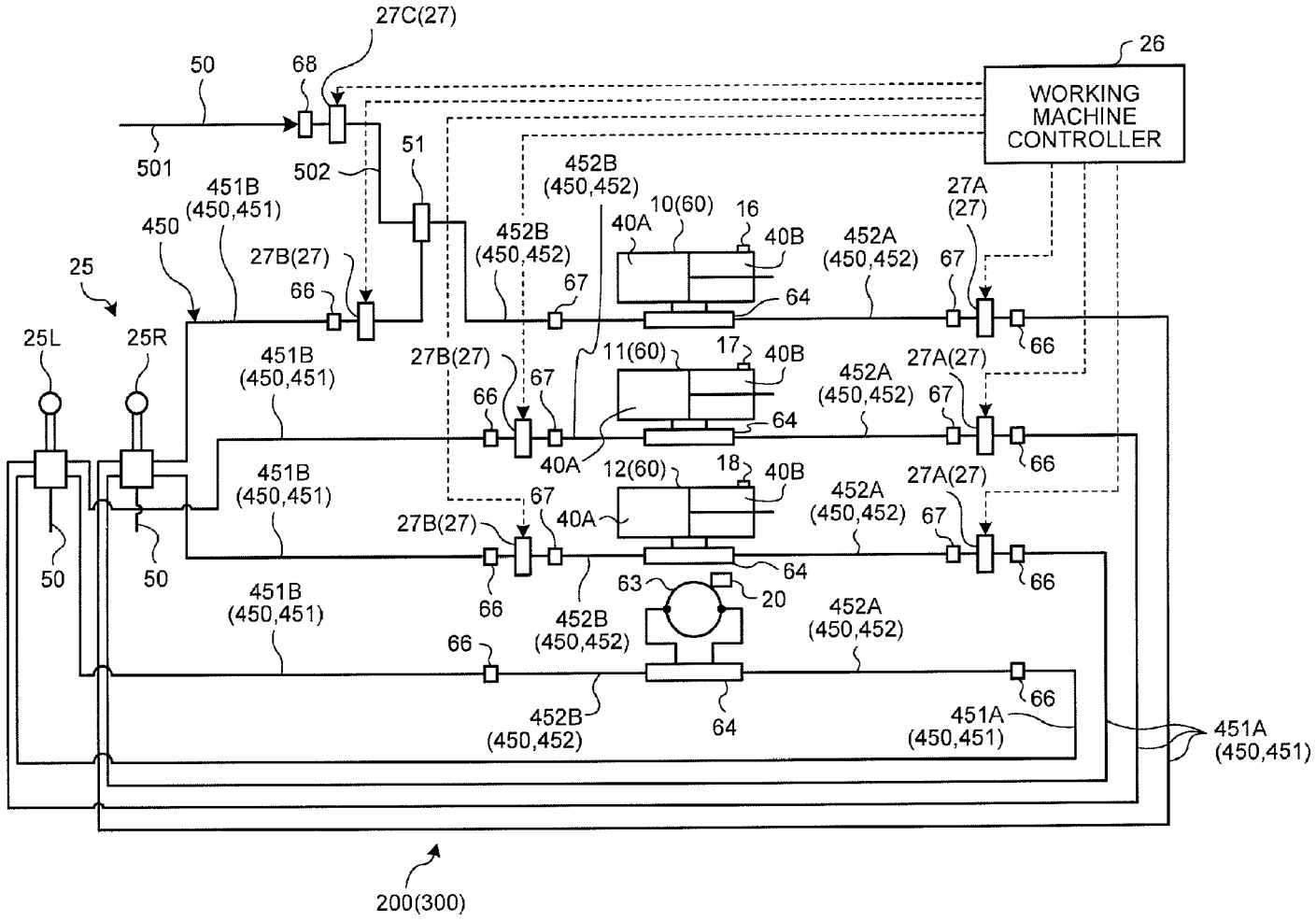
FIG. 18 is a diagram illustrating an example of the control system.
Figure 19:
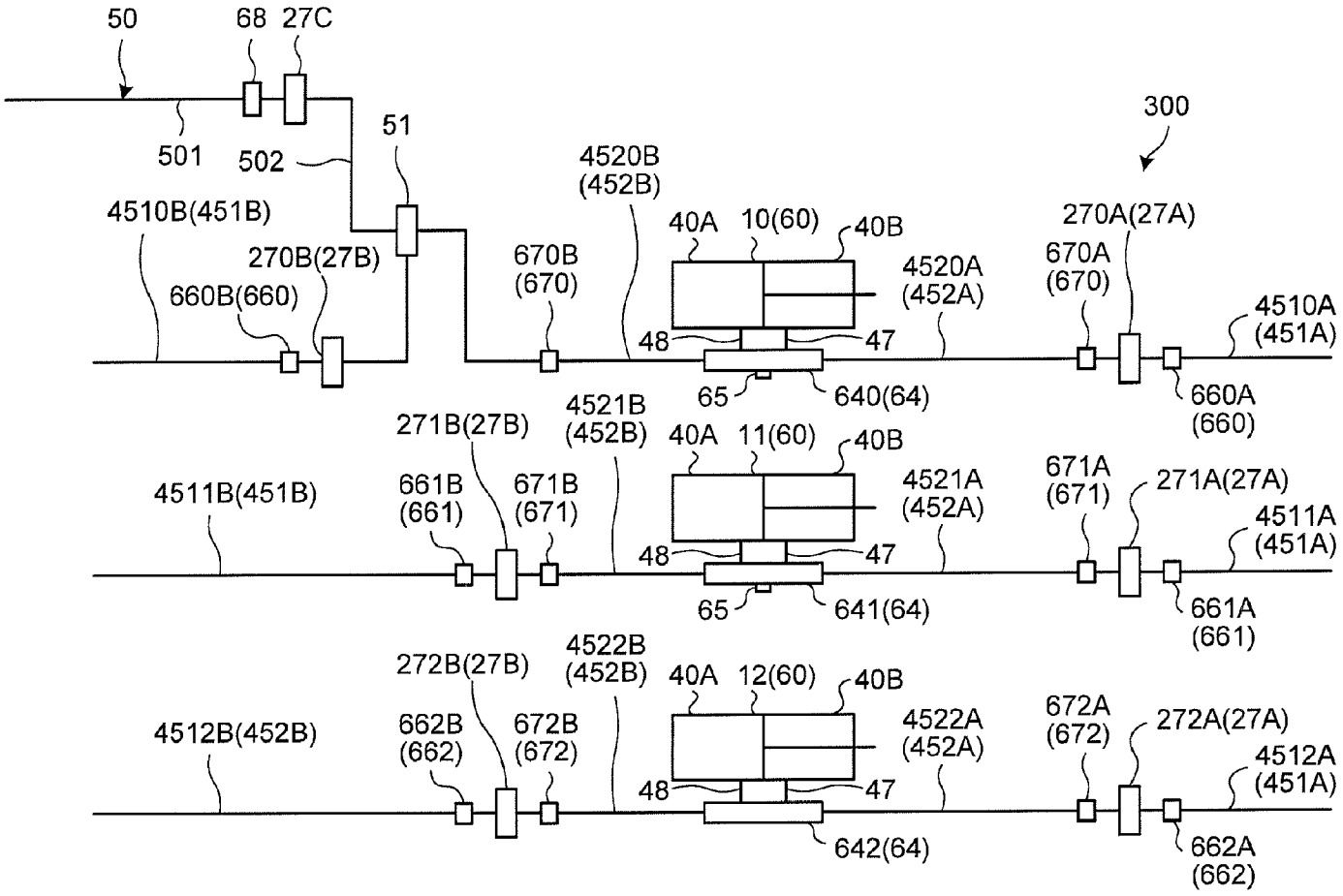
FIG. 19 is a diagram illustrating an example of the control system.

FIG. 18 is a schematic diagram illustrating an example of the control system 200 according to the present embodiment. FIG. 19 is an enlarged view of a portion of FIG. 18.

As illustrated in FIGS. 18 and 19, a hydraulic system 300 includes the hydraulic cylinder 60 including the boom cylinder 10, the arm cylinder 11, and the bucket cylinder 12 and a swinging motor 63 that swings the swinging structure 3. The hydraulic cylinder 60 operates with operating oil supplied from the main hydraulic pump. The swinging motor 63 is a hydraulic motor and operates with operating oil supplied from the main hydraulic pump.

The control valve 27 includes a control valve 27A and a control valve 27B arranged at the two sides of the hydraulic cylinder 60. In the following description, the control valve 27A will be appropriately referred to as a pressure-reducing valve 27A, and the control valve 27B will be appropriately referred to as a pressure-reducing valve 27B.

In the present embodiment, the direction control valve 64 that controls the direction in which operating oil flows is provided. The direction control valve 64 is disposed in each of the plurality of hydraulic cylinders 60 (the boom cylinder 10, the arm cylinder 11, and the bucket cylinder 12). The direction control valve 64 is a spool-type valve in which a rod-shaped spool is moved to change the flowing direction of operating oil. The direction control valve 64 includes a rod-shaped movable spool. The spool moves with pilot oil supplied. The direction control valve 64 supplies operating oil to the hydraulic cylinder 60 with the movement of the spool to operate the hydraulic cylinder 60. The operating oil supplied from the main hydraulic pump is supplied to the hydraulic cylinder 60 via the direction control valve 64. When the spool moves in an axial direction, the supply of operating oil to the cap-side oil chamber 40A (an oil passage 48) and the supply of operating oil to the rod-side oil chamber 40B (an oil passage 47) are switched. Moreover, when the spool moves in the axial direction, the amount (the amount of supply per unit time) of operating oil supplied to the hydraulic cylinder 60 is adjusted. When the amount of operating oil supplied to the hydraulic cylinder 60 is adjusted, the cylinder speed of the hydraulic cylinder 60 is adjusted.

Figure 20:
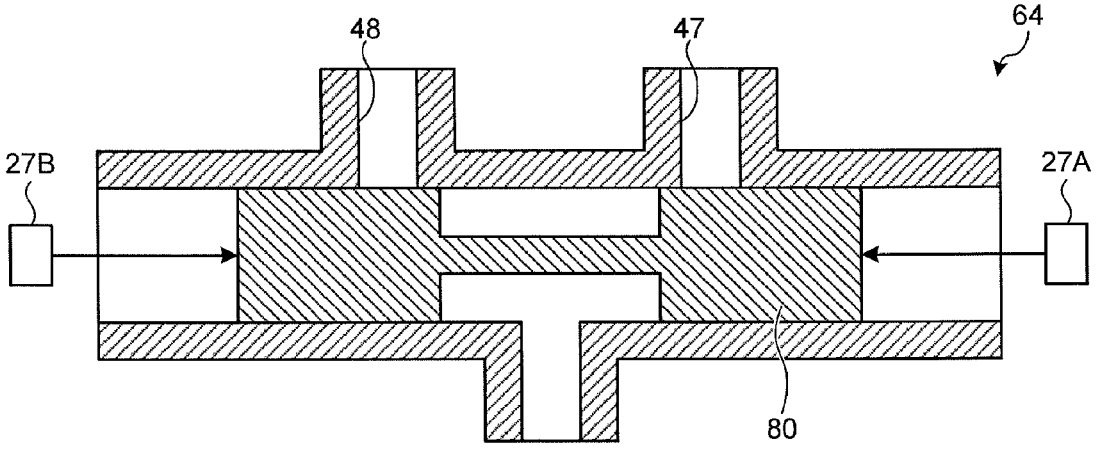
FIG. 20 is a diagram for describing an example of an operation of the construction machine.
Figure 21:
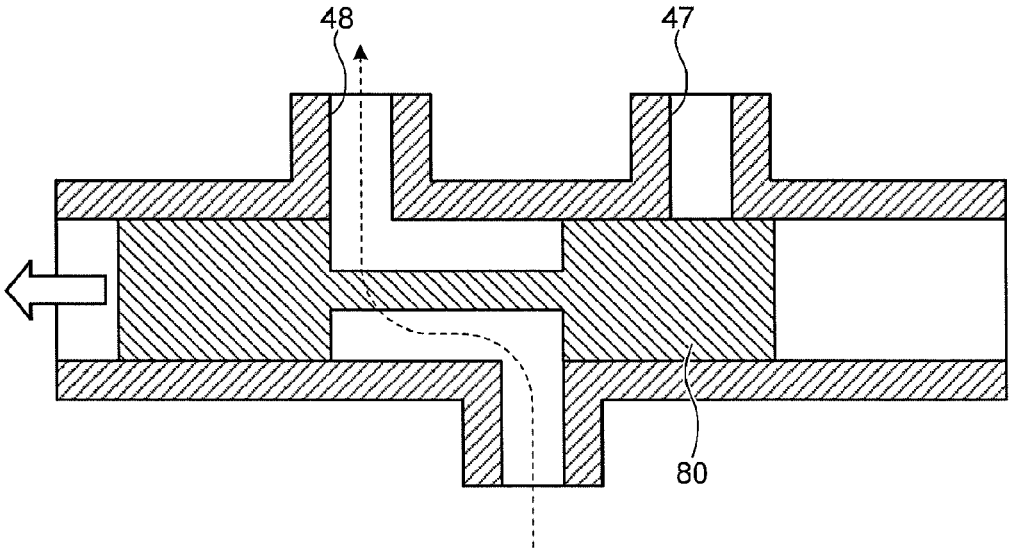
FIG. 21 is a diagram for describing an example of an operation of the construction machine.
Figure 22:
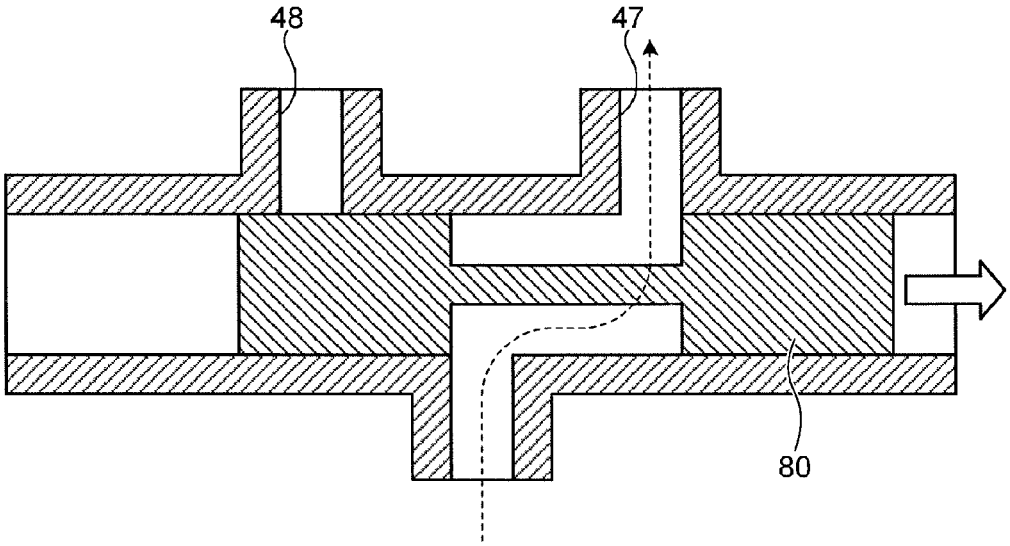
FIG. 22 is a diagram for describing an example of an operation of the construction machine.

FIG. 20 is a diagram schematically illustrating an example of the direction control valve 64. The direction control valve 64 controls the direction in which operating oil flows. The direction control valve 64 is a spool-type valve in which a rod-shaped spool 80 is moved to change the flowing direction of operating oil. As illustrated in FIGS. 21 and 22, when the spool 80 moves in the axial direction, the supply of operating oil to the cap-side oil chamber 40A (the oil passage 48) and the supply of operating oil to the rod-side oil chamber 40B (the oil passage 47) are switched. FIG. 21 illustrates a state where the spool 80 is moved so that operating oil is supplied to the cap-side oil chamber 40A through the oil passage 48. FIG. 22 illustrates a state where the spool 80 is moved so that operating oil is supplied to the rod-side oil chamber 40B through the oil passage 47.

Moreover, when the spool 80 moves in the axial direction, the amount (the amount of supply per unit time) of operating oil supplied to the hydraulic cylinder 60 is adjusted. As illustrated in FIG. 20, when the spool 80 is present at an initial position (origin), operating oil is not supplied to the hydraulic cylinder 60. When the spool 80 moves in relation to the axial direction from the origin, an amount of operating oil corresponding to the movement amount of the spool 80 is supplied to the hydraulic cylinder 60. When the amount of operating oil supplied to the hydraulic cylinder 60 is adjusted, the cylinder speed is adjusted.

That is, when pilot oil of which the pressure (pilot pressure) is adjusted by the operating device 25 or the pressure-reducing valve 27A is supplied to the direction control valve 64, the spool 80 moves to one side in relation to the axial direction. When pilot oil of which the pressure (pilot pressure) is adjusted by the operating device 25 or the pressure-reducing valve 27B is supplied to the direction control valve 64, the spool 80 moves to the other side in relation to the axial direction. In this way, the position of the spool in relation to the axial direction is adjusted.

The driving of the direction control valve 64 is adjusted by the operating device 25. In the present embodiment, the operating device 25 is a pilot hydraulic-type operating device. Pilot oil which has been delivered from the main hydraulic pump and decompressed by the pressure-reducing valve is supplied to the operating device 25. Note that pilot oil which has been delivered from a pilot hydraulic pump different from the main hydraulic pump may be supplied to the operating device 25. The operating device 25 includes a pressure adjustment valve 250 capable of adjusting the pilot pressure. The pilot pressure is adjusted based on the amount of operation of the operating device 25. The direction control valve 64 is driven with the pilot pressure. When the pilot pressure is adjusted by the operating device 25, the movement amount and the moving speed of the spool in relation to the axial direction are adjusted.

The direction control valve 64 is provided in each of the boom cylinder 10, the arm cylinder 11, the bucket cylinder 12, and the swinging motor 63. In the following description, the direction control valve 64 connected to the boom cylinder 10 will be appropriately referred to as a direction control valve 640. The direction control valve 64 connected to the arm cylinder 11 will be appropriately referred to as a direction control valve 641. The direction control valve 64 connected to the bucket cylinder 12 will be appropriately referred to as a direction control valve 642.

A spool stroke sensor 65 that detects a movement amount (movement distance) of the spool is provided in a boom direction control valve 640 and an arm direction control valve 641. A detection signal of the spool stroke sensor 65 is output to the work machine controller 26.

The operating device 25 and the direction control valve 64 are connected by the pilot oil passage 450. The pilot oil for moving the spool of the direction control valve 64 flows through the pilot oil passage 450. In the present embodiment, the control valve 27, the pressure sensor 66, and the pressure sensor 67 are disposed in the pilot oil passages 450.

In the following description, among pilot oil passages 450, the pilot oil passage 450 between the operating device 25 and the control valve 27 will be appropriately referred to as a pilot oil passage 451, and the pilot oil passage 450 between the control valve 27 and the direction control valve 64 will be appropriately referred to as a pilot oil passage 452.

The pilot oil passage 452 is connected to the direction control valve 64. The pilot oil is supplied to the direction control valve 64 through the pilot oil passage 452. The direction control valve 64 includes a first pressure receiving chamber and a second pressure receiving chamber. The pilot oil passage 452 includes a pilot oil passage 452A connected to the first pressure receiving chamber and a pilot oil passage 452B connected to the second pressure receiving chamber.

When pilot oil is supplied to the first pressure receiving chamber of the direction control valve 64 through the pilot oil passage 452A, the spool moves according to the pilot pressure of the pilot oil, and the operating oil is supplied to the rod-side oil chamber 40B via the direction control valve 64. The amount of operating oil supplied to the rod-side oil chamber 40B is adjusted by the amount of operation (movement amount of the spool) of the operating device 25.

When pilot oil is supplied to the second pressure receiving chamber of the direction control valve 64 through the pilot oil passage 452B, the spool moves according to the pilot pressure of the pilot oil, and the operating oil is supplied to the cap-side oil chamber 40A via the direction control valve 64. The amount of the operating oil supplied to the cap-side oil chamber 40A is adjusted by the amount of operation (movement amount of the spool) of the operating device 25.

That is, when pilot oil of which the pilot pressure is adjusted by the operating device 25 is supplied to the direction control valve 64, the spool moves to one side in relation to the axial direction. When pilot oil of which the pilot pressure is adjusted by the operating device 25 is supplied to the direction control valve 64, the spool moves to the other side in relation to the axial direction. In this way, the position of the spool in relation to the axial direction is adjusted.

The pilot oil passage 451 includes a pilot oil passage 451A that connects the pilot oil passage 452A and the operating device 25, and the pilot oil passage 451B that connects the pilot oil passage 452B and the operating device 25.

In the following description, the pilot oil passage 452A connected to the direction control valve 640 via which operating oil is supplied to the boom cylinder 10 will be appropriately referred to as a boom adjustment oil passage 4520A, and the pilot oil passage 452B connected to the direction control valve 640 will be appropriately referred to as a boom adjustment oil passage 4520B.

In the following description, the pilot oil passage 452A connected to the direction control valve 641 via which operating oil is supplied to the arm cylinder 11 will be appropriately referred to as an arm adjustment oil passage 4521A, and the pilot oil passage 452B connected to the direction control valve 641 will be appropriately referred to as an arm adjustment oil passage 4521B.

In the following description, the pilot oil passage 452A connected to the direction control valve 642 via which operating oil is supplied to the bucket cylinder 12 will be appropriately referred to as a bucket adjustment oil passage 4522A, and the pilot oil passage 452B connected to the direction control valve 642 will be appropriately referred to as a bucket adjustment oil passage 45223.

In the following description, the pilot oil passage 451A connected to the boom adjustment oil passage 4520A will be appropriately referred to as a boom operating oil passage 4510A, and the pilot oil passage 451B connected to the boom adjustment oil passage 4520B will be appropriately referred to as a boom operating oil passage 4510B.

In the following description, the pilot oil passage 451A connected to the arm adjustment oil passage 4521A will be appropriately referred to as an arm operating oil passage 4511A, and the pilot oil passage 451B connected to the arm adjustment oil passage 4521B will be appropriately referred to as an arm operating oil passage 4511B.

In the following description, the pilot oil passage 451A connected to the bucket adjustment oil passage 4522A will be appropriately referred to as a bucket operating oil passage 4512A, and the pilot oil passage 451B connected to the bucket adjustment oil passage 4522B will be appropriately referred to as a bucket operating oil passage 4512B.

The boom operating oil passage (4510A and 4510B) and the boom adjustment oil passage (4520A and 4520B) are connected to the pilot hydraulic-type operating device 25. The pilot oil of which the pressure is adjusted according to the amount of operation of the operating device 25 flows through the boom operating oil passage (4510A and 4510B).

The arm operating oil passage (4511A and 4511B) and the arm adjustment oil passage (4521A and 4521B) are connected to the pilot hydraulic-type operating device 25. The pilot oil of which the pressure is adjusted according to the amount of operation of the operating device 25 flows through the arm operating oil passage (4511A and 4511B).

The bucket operating oil passage (4512A and 4512B) and the bucket adjustment oil passage (4522A and 4522B) are connected to the pilot hydraulic-type operating device 25. The pilot oil of which the pressure is adjusted according to the amount of operation of the operating device 25 flows through the bucket operating oil passage (4512A and 4512B).

The boom operating oil passage 4510A, the boom operating oil passage 4510B, the boom adjustment oil passage 4520A, and the boom adjustment oil passage 4520B are boom oil passages through which the pilot oil for operating the boom 6 flows.

The arm operating oil passage 4511A, the arm operating oil passage 4511B, the arm adjustment oil passage 4521A, and the arm adjustment oil passage 4521B are arm oil passages through which the pilot oil for operating the arm 7 flows.

The bucket operating oil passage 4512A, the bucket operating oil passage 4512B, the bucket adjustment oil passage 4522A, and the bucket adjustment oil passage 4522B are bucket oil passages through which the pilot oil for operating the bucket 8 flows.

As described above, according to the operation of the operating device 25, the boom 6 executes two types of operations of the lowering operation and the raising operation. When the operating device 25 is operated so that the raising operation of the boom 6 is executed, pilot oil is supplied to the direction control valve 640 connected to the boom cylinder 10, through the boom operating oil passage 4510A and the boom adjustment oil passage 4520A. The direction control valve 640 operates based on pilot pressure. In this way, operating oil from the main hydraulic pump is supplied to the boom cylinder 10, and the lowering operation of the boom 6 is executed.

When the operating device 25 is operated so that the raising operation of the boom 6 is executed, pilot oil is supplied to the direction control valve 640 connected to the boom cylinder 10, through the boom operating oil passage 4510B and the boom adjustment oil passage 4520B. The direction control valve 640 operates based on pilot pressure. In this way, operating oil from the main hydraulic pump is supplied to the boom cylinder 10, and the raising operation of the boom 6 is executed.

That is, in the present embodiment, the boom operating oil passage 4510A and the boom adjustment oil passage 4520A are boom lowering oil passages which are connected to the first pressure receiving chamber of the direction control valve 640 and through which the pilot oil for lowering the boom 6 flows. The boom operating oil passage 4510B and the boom adjustment oil passage 4520B are boom raising oil passages which are connected to the second pressure receiving chamber of the direction control valve 640 and through which the pilot oil for raising the boom 6 flows.

Moreover, according to the operation of the operating device 25, the arm 7 executes two types of operations of the lowering operation and the raising operation. When the operating device 25 is operated so that the raising operation of the arm 7 is executed, pilot oil is supplied to the direction control valve 641 connected to the arm cylinder 11, through the arm operating oil passage 4511A and the arm adjustment oil passage 4521A. The direction control valve 641 operates based on pilot pressure. In this way, operating oil from the main hydraulic pump is supplied to the arm cylinder 11, and the raising operation of the arm 7 is executed.

When the operating device 25 is operated so that the lowering operation of the arm 7 is executed, pilot oil is supplied to the direction control valve 641 connected to the arm cylinder 11, through the arm operating oil passage 4511B and the arm adjustment oil passage 4521B. The direction control valve 641 operates based on pilot pressure. In this way, operating oil from the main hydraulic pump is supplied to the arm cylinder 11, and the lowering operation of the arm 7 is executed.

That is, in the present embodiment, the arm operating oil passage 4511A and the arm adjustment oil passage 4521A are arm raising oil passages which are connected to the first pressure receiving chamber of the direction control valve 641 and through which the pilot oil for raising the arm 7 flows. The arm operating oil passage 4511B and the arm adjustment oil passage 4521B are arm raising oil passages which are connected to the second pressure receiving chamber of the direction control valve 641 and through which the pilot oil for raising the arm 7 flows.

Moreover, according to the operation of the operating device 25, the bucket 8 executes two types of operations of the lowering operation and the raising operation. When the operating device 25 is operated so that the raising operation of the bucket 8 is executed, pilot oil is supplied to the direction control valve 642 connected to the bucket cylinder 12, through the bucket operating oil passage 4512A and the bucket adjustment oil passage 4522A. The direction control valve 642 operates based on pilot pressure. In this way, operating oil from the main hydraulic pump is supplied to the bucket cylinder 12, and the raising operation of the bucket 8 is executed.

When the operating device 25 is operated so that the lowering operation of the bucket 8 is executed, pilot oil is supplied to the direction control valve 642 connected to the bucket cylinder 12, through the bucket operating oil passage 4512B and the bucket adjustment oil passage 4522B. The direction control valve 642 operates based on pilot pressure. In this way, operating oil from the main hydraulic pump is supplied to the bucket cylinder 12, and the lowering operation of the bucket 8 is executed.

That is, in the present embodiment, the bucket operating oil passage 4512A and the bucket adjustment oil passage 4522A are bucket lowering oil passages which are connected to the first pressure receiving chamber of the direction control valve 642 and through which the pilot oil for lowering the bucket 8 flows. The bucket operating oil passage 4512B and the bucket adjustment oil passage 4522B are bucket raising oil passages which are connected to the second pressure receiving chamber of the direction control valve 642 and through which the pilot oil for raising the bucket 8 flows.

Moreover, according to the operation of the operating device 25, the swinging structure 3 executes two types of operations of the right swinging operation and the left swinging operation. When the operating device 25 is operated so that the right swinging operation of the swinging structure 3 is executed, operating oil is supplied to the swinging motor 63. When the operating device 25 is operated so that the left swinging operation of the swinging structure 3 is executed, the operating oil is supplied to the swinging motor 63.

[Overview of Calibration]

In the present embodiment, the boom 6 is raised when the boom cylinder 10 is extended, and the boom 6 is lowered when the boom cylinder 10 is retracted. Thus, when operating oil is supplied to the cap-side oil chamber 40A of the boom cylinder 10, the boom cylinder 10 is extended and the boom 6 is raised. When operating oil is supplied to the rod-side oil chamber 40B of the boom cylinder 10, the boom cylinder 10 is retracted and the boom 6 is lowered.

In the present embodiment, the arm 7 is lowered (performs an excavating operation) when the arm cylinder 11 is extended, and the arm 7 is raised (performs a dumping operation) when the arm cylinder 11 is retracted. Thus, when operating oil is supplied to the cap-side oil chamber 40A of the boom cylinder 11, the arm cylinder 11 is extended and the arm 7 is lowered. When operating oil is supplied to the rod-side oil chamber 40B of the arm cylinder 11, the arm cylinder 11 is retracted and the arm 7 is raised.

In the present embodiment, the bucket 8 is lowered (performs an excavating operation) when the bucket cylinder 12 is extended, and the bucket 8 is raised (performs a dumping operation) when the bucket cylinder 12 is retracted. Thus, when operating oil is supplied to the cap-side oil chamber 40A of the bucket cylinder 12, the bucket cylinder 12 is extended and the bucket 8 is lowered. When operating oil is supplied to the rod-side oil chamber 40B of the bucket cylinder 12, the bucket cylinder 12 is retracted and the bucket 8 is raised.

The control valve 27 adjusts pilot pressure based on the control signal (current) from the work machine controller 26. The control valve 27 is an electromagnetic proportional control valve and is controlled based on the control signal from the work machine controller 26. The control valve 27 includes a control valve 27B capable of adjusting the pilot pressure of pilot oil supplied to the first pressure receiving chamber of the direction control valve 64 to adjust the amount of operating oil supplied to the cap-side oil chamber 40A via the direction control valve 64 and a control valve 27A capable of adjusting the pilot pressure of pilot oil supplied to the second pressure receiving chamber of the direction control valve 64 to adjust the amount of operating oil supplied to the rod-side oil chamber 40B via the direction control valve 64.

The pressure sensors 66 and 67 that detect the pilot pressure are provided on both sides of the control valve 27. In the present embodiment, the pressure sensor 66 is disposed in the pilot oil passage 451 between the operating device 25 and the control valve 27. The pressure sensor 67 is disposed in the pilot oil passage 452 between the control valve 27 and the direction control valve 64. The pressure sensor 66 is capable of detecting the pilot pressure before being adjusted by the control valve 27. The pressure sensor 67 is capable of detecting the pilot pressure adjusted by the control valve 27. The pressure sensor 66 is capable of detecting the pilot pressure to be adjusted by the operation of the operating device 25. Although not illustrated in the figure, the detection results of the pressure sensors 66 and 67 are output to the work machine controller 26.

In the following description, the control valve 27 capable of adjusting the pilot pressure of pilot oil to the direction control valve 640 via which operating oil is supplied to the boom cylinder 10 will be appropriately referred to as a boom pressure-reducing valve 270. Moreover, among boom pressure-reducing valves 270, one boom pressure-reducing valve (corresponding to the pressure-reducing valve 27A) will be appropriately referred to as a boom pressure-reducing valve 270A, and the other boom pressure-reducing valve (corresponding to the pressure-reducing valve 27B) will be appropriately referred to as a boom pressure-reducing valve 270B. The boom pressure-reducing valve 270 (270A and 270B) is disposed in the boom operating oil passage.

In the following description, the control valve 27 capable of adjusting the pilot pressure of pilot oil to the direction control valve 641 via which operating oil is supplied to the arm cylinder 11 will be appropriately referred to as an arm pressure-reducing valve 271. Moreover, among arm pressure-reducing valves 271, one arm pressure-reducing valve (corresponding to the pressure-reducing valve 27A) will be appropriately referred to as an arm pressure-reducing valve 271A, and the other arm pressure-reducing valve (corresponding to the pressure-reducing valve 27B) will be appropriately referred to as an arm pressure-reducing valve 271B. The arm pressure-reducing valve 271 (271A and 271B) is disposed in the arm operating oil passage.

In the following description, the control valve 27 capable of adjusting the pilot pressure of pilot oil to the direction control valve 642 via which operating oil is supplied to the bucket cylinder 12 will be appropriately referred to as a bucket pressure-reducing valve 272. Moreover, among bucket pressure-reducing valves 272, one bucket pressure-reducing valve (corresponding to the pressure-reducing valve 27A) will be appropriately referred to as a bucket pressure-reducing valve 272A, and the other bucket pressure-reducing valve (corresponding to the pressure-reducing valve 27B) will be appropriately referred to as a bucket pressure-reducing valve 272B. The bucket pressure-reducing valve 272 (272A and 272B) is disposed in the bucket operating oil passage.

[Pressure Sensor]

In the following description, the pressure sensor 66 that detects the pilot pressure of the pilot oil passage 451 connected to the direction control valve 640 via which operating oil is supplied to the boom cylinder 10 will be appropriately referred to as a boom pressure sensor 660, and the pressure sensor 67 that detects the pilot pressure of the pilot oil passage 452 connected to the direction control valve 640 will be appropriately referred to as a boom pressure sensor 670.

Moreover, in the following description, the boom pressure sensor 660 disposed in the boom operating oil passage 4510A will be appropriately referred to as a boom pressure sensor 660A, and the boom pressure sensor 660 disposed in the boom operating oil passage 4510B will be appropriately referred to as a boom pressure sensor 660B. Moreover, the boom pressure sensor 670 disposed in the boom adjustment oil passage 4520A will be appropriately referred to as a boom pressure sensor 670A, and the boom pressure sensor 670 disposed in the boom adjustment oil passage 4520B will be appropriately referred to as a boom pressure sensor 670B.

In the following description, the pressure sensor 66 that detects the pilot pressure of the pilot oil passage 451 connected to the direction control valve 641 via which operating oil is supplied to the arm cylinder 11 will be appropriately referred to as an arm pressure sensor 661, and the pressure sensor 67 that detects the pilot pressure of the pilot oil passage 452 connected to the direction control valve 641 will be appropriately referred to as an arm pressure sensor 671.

Moreover, in the following description, the arm pressure sensor 661 disposed in the arm operating oil passage 4511A will be appropriately referred to as an arm pressure sensor 661A, and the arm pressure sensor 661 disposed in the arm operating oil passage 4511B will be appropriately referred to as an arm pressure sensor 661B. Moreover, the arm pressure sensor 671 disposed in the arm adjustment oil passage 4521A will be appropriately referred to as an arm pressure sensor 671A, and the arm pressure sensor 671 disposed in the arm adjustment oil passage 4521B will be appropriately referred to as an arm pressure sensor 671B.

In the following description, the pressure sensor 66 that detects the pilot pressure of the pilot oil passage 451 connected to the direction control valve 642 via which operating oil is supplied to the bucket cylinder 12 will be appropriately referred to as a bucket pressure sensor 662, and the pressure sensor 67 that detects the pilot pressure of the pilot oil passage 452 connected to the direction control valve 642 will be appropriately referred to as a bucket pressure sensor 672.

Moreover, in the following description, the bucket pressure sensor 662 disposed in the bucket operating oil passage 4512A will be appropriately referred to as a bucket pressure sensor 662A, and the bucket pressure sensor 662 disposed in the bucket operating oil passage 4512B will be appropriately referred to as a bucket pressure sensor 662B. Moreover, the bucket pressure sensor 672 disposed in the bucket adjustment oil passage 4522A will be appropriately referred to as a bucket pressure sensor 672A, and the bucket pressure sensor 672 disposed in the bucket adjustment oil passage 4522B will be appropriately referred to as a bucket pressure sensor 672B.

[Control Valve]

When the limited excavation control is not executed, the work machine controller 26 controls the control valve 27 to open (fully open) the pilot oil passage 450. When the pilot oil passage 450 opens, the pilot pressure of the pilot oil passage 451 becomes equal to the pilot pressure of the pilot oil passage 452. In the state where the pilot oil passage 450 is opened by the control valve 27, the pilot pressure is adjusted based on the amount of operation of the operating device 25.

When the pilot oil passage 450 is fully opened by the control valve 27, the pilot pressure acting on the pressure sensor 66 is equal to the pilot pressure acting on the pressure sensor 67. When the degree of opening of the control valve 27 decreases, the pilot pressure acting on the pressure sensor 66 is different from the pilot pressure acting on the pressure sensor 67.

When the limited excavation control is performed and the work machine controller 26 is controlled by the work machine 2, the work machine controller 26 outputs the control signal to the control valve 27. The pilot oil passage 451 has a predetermined pressure (pilot pressure) by the action of a pilot relief valve, for example. When the control signal is output from the work machine controller 26 to the control valve 27, the control valve 27 operates based on the control signal. The pilot oil of the pilot oil passage 451 is supplied to the pilot oil passage 452 via the control valve 27. The pilot pressure of the pilot oil passage 452 is adjusted (reduced) by the control valve 27. The pilot pressure of the pilot oil passage 452 acts on the direction control valve 64. In this way, the direction control valve 64 operates based on the pilot pressure controlled by the control valve 27. In the present embodiment, the pressure sensor 66 detects the pilot pressure before being adjusted by the control valve 27. The pressure sensor 67 detects the pilot pressure after being adjusted by the control valve 27.

When the pilot oil of which the pressure is adjusted by the pressure-reducing valve 27A is supplied to the direction control valve 64, the spool moves to one side in relation to the axial direction. When the pilot oil of which the pressure is adjusted by the pressure-reducing valve 27B is supplied to the direction control valve 64, the spool moves to the other side in relation to the axial direction. In this way, the position of the spool in relation to the axial direction is adjusted.

For example, the work machine controller 26 can adjust the pilot pressure to the direction control valve 640 connected to the boom cylinder 10 by outputting the control signal to at least one of the boom pressure-reducing valves 270A and 270B.

Moreover, the work machine controller 26 can adjust the pilot pressure to the direction control valve 641 connected to the arm cylinder 11 by outputting the control signal to at least one of the arm pressure-reducing valves 271A and 271B.

Moreover, the work machine controller 26 can adjust the pilot pressure to the direction control valve 642 connected to the bucket cylinder 12 by outputting the control signal to at least one of the bucket pressure-reducing valves 272A and 272B.

The work machine controller 26 limits the speed of the boom 6 based on the target excavation landform U indicating the designed landform which is a target shape of an excavation object and the bucket position data (cutting edge position data S) indicating the position of the bucket 8 so that a speed at which the bucket 8 approaches the target excavation landform U decreases according to the distance d between the target excavation landform U and the bucket 8. The work machine controller 26 includes a boom intervention unit that outputs a control signal for limiting the speed of the boom 6. In the present embodiment, when the work machine 2 is driven based on the operation of the operating device 25, the movement of the boom 6 is controlled (intervention control) based on the control signal output from the boom intervention unit of the work machine controller 26 so that the cutting edge 8*a* of the bucket 8 does not dig into the target excavation landform U. When the bucket 8 performs excavation, the raising operation of the boom 6 is executed by the work machine controller 26 so that the cutting edge 8*a* does not dig into the target excavation landform U.

[Intervention Valve During Intervention Control]

In the present embodiment, a pilot oil passage 502 is connected to the control valve 27C that operates based on an intervention control signal output from the work machine controller 26 in order to perform intervention control. In the intervention control, the pilot oil of which the pressure (pilot pressure) is adjusted flows through the pilot oil passage 502. The control valve 27C is connected to the pilot oil passage 501 and capable of adjusting the pilot pressure of the pilot oil from a pilot oil passage 501.

In the following description, the pilot oil passage 50 through which the pilot oil of which the pressure is adjusted during the intervention control flows will be appropriately referred to as intervention oil passages 501 and 502, and the control valve 27C connected to the intervention oil passage 501 will be appropriately referred to as an intervention valve 27C.

The pilot oil supplied to the direction control valve 640 that is connected to the boom cylinder 10 flows through the intervention oil passage 501. The intervention oil passage 502 is connected to the boom operating oil passage 4510B and the boom adjustment oil passage 4520B that are connected to the direction control valve 640 via the shuttle valve 51.

The shuttle valve 51 has two inlet ports and one outlet port. The one inlet port is connected to the intervention oil passage 502. The other inlet port is connected to the boom operating oil passage 4510B. The outlet port is connected to the boom adjustment oil passage 4520B. The shuttle valve 51 connects an oil passage having a higher pilot pressure among the intervention oil passage 502 and the boom operating oil passage 4510B to the boom adjustment oil passage 4520B. For example, when the pilot pressure of the intervention oil passage 502 is higher than the pilot pressure of the boom operating oil passage 4510B, the shuttle valve 51 operates so that the intervention oil passage 501 and the boom adjustment oil passage 4520B are connected and the boom operating oil passage 4510B and the boom adjustment oil passage 4520B are not connected. In this way, the pilot oil of the intervention oil passage 502 is supplied to the boom adjustment oil passage 4520B via the shuttle valve 51. When the pilot pressure of the boom operating oil passage 4510B is higher than the pilot pressure of the intervention oil passage 502, the shuttle valve 51 operates so that the boom operating oil passage 4510B and the boom adjustment oil passage 4520B are connected and the intervention oil passage 502 and the boom adjustment oil passage 4520B are not connected. In this way, the pilot oil of the boom operating oil passage 4510B is supplied to the boom adjustment oil passage 4520B via the shuttle valve 51.

A pressure sensor 68 that detects the pilot pressure of the pilot oil of the intervention oil passage 501 is provided in the intervention oil passage 501. The intervention oil passage 501 includes an intervention oil passage 501 through which the pilot oil before passing through the control valve 27C flows and an intervention oil passage 502 through which the pilot oil after having passed through the intervention valve 27C flows. The intervention valve 27C is controlled based on the control signal output from the work machine controller 26 in order to execute the intervention control.

When the intervention control is not executed, the work machine controller 26 does not output the control signal to the control valve 27 so that the direction control valve 64 is driven based on the pilot pressure adjusted by the operation of the operating device 25. For example, the work machine controller 26 opens (fully opens) the boom operating oil passage 4510B by the boom pressure-reducing valve 270B and also closes the intervention oil passage 501 by the intervention valve 27C so that the direction control valve 640 is driven based on the pilot pressure adjusted by the operation of the operating device 25.

When the intervention control is executed, the work machine controller 26 controls each control valve 27 so that the direction control valve 64 is driven based on the pilot pressure adjusted by the intervention valve 27C. For example, when the intervention control of limiting the movement of the boom 6 is executed, the work machine controller 26 controls the intervention valve 27C so that the pilot pressure of the intervention oil passage 501 adjusted by the intervention valve 27C is higher than the pilot pressure of the boom operating oil passage 4510B adjusted by the operating device 25. In this way, the pilot oil from the intervention valve 27C is supplied to the direction control valve 640 through the intervention oil passage 502 via the shuttle valve 51.

When the boom 6 is raised at a high speed by the operating device 25 so that the bucket 8 does not dig into the target excavation landform U, the intervention control is not executed. When the operating device 25 is operated so that the boom 6 is raised at a high speed and the pilot pressure is adjusted based on the amount of operation of the operating device 25, the pilot pressure of the boom operating oil passage 4510B to be adjusted by the operation of the operating device 25 becomes higher than the pilot pressure of the intervention oil passage 502 to be adjusted by the intervention valve 27C. In this way, the pilot oil of the boom operating oil passage 4510B, of which the pilot pressure has been adjusted by the operation of the operating device 25 is supplied to the direction control valve 640 via the shuttle valve 51.

In the following description, for the sake of convenience, opening the pilot oil passage 450 with the operation of the control valve 27 will be simply referred to as opening the control valve 27 (putting the control valve 27 into an open state), and closing the pilot oil passage 450 with the operation of the control valve 27 will be simply referred to as closing the control valve 27 (putting the control valve 27 into a closed state). Note that the open state of the control valve 27 includes a slightly open state as well as a fully open state. That is, the open state of the control valve 27 includes states other than the closed state of the control valve 27. When the control valve 27 opens, the pilot oil passage 450 enters into a decompressed state.

For example, opening the intervention oil passage 501 with the operation of the intervention valve 27C will be simply referred to as opening the intervention valve 27C, and closing the intervention oil passage 501 with the operation of the intervention valve 27C will be simply referred to as closing the intervention valve 27C.

Similarly, opening the boom operating oil passage 4510A with the operation of the boom pressure-reducing valve 270A (putting the boom operating oil passage 4510A and the boom adjustment oil passage 4520A into a connected state) will be simply referred to as opening the boom pressure-reducing valve 270A, and closing the boom operating oil passage 4510A with the operation of the boom pressure-reducing valve 270A (putting the boom operating oil passage 4510A and the boom adjustment oil passage 4520A into a disconnected state) will be simply referred to as closing the boom pressure-reducing valve 270A. Moreover, opening the boom operating oil passage 4510B with the operation of the boom pressure-reducing valve 270B (putting the boom operating oil passage 4510B and the boom adjustment oil passage 4520B into a connected state) will be simply referred to as opening the boom pressure-reducing valve 270B, and closing the boom operating oil passage 4510B with the operation of the boom pressure-reducing valve 270B (putting the boom operating oil passage 4510B and the boom adjustment oil passage 4520B into a disconnected state) will be simply referred to as closing the boom pressure-reducing valve 270B.

Similarly, opening the arm operating oil passage 4511A with the operation of the arm pressure-reducing valve 271A (putting the arm operating oil passage 4511A and the arm adjustment oil passage 4521A into a connected state) will be simply referred to as opening the arm pressure-reducing valve 271A, and closing the arm operating oil passage 4511A with the operation of the arm pressure-reducing valve 271A (putting the arm operating oil passage 4511A and the arm adjustment oil passage 4521A into a disconnected state) will be simply referred to as closing the arm pressure-reducing valve 271A. Moreover, opening the arm operating oil passage 4511B with the operation of the arm pressure-reducing valve 271B (putting the arm operating oil passage 4511B and the arm adjustment oil passage 4521B into a connected state) will be simply referred to as opening the arm pressure-reducing valve 271B, and closing the arm operating oil passage 4511B with the operation of the arm pressure-reducing valve 271B (putting the arm operating oil passage 4511B and the arm adjustment oil passage 4521B into a disconnected state) will be simply referred to as closing the arm pressure-reducing valve 271B.

Similarly, opening the bucket operating oil passage 4512A with the operation of the bucket pressure-reducing valve 272A (putting the bucket operating oil passage 4512A and the bucket adjustment oil passage 4522A into a connected state) will be simply referred to as opening the bucket pressure-reducing valve 272A, and closing the bucket operating oil passage 4512A with the operation of the bucket pressure-reducing valve 272A (putting the bucket operating oil passage 4512A and the bucket adjustment oil passage 4522A into a disconnected state) will be simply referred to as closing the bucket pressure-reducing valve 272A. Moreover, opening the bucket operating oil passage 4512B with the operation of the bucket pressure-reducing valve 272B (putting the bucket operating oil passage 4512B and the bucket adjustment oil passage 4522B into a connected state) will be simply referred to as opening the bucket pressure-reducing valve 272B, and closing the bucket operating oil passage 4512B with the operation of the bucket pressure-reducing valve 272B (putting the bucket operating oil passage 4512B and the bucket adjustment oil passage 4522B into a disconnected state) will be simply referred to as closing the bucket pressure-reducing valve 272B.

The pressure-reducing valve 27A and the pressure-reducing valve 28B are used during stop control of stopping the work machine 2, for example. For example, the boom pressure-reducing valve 270A is closed when the lowering operation of the boom 6 stops. In this way, the boom 6 does not perform the lowering operation even when the operating device 25 is operated. Similarly, the arm pressure-reducing valve 271B is closed when the lowering operation of the arm 7 stops. The bucket pressure-reducing valve 272B is closed when the lowering operation of the bucket 8 stops. The boom pressure-reducing valve 270B is closed when the raising operation of the boom 6 stops. The arm pressure-reducing valve 271A is closed when the raising operation of the arm 7 stops. The bucket pressure-reducing valve 272A is closed when the raising operation of the bucket 8 stops.

In the present embodiment, the boom cylinder 10 allows the boom 6 to execute the lowering operation by operating in a first operating direction (for example, a retracting direction) and allows the boom 6 to execute the raising operation by operating in a second operating direction (for example, an extending direction) opposite to the first operating direction.

In the present embodiment, the arm cylinder 11 allows the arm 7 to execute the raising operation by operating in a first operating direction (for example, a retracting direction) and allows the arm 7 to execute the lowering operation by operating in a second operating direction (for example, an extending direction) opposite to the first operating direction.

In the present embodiment, the bucket cylinder 12 allows the bucket to execute the dumping operation by operating in a first operating direction (for example, a retracting direction) and allows the bucket to execute the excavating operation by operating in a second operating direction (for example, an extending direction) opposite to the first operating direction.

The boom operating oil passages 4510A and 4510B and the boom adjustment oil passages 4520A and 4520B are disposed so as to be connected to the direction control valve 640. The pilot oil for moving the spool 80 of the direction control valve 640 to allow the boom cylinder 10 to operate in the first operating direction flows through the boom operating oil passage 4510A and the boom adjustment oil passage 4520A. The pilot oil for moving the spool 80 of the direction control valve 640 to allow the boom cylinder 10 to operate in the second operating direction flows through the boom operating oil passage 4510B and the boom adjustment oil passage 4520B.

The arm operating oil passages 4511A and 4511B and the arm adjustment oil passages 4521A and 4521B are disposed so as to be connected to the direction control valve 641. The pilot oil for moving the spool 80 of the direction control valve 641 to allow the arm cylinder 11 to operate in the first operating direction flows through the arm operating oil passage 4511A and the arm adjustment oil passage 4521A. The pilot oil for moving the spool 80 of the direction control valve 641 to allow the arm cylinder 11 to operate in the second operating direction flows through the arm operating oil passage 4511B and the arm adjustment oil passage 4521B.

The bucket operating oil passages 4512A and 4512B and the bucket adjustment oil passages 4522A and 4522B are disposed so as to be connected to the direction control valve 642. The pilot oil for moving the spool 80 of the direction control valve 642 to allow the bucket cylinder 12 to operate in the first operating direction flows through the bucket operating oil passage 4512A and the bucket adjustment oil passage 4522A. The pilot oil for moving the spool 80 of the direction control valve 642 to allow the bucket cylinder 12 to operate in the second operating direction flows through the bucket operating oil passage 4512B and the bucket adjustment oil passage 4522B.

The boom pressure-reducing valve 270A is disposed in the pilot oil passages (4510A and 4520A) through which the pilot oil for allowing the boom cylinder 10 to operate in the first operating direction (for allowing the boom 6 to perform the lowering operation) flows. The boom pressure-reducing valve 270A is decompressed by adjusting the pressure-reducing valve to limit the operation of the boom.

The boom pressure-reducing valve 270B is disposed in the pilot oil passages (4510B and 4520B) through which the pilot oil for allowing the boom cylinder 10 to operate in the second operating direction (for allowing the boom 6 to perform the raising operation) flows. The boom pressure-reducing valve 270B has a function of blocking the pilot oil passages.

The arm pressure-reducing valve 271A is disposed in the pilot oil passages (4511A and 4521A) through which the pilot oil for allowing the arm cylinder 11 to operate in the first operating direction (for allowing the arm 7 to perform the raising operation) flows. The arm pressure-reducing valve 271A is capable of adjusting the pilot pressure for limiting the operation of the arm 7.

The arm pressure-reducing valve 271B is disposed in the pilot oil passages (4511B and 4521B) through which the pilot oil for allowing the arm cylinder 11 to operate in the second operating direction (for allowing the arm 7 to perform the lowering operation) flows. The arm pressure-reducing valve 271B is capable of adjusting the pilot pressure for allowing the arm 7 to perform the lowering operation (the excavating operation).

The bucket pressure-reducing valve 272A is disposed in the pilot oil passages (4512A and 4522A) through which the pilot oil for allowing the bucket cylinder 12 to operate in the first operating direction (for allowing the bucket 8 to perform the raising operation) flows. The bucket pressure-reducing valve 272A is capable of adjusting the pilot pressure for allowing the bucket 8 to perform the raising operation (the dumping operation).

The bucket pressure-reducing valve 272B is disposed in the pilot oil passages (4512B and 4522B) through which the pilot oil for allowing the bucket cylinder 12 to operate in the second operating direction (for allowing the bucket 8 to perform the lowering operation) flows. The bucket pressure-reducing valve 272B is capable of adjusting the pilot pressure for allowing the bucket 8 to perform the lowering operation (the excavating operation).

[Control System]

Figure 23:
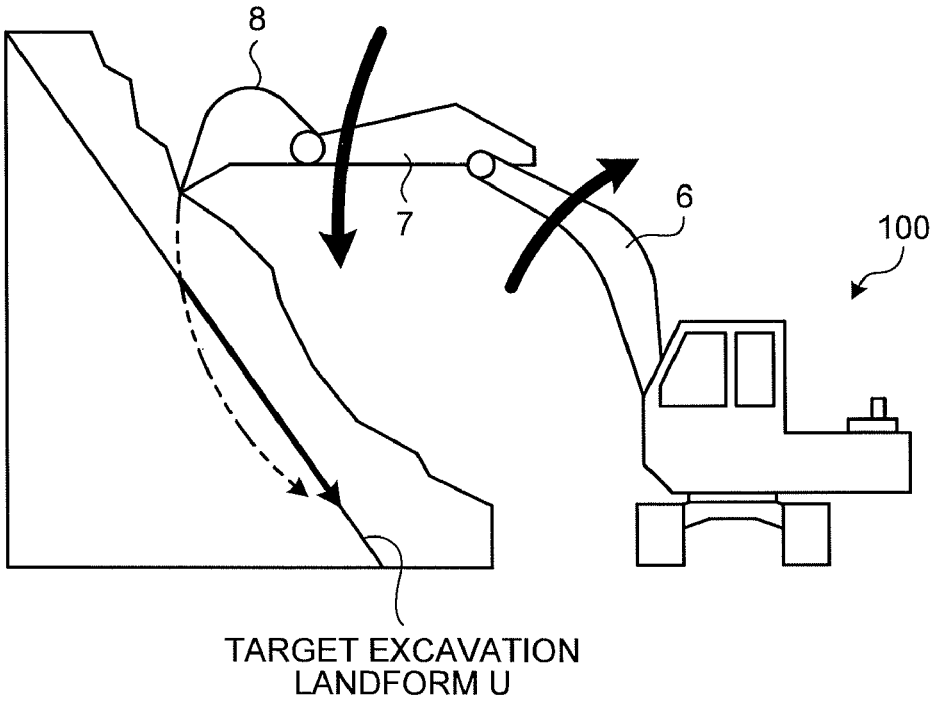
FIG. 23 is a schematic diagram illustrating an example of an operation of the construction machine.

FIG. 23 is a diagram schematically illustrating an example of an operation of the work machine 2 when the limited excavation control is performed. As described above, the hydraulic system 300 includes the boom cylinder 10 for driving the boom 6, the arm cylinder 11 for driving the arm 7, and the bucket cylinder 12 for driving the bucket 8.

As illustrated in FIG. 23, when excavation is performed according to the operation of the arm 7, the hydraulic system 300 operates so that the boom 6 is raised and the arm 7 is lowered. In the limited excavation control, the intervention control including the raising operation of the boom 6 is executed so that the bucket 8 does not dig into the target excavation landform U.

For example, when work of excavating an excavation object (the ground, a mountain, or the like) is performed, the operating device 25 is operated by the operator so that at least one of the arm 7 and the bucket 8 is lowered. When the cutting edge 8*a* of the bucket 8 would dig into the target excavation landform U according to the operation of the operator, the work machine controller 26 executes the raising operation of the boom 6 by controlling the intervention valve 27C to increase the pilot pressure of the intervention oil passage 502 so that the cutting edge 8*a* of the bucket 8 does not dig into the target excavation landform U.

Figure 24:
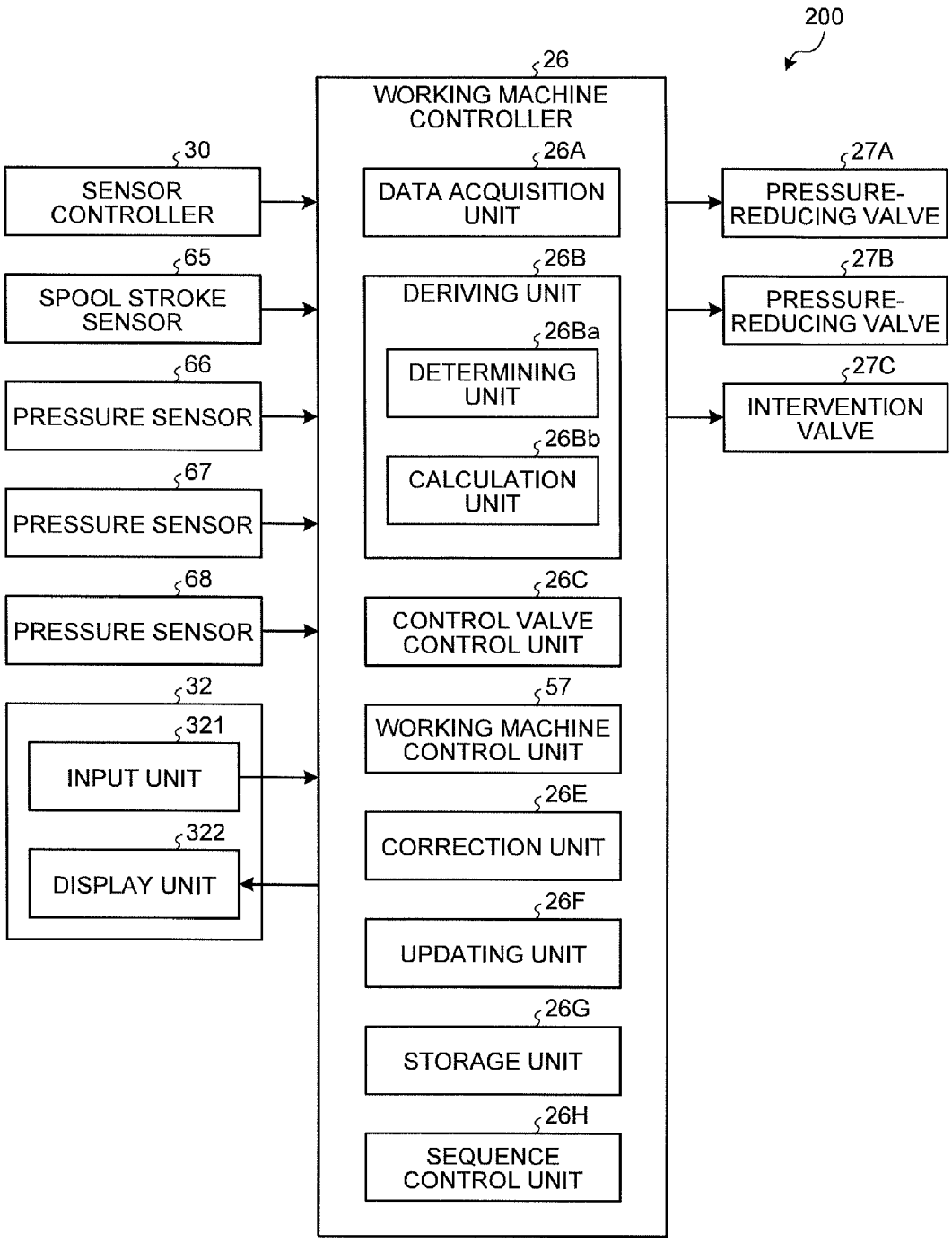
FIG. 24 is a functional block diagram illustrating an example of the control system.
Figure 25:
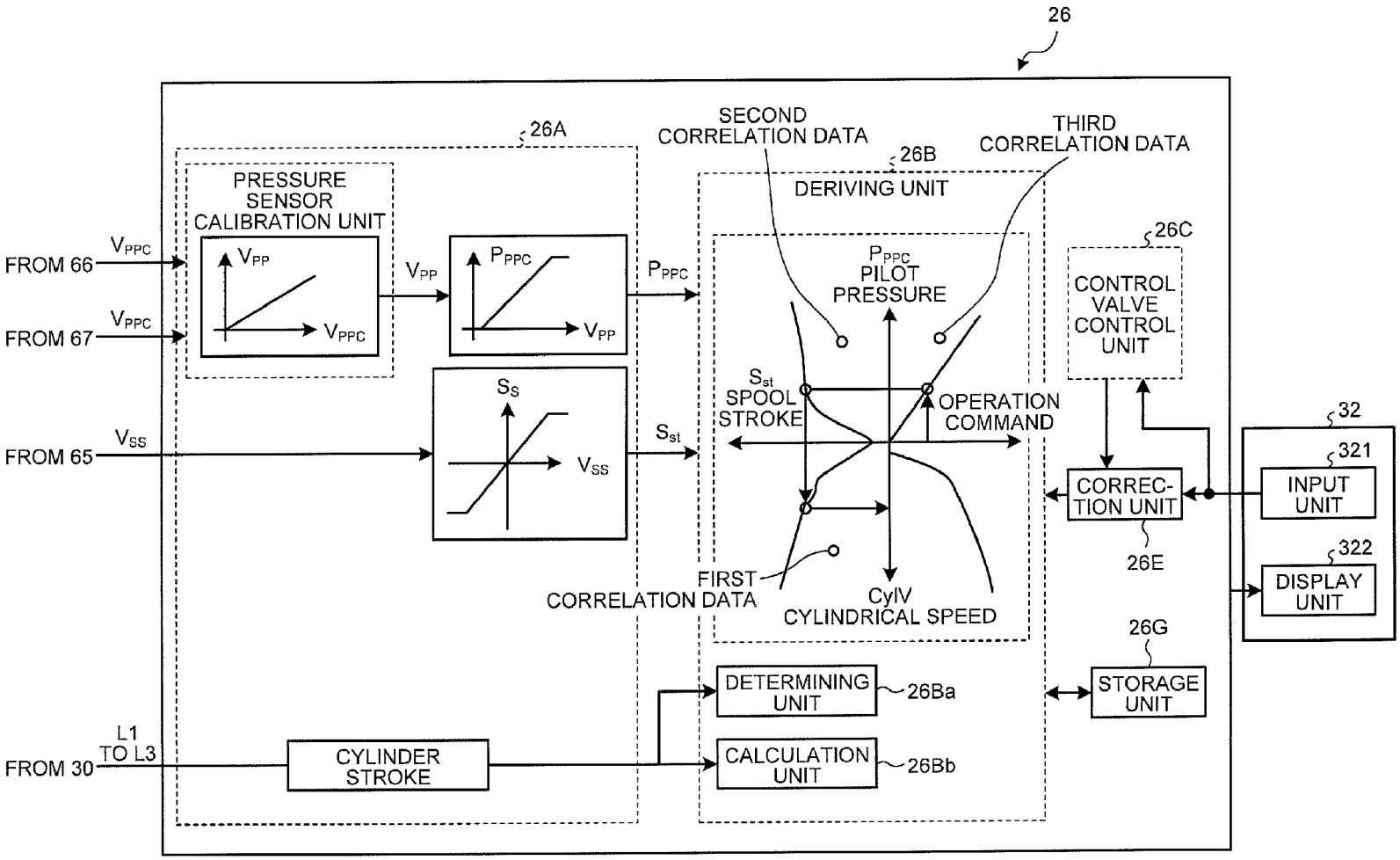
FIG. 25 is a functional block diagram illustrating an example of the control system.

FIGS. 24 and 25 are functional block diagrams illustrating an example of the control system 200 according to the present embodiment. As illustrated in FIGS. 24 and 25, the control system 200 includes the work machine controller 26, the sensor controller 30, the spool stroke sensor 65, the pressure sensor 66, the pressure sensor 67, the pressure sensor 68, the man machine interface 32 including the input unit 321 and the display unit 322, the pressure-reducing valve 27A, the pressure-reducing valve 27B, and the intervention valve 27C.

The work machine controller 26 includes a data acquisition unit 26A, a deriving unit 26B, a control valve control unit 26C, a work machine control unit 57, a correction unit 26E, an updating unit 26F, a storage unit 26G, and a sequence control unit 26H. The deriving unit 26B includes a determining unit 26Ba and a calculation unit 26Bb.

[Calibration Method]

Figure 26:
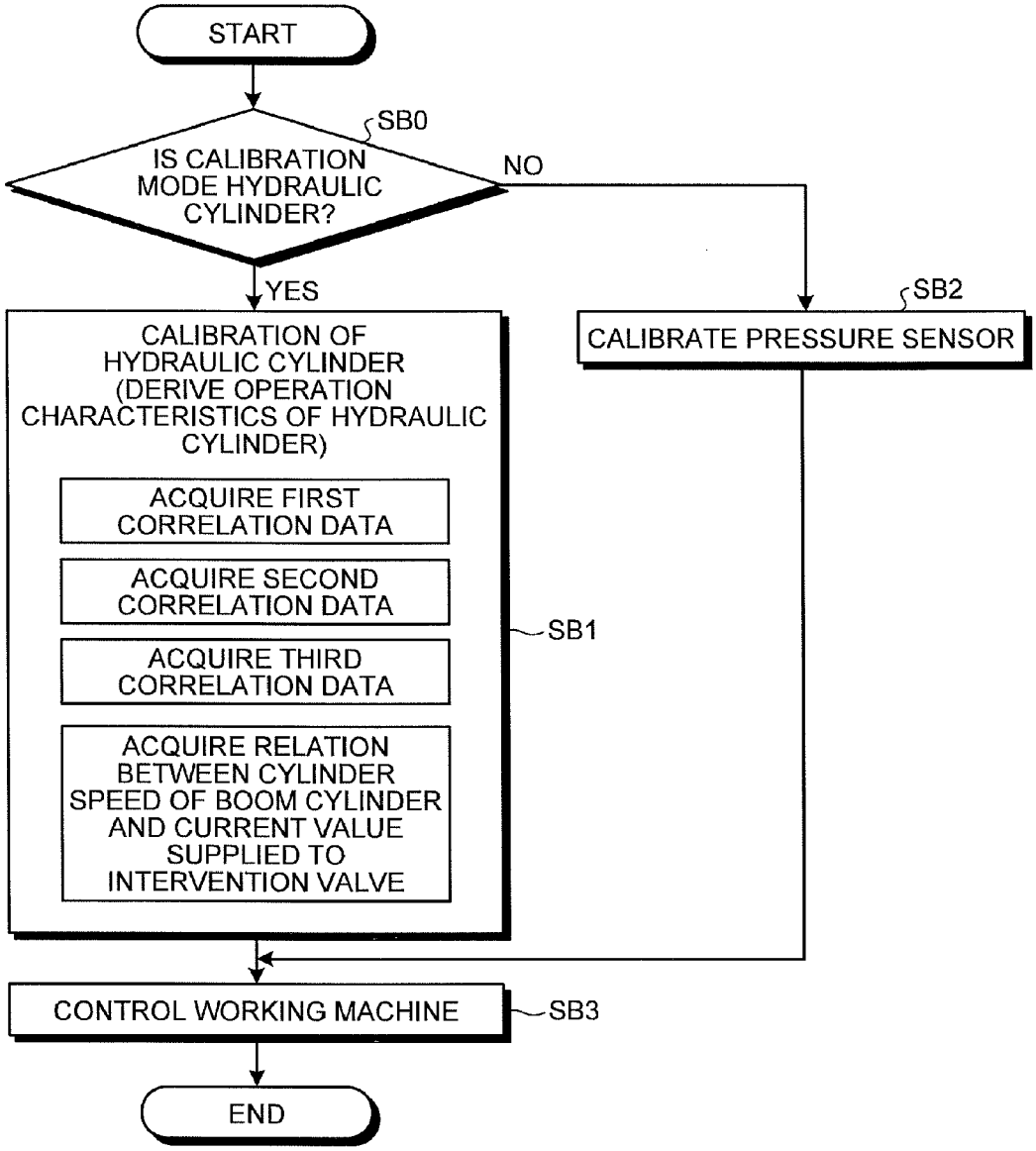
FIG. 26 is a flowchart illustrating an example of a process of a work machine controller.

FIG. 26 is a flowchart illustrating an example of a process of the work machine controller 26 according to the present embodiment. In the present embodiment, the work machine controller 26 calibrates at least a portion of the control system 200.

As illustrated in FIG. 26, in the present embodiment, the work machine controller 26 executes selecting a calibration mode (step SB0), calibrating the hydraulic cylinder 60 (step SB1), calibrating the pressure sensors 66 and 67 (step SB2), and controlling the work machine 2 (step SB3). Based on an operation command from the man machine interface, it is determined whether the calibration mode is the calibration of the hydraulic cylinder or the calibration of the pressure sensor (step SB0). When it is determined in step SB0 that the calibration mode is the calibration of the hydraulic cylinder (step SB0: Yes), the flow proceeds to step SB1. When it is determined in step SB0 that the calibration mode is not the calibration of the hydraulic cylinder (step SB0: No), the flow proceeds to step SB2.

The calibration will be described based on FIG. 25. The calibration of the hydraulic cylinder 60 includes outputting an operation command of operating the hydraulic cylinder 60 and acquiring operation characteristics of the hydraulic cylinder 60 when driving power based on the operation command is applied to the hydraulic cylinder 60. In the present embodiment, the data acquisition unit 26A of the work machine controller 26 acquires an operation command value and data on the cylinder speed of the hydraulic cylinder 60 in a state where the operation command of operating the hydraulic cylinder 60 is output. The deriving unit 26B of the work machine controller 26 derives the operation characteristics of the hydraulic cylinder 60 in relation to the output operation command value based on the data acquired by the data acquisition unit 26A.

Pilot oil is supplied to the pilot oil passage 450 based on the operation of the operating device 25. With the supply of pilot oil, the pressure sensor 66 detects pressure. The pressure detected by the pressure sensor 66 is transmitted to the work machine controller 26 and the pilot pressure is obtained by the work machine controller 26. A change in a stroke is detected by the spool stroke sensor 65 and a spool stroke Sst is transmitted to the work machine controller 26.

The detection values of the cylinder stroke sensors 16 to 18 are output to the work machine controller 26 as cylinder strokes L1 to L3 obtained by the sensor controller 30, and the cylinder speed is obtained by the work machine controller 26. In this way, the cylinder speed with respect to the operation of the operating device 25 is calculated.

Deriving the operation characteristics of the hydraulic cylinder 60 includes deriving first correlation data indicating the relation between the cylinder speed of the hydraulic cylinder 60 and the movement amount of the spool 80 of the direction control valve 64, second correlation data indicating the relation between the movement amount of the spool 80 and the pilot pressure controlled by the control valve 27, and third correlation data indicating the relation between the pilot pressure and the control signal output to the control valve 27.

Deriving the operation characteristics of the hydraulic cylinder 60 also includes deriving the relation between the cylinder speed of the boom cylinder 10 and the control signal output to the intervention valve 27C among the plurality of hydraulic cylinders 60 (the boom cylinder 10, the arm cylinder 11, and the bucket cylinder 12). In the present embodiment, the control valve 27 including the intervention valve 27C operates with a command current which serves as a command value from the work machine controller 26. When current is supplied to the control valve 27, the control valve 27 operates. In the present embodiment, deriving the operation characteristics of the boom cylinder 10 includes deriving the relation between the cylinder speed of the boom cylinder 10 and the current value supplied to the intervention valve 27C.

The calibration of the pressure sensors 66 and 67 includes correcting the detection value of the pressure sensor 66 so that the detection value of the pressure sensor 66 is identical to the detection value of the pressure sensor 67. In the present embodiment, the data acquisition unit 26A of the work machine controller 26 acquires data on the detection value of the pressure sensor 66 and the detection value of the pressure sensor 67 in a state where the pilot oil passage 450 is opened by the control valve 27. The correction unit 26E of the work machine controller 26 corrects the detection value of the pressure sensor 66 based on the data acquired by the data acquisition unit 26A so that the detection value of the pressure sensor 66 is identical to the detection value of the pressure sensor 67.

Based on an operation of the operator, the input unit 321 of the man machine interface 32 outputs each calibration command to the work machine controller 26. The control valve control unit 26C of the work machine controller outputs a command of driving each work machine to the control valve 27 (27C) based on the calibration command. The work machine is driven based on the command of the control valve control unit 26C, and the data acquisition unit 26A acquires the detection value from the stroke sensor 65 and the output of the cylinder strokes L1 to L3 from the sensor controller 30 at that time. Based on the data acquired by the data acquisition unit 26A, the deriving unit 26B causes the 26Ba to make determination on the detection value and causes the calculation unit 26Bb to calculate the cylinder speed from the cylinder stroke. Moreover, the deriving unit 26B creates first to third correlation diagrams with a pilot pressure Pppc acquired from the pressure sensor 66 acquired by the data acquisition unit 26A, the spool stroke Sst acquired from the spool stroke sensor 65, and the cylinder stroke cylinder speed calculated by the calculation unit 26Bb.

The first to third correlation data created by the deriving unit 26B are stored in the storage unit 26G and updated by the updating unit 26F.

[Calibration Method of Hydraulic Cylinder]

A calibration method of the hydraulic cylinder 60 will be described. First, a calibration method (deriving of operation characteristics) of the boom cylinder 10 will be described.

Figure 27:
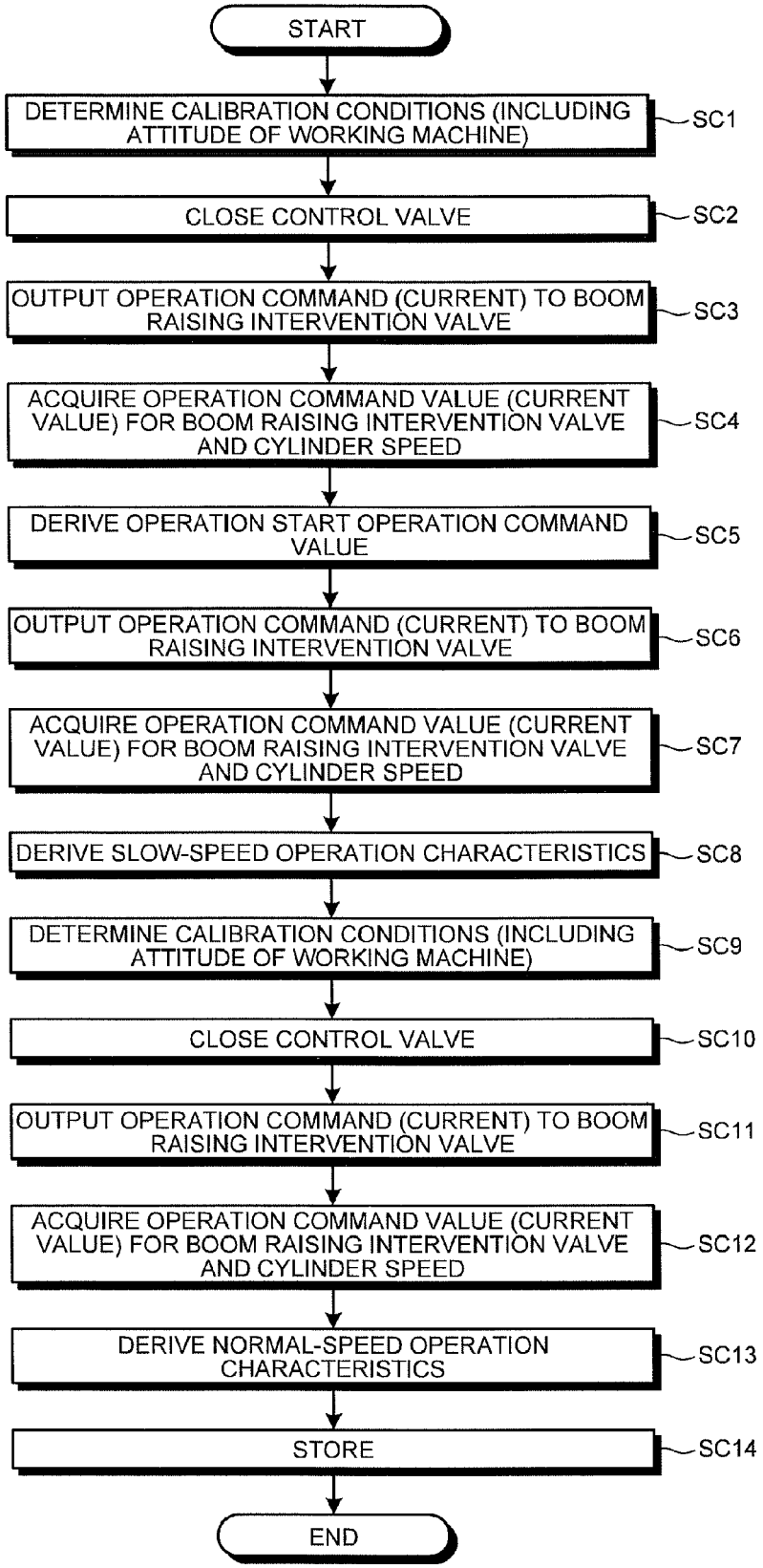
FIG. 27 is a flowchart illustrating an example of a calibration method.

FIG. 27 is a flowchart illustrating an example of the calibration method of the boom cylinder 10 according to the present embodiment. In the present embodiment, calibration of the boom cylinder 10 includes deriving the operation characteristics of the raising operation of the boom cylinder 10. Deriving the operation characteristics of the raising operation of the boom cylinder 10 includes deriving the relation between the current value supplied to the intervention valve 27C and the cylinder speed of the boom cylinder 10. In the following description, an example where a calibration subject is the intervention valve 27C will be described.

As illustrated in FIG. 27, the calibration method of the boom cylinder 10 according to the present embodiment includes determining calibration conditions of the excavator 100 including the attitude of the work machine 2 (step SC1), closing the plurality of control valves 27 (step SC2), outputting an operation command of allowing the boom cylinder 10 to perform the raising operation after the determination (step SC3), acquiring an operation command value and data on the cylinder speed of the boom cylinder 10 during the raising operation in a state where the operation command of allowing the boom cylinder 10 to perform the raising operation is output (step SC4), deriving an operation start operation command value when the boom cylinder 10 in a stopped state starts the raising operation based on the data (the operation command value and the cylinder speed of the boom cylinder 10) acquired in step SC4 (step SC5), outputting an operation command of an operation command value higher than that used in step SC3 after the operation start operation command value is derived (step SC6), acquiring the operation command value and data on the cylinder speed of the boom cylinder 10 during the raising operation in a state where the operation command of allowing the boom cylinder 10 to perform the raising operation is output (step SC7), deriving slow-speed operation characteristics indicating the relation between the operation command value and the cylinder speed in a slow-speed area based on the data (the operation command value and the cylinder speed of the boom cylinder 10) acquired in step SC7 (step SC8), determining the attitude of the work machine 2 again after the slow-speed operation characteristics are derived (step S9), closing the plurality of control valves 27 (step SC10), outputting an operation command of an operation command value higher than that used in step SC6 after the attitude of the work machine 2 is determined (step SC11), acquiring an operation command value and data on the cylinder speed of the boom cylinder 10 during the raising operation in a state where the operation command of allowing the boom cylinder 10 to perform the raising operation is output (step SC12), deriving normal-speed operation characteristics indicating the relation between the operation command value and the cylinder speed in a normal-speed area higher than in the slow-speed area based on the data (the operation command value and the cylinder speed of the boom cylinder 10) acquired in step SC12 (step SC13), and storing the derived operation start operation command value, slow-speed operation characteristics, and normal-speed operation characteristics in the storage unit 26G (step SC14).

In the present embodiment, the processes of steps SC1 to SC14 including acquiring the data for deriving the operation start operation command value (step SC4), deriving the operation start operation command value (step SC5), acquiring the data for deriving the slow-speed operation characteristics (step SC7), deriving the slow-speed operation characteristics (step SC8), acquiring the data for deriving the normal-speed operation characteristics (step SC12), and deriving the normal-speed operation characteristics (step SC13) are continuously executed in sequence based on the control of the sequence control unit 26H.

In the present embodiment, a calibration process includes a first deriving sequence of deriving the operation start operation command value and the slow-speed operation characteristics and a second deriving sequence of deriving the normal-speed operation characteristics. The first deriving sequence includes the processes of steps SC1 to SC8. The second deriving sequence includes the processes of steps SC9 to SC13. The second deriving sequence is executed a plurality of times under different conditions (operation command values). That is, the processes of steps SC9 to SC13 are executed a plurality of times. In the present embodiment, the second deriving sequence is executed three times under different conditions. In the following description, the first deriving sequence will be appropriately referred to as a first sequence. Among the second deriving sequence executed three times, the first round of the second deriving sequence will be appropriately referred to as a second sequence, the second round of the second deriving sequence will be appropriately referred to as a third sequence, and the third round of the second deriving sequence will be appropriately referred to as a fourth sequence.

Figure 28:
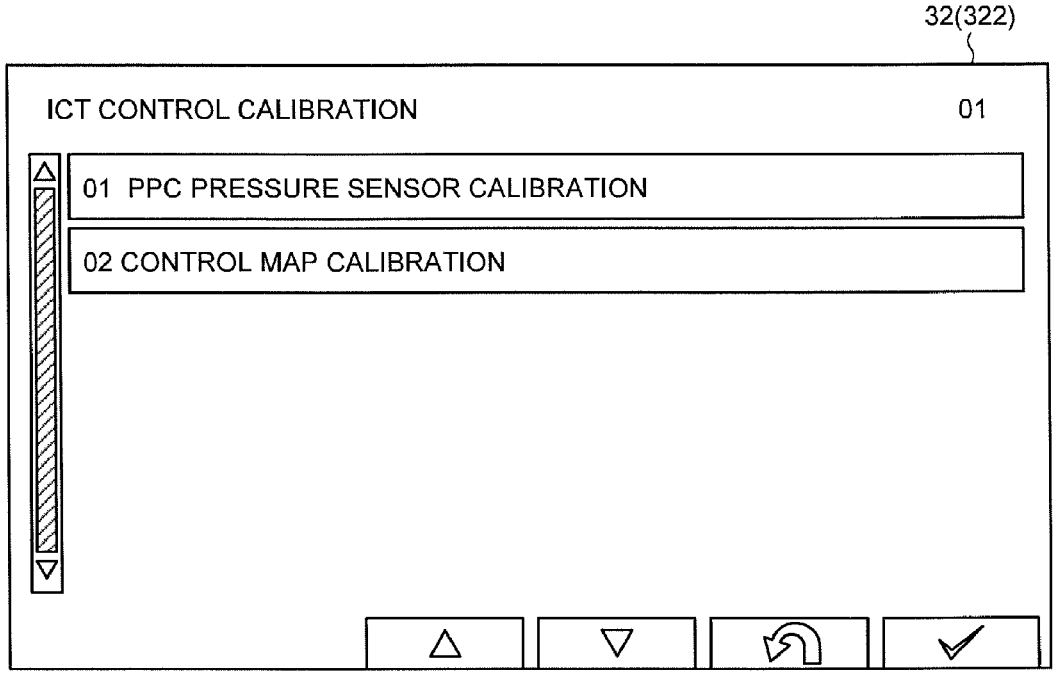
FIG. 28 is a diagram illustrating an example of a display unit.
Figure 29:
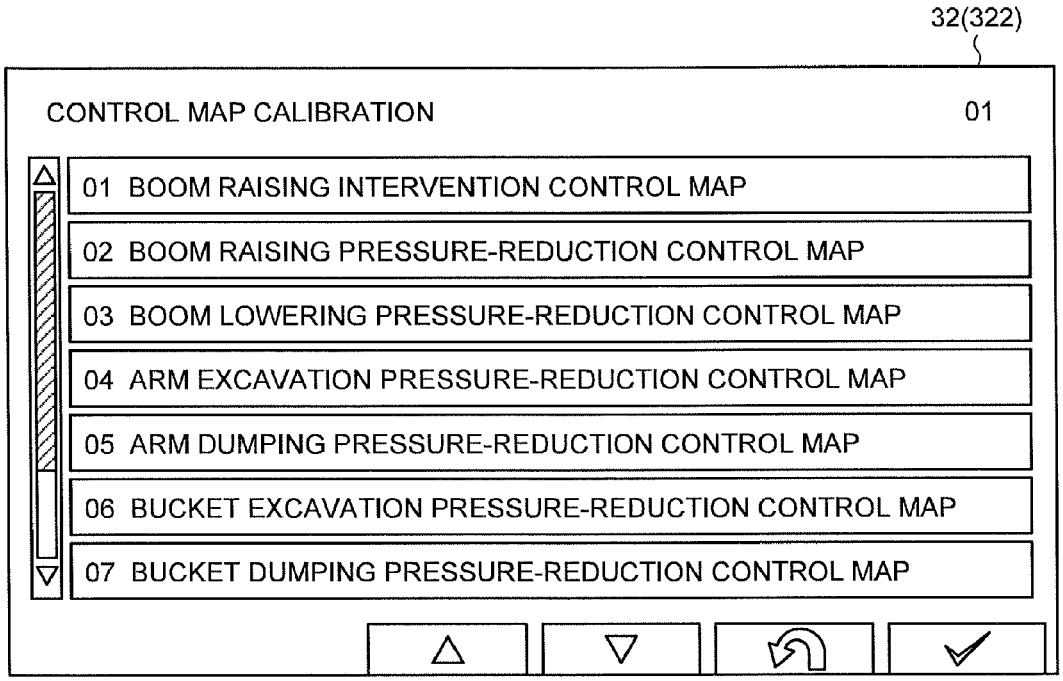
FIG. 29 is a diagram illustrating an example of the display unit.

During the calibration, a menu is displayed on the display unit 322 of the man machine interface 32. FIGS. 28 and 29 are diagrams illustrating an example of a screen of the display unit 322. As illustrated in FIG. 28, "PPC pressure sensor calibration" and "control map calibration" are provided as a calibration menu. As described with reference to FIG. 26, in the present embodiment, the work machine controller 26 executes the calibration (step SB1) of the hydraulic cylinder 60 or the calibration (step SB2) of the pressure sensors 66 and 67 with the data on a calibration sheet from the man machine interface 32. When the calibration of the pressure sensors 66 and 67 is performed, the "PPC pressure sensor calibration" is selected. When the calibration of the hydraulic cylinder 60 is performed, the "control map calibration" is selected. Here, since the calibration (derivation of operation characteristics) of the boom cylinder among the hydraulic cylinders 60 is executed, the "control map calibration" is selected.

When the "control map calibration" is selected, the screen illustrated in FIG. 29 is displayed on the display unit 322. Here, when the "relation between the current value supplied to the intervention valve 27C and the cylinder speed of the boom cylinder 10" is derived, the operator selects a "boom raising intervention control map".

In the present embodiment, the "relation between the current value supplied to the boom pressure-reducing valve 270A and the cylinder speed of the boom cylinder 10," the "relation between the current value supplied to the boom pressure-reducing valve 270B and the cylinder speed of the boom cylinder 10," the "relation between the current value supplied to the arm pressure-reducing valve 271A and the cylinder speed of the arm cylinder 11," the "relation between the current value supplied to the arm pressure-reducing valve 271B and the cylinder speed of the arm cylinder 11," the "relation between the current value supplied to the bucket pressure-reducing valve 272A and the cylinder speed of the bucket cylinder 12," and the "relation between the current value supplied to the bucket pressure-reducing valve 272B and the cylinder speed of the bucket cylinder 12" can be also derived as well as the "relation between the current value supplied to the intervention valve 27C and the cylinder speed of the boom cylinder 10".

When the "relation between the current value supplied to the boom pressure-reducing valve 270A and the cylinder speed of the boom cylinder 10" is derived, a "boom lowering pressure-reduction control map" is selected. When the "relation between the current value supplied to the boom pressure-reducing valve 270B and the cylinder speed of the boom cylinder 10" is derived, a "boom raising pressure-reduction control map" is selected. When the "relation between the current value supplied to the arm pressure-reducing valve 271A and the cylinder speed of the arm cylinder 11" is derived, an "arm dumping pressure-reduction control map" is selected. When the "relation between the current value supplied to the arm pressure-reducing valve 271B and the cylinder speed of the arm cylinder 11" is derived, an "arm excavation pressure-reduction control map" is selected. When the "relation between the current value supplied to the bucket pressure-reducing valve 272A and the cylinder speed of the bucket cylinder 12" is derived, a "bucket dumping pressure-reduction control map" is selected. When the "relation between the current value supplied to the bucket pressure-reducing valve 272B and the cylinder speed of the bucket cylinder 12" is derived, a "bucket excavation pressure-reduction control map" is selected.

In order to derive the relation between the current value supplied to the intervention valve 27C and the cylinder speed of the boom cylinder 10, the sequence control unit 26H determines calibration conditions after the man machine interface 32 is operated (step SC1). The calibration conditions include output pressure of the main hydraulic pump, temperature conditions of operating oil, failure conditions of the control valve 27, and attitude conditions of the work machine 2. In the present embodiment, during the calibration, the locking lever is operated so that operating oil is supplied to the pilot oil passage 502. Moreover, the output of the main hydraulic pump is adjusted so as to have a predetermined value (constant value). In the present embodiment, the output of the main hydraulic pump is adjusted so as to be maximized (at the full throttle in which the pump swash plate of the hydraulic pump is in its largest tilt angle state). The output of the main hydraulic pump is adjusted so that the pilot pressure reaches a largest value in an allowable range of the pilot pressure in the intervention oil passage 501. Moreover, the temperature of the operating oil is adjusted so as to have a predetermined value (constant value).

The determination of the calibration conditions includes adjustment of the attitude of the work machine 2. In the present embodiment, attitude adjustment request information of requesting adjustment of the attitude of the work machine 2 is displayed on the display unit 322 of the man machine interface 32. When this information is displayed, the control valve control unit 260 outputs a command current to the control valves 270A, 270B, 271A, 271B, 272A, and 272B and creates a state where the operating device 25 can operate the work machine. The operator operates the operating device 25 according to the display on the display unit 322 to adjust the attitude of the work machine 2 to the attitude (initial attitude) displayed by the attitude adjustment request information. By performing the calibration process after the work machine 2 is put into the initial attitude, it is possible to perform the calibration process always under the same conditions. For example, the moment acting on the boom 6 changes depending on the attitude of the work machine 2. When the moment acting on the boom 6 changes, the calibration results may change. In the present embodiment, since the calibration process is performed after the work machine 2 is put into the initial attitude, it is possible to perform the calibration process always under the same conditions without causing a change in the moment acting on the boom 6, for example.

Figure 30:
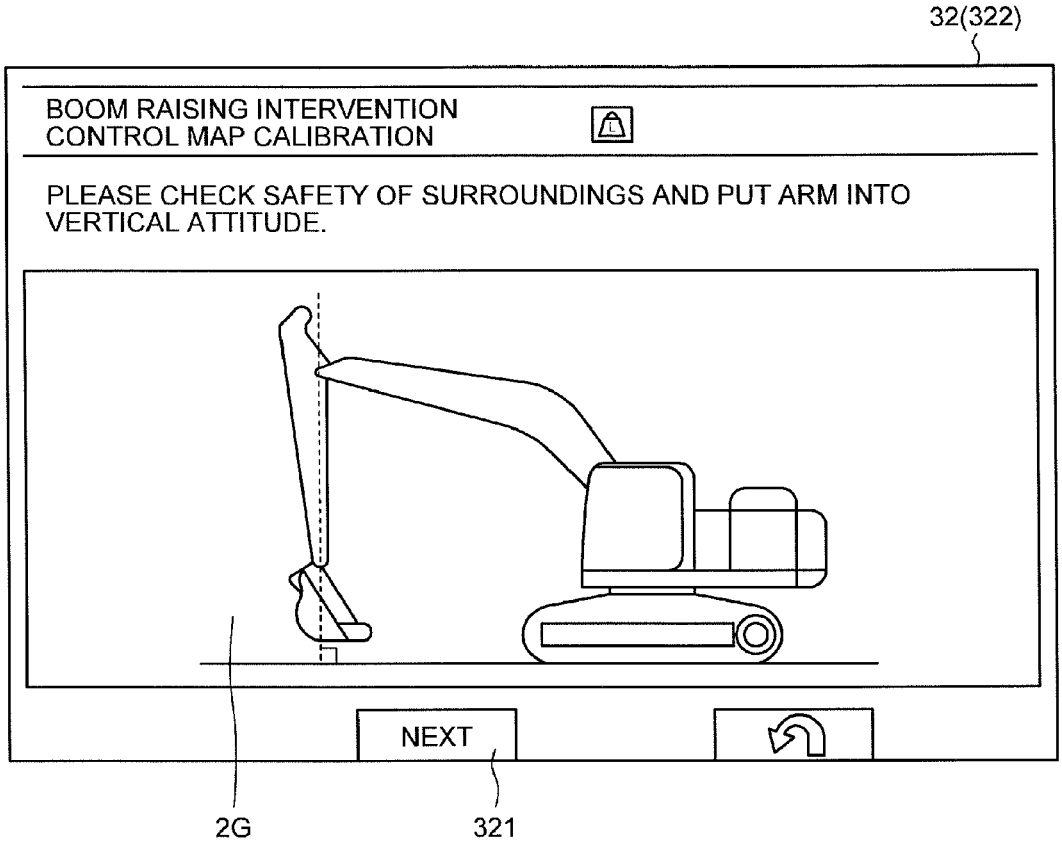
FIG. 30 is a diagram illustrating an example of the display unit.

FIG. 30 is a diagram illustrating an example of the attitude adjustment request information displayed on the display unit 322 according to the present embodiment. As illustrated in FIG. 30, a guidance (line) 2G for adjusting the initial attitude of the work machine 2 is displayed on the display unit 322. The operator operates the operating device 25 to adjust the attitude of the work machine 2 while viewing the display unit 322 so that the work machine 2 (the arm 7) is disposed along the guidance 2G. The determining unit 26Ba can understand (detect) the attitude of the work machine 2 based on the input from the cylinder stroke sensors 16, 17, and 18, for example. In this way, the operator operates the operating device 25 to adjust the attitude of the work machine 2 while viewing the display unit 322 so that the arm 7 is disposed along the guidance 2G. The determining unit 26Ba can determine whether the actual attitude follows the attitude request information.

Here, a service person that performs maintenance and an operator can perform calibration work. However, the operator can perform the calibration work of the boom raising intervention calibration (first sequence). In this way, when the bucket is replaced, the bucket can be calibrated so as to have accurate command characteristics.

Moreover, during the adjustment of the attitude of the work machine 2, each of the plurality of control valves 27 enters into an open state based on the command of the control valve control unit 26C. Therefore, the operator can drive the work machine 2 by operating the operating device 25. With the operation of the operating device 25, the work machine 2 is driven so as to be in the initial attitude.

As illustrated in FIG. 30, in the present embodiment, the guidance 2G is vertical to the ground surface on which the excavator 100 is disposed. The initial attitude of the work machine 2 is an attitude where the arm 7 is disposed vertically to the ground surface on which the excavator 100 is disposed.

In the excavation work, when a predetermined attitude is created with the work machine 2 arranged horizontally, a normal attitude (the central position of each cylinder) of the work machine 2 is set as the initial attitude of the calibration. In the excavation work, when the intervention control is executed so that the cutting edge 8*a* of the bucket 8 does not dig into the target excavation landform U, the intervention valve 27C operates in a state where the work machine 2 is in such an attitude as illustrated in FIG. 30. Therefore, by performing the calibration process for deriving the relation between the current value supplied to the intervention valve 27C and the cylinder speed of the boom cylinder 10 after putting the work machine 2 into such an attitude (initial attitude) as illustrated in FIG. 30, it is possible to derive the relation between the current value supplied to the intervention valve 27C and the cylinder speed of the boom cylinder 10 in such an attitude that the work machine 2 takes most frequently.

After the attitude of the work machine 2 is adjusted to the initial attitude, the input unit 321 of the man machine interface 32 is operated by the operator in order to start the calibration process. In the present embodiment, the input unit 321 includes operation buttons or a touch panel and includes an input switch corresponding to a "NEXT" switch illustrated in FIG. 30. The "NEXT" switch functions as the input unit 321.

Figure 31:
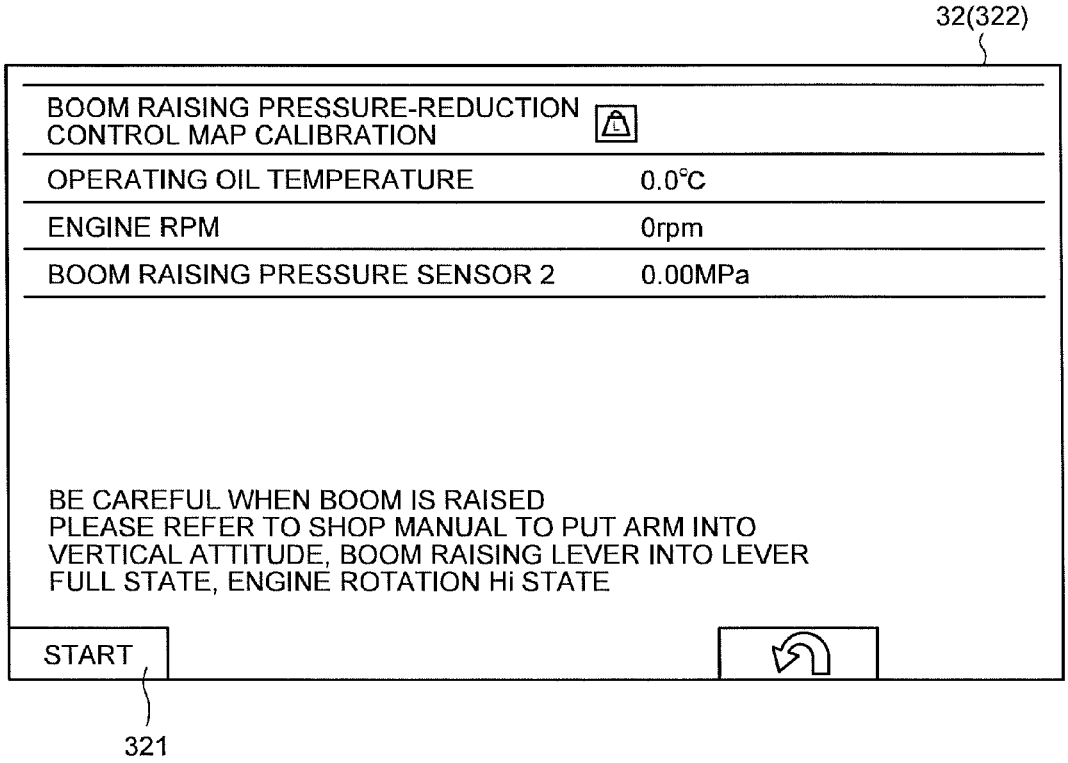
FIG. 31 is a diagram illustrating an example of the display unit.

When the "NEXT" switch illustrated in FIG. 30 is operated, such a screen as illustrated in FIG. 31 is displayed on the display unit 322. In FIG. 31, a "START" switch functioning as the input unit 321 is displayed on the display unit 322. When the "START" switch is operated, the calibration process starts. A command signal generated with the operation of the input unit 321 is output to the work machine controller 26.

In the present embodiment, a display content of the display unit 322 changes according to a progress rate of the calibration process. FIG. 31 illustrates an example of a screen of the display unit 322 when the progress rate of the calibration process is 0%.

Figure 32:
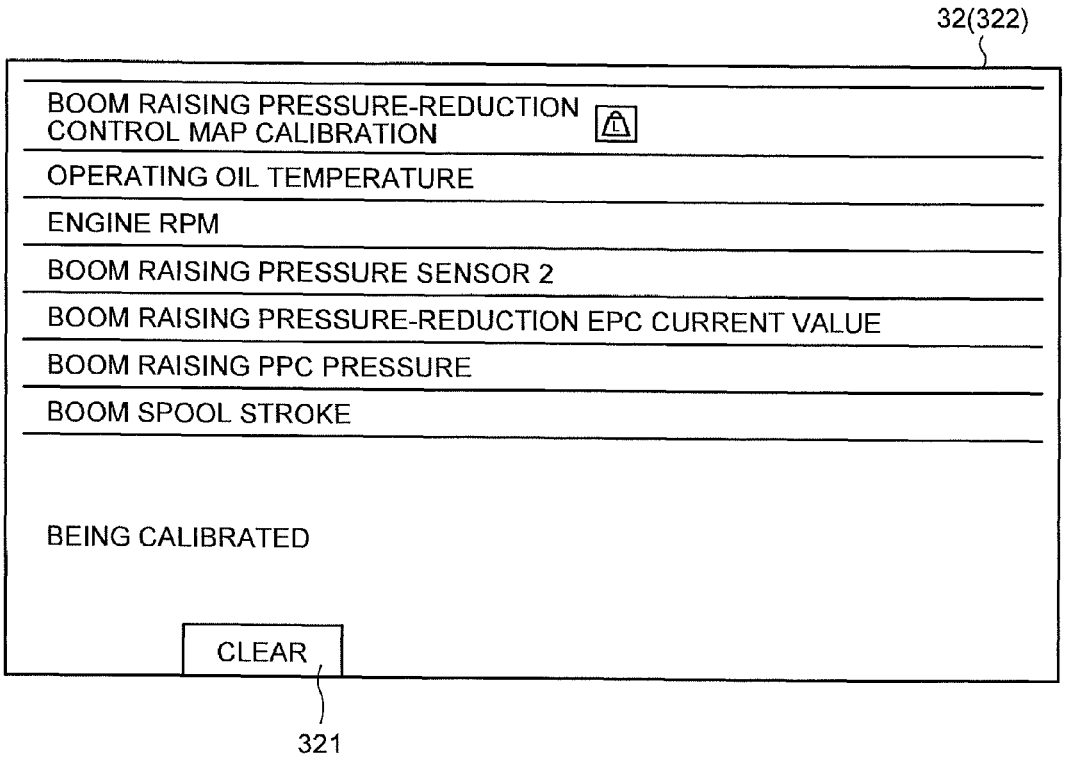
FIG. 32 is a diagram illustrating an example of the display unit.

FIG. 32 illustrates an example of a screen of the display unit 322 when the progress rate of the calibration process is 1% or more and 99% or less. When the calibration process starts and the progress rate of the calibration process is 1% or more and 99% or less, such a display content as illustrated in FIG. 32 is displayed on the display unit 322. In FIG. 32, a "CLEAR" switch functioning as the input unit 321 is displayed on the display unit 322. When the operator needs to interrupt the calibration, the operator operates the "CLEAR" switch to interrupt the calibration process, the data acquired by the data acquisition unit 26A is restored to the previously calibrated value, and also the progress rate returns to 0% (is reset).

FIG. 33 illustrates an example of a screen of the display unit 322 when the progress rate of the calibration process is 100%. In FIG. 33, a "CLEAR" switch functioning as the input unit 321 is displayed on the display unit 322. When the "CLEAR" switch is operated, the calibration process is interrupted, the data acquired by the data acquisition unit 26A is restored to the previously calibrated value, and also the progress rate returns to 0% (is reset). Moreover, a "NEXT" switch is displayed on the display unit 322 illustrated in FIG. 33.

The control valve control unit 26C of the work machine controller 26 controls each of the plurality of control valves 27. After acquiring the command signal for starting the calibration process from the input unit 321, the control valve control unit 26C closes all of the plurality of control valves 27 (step SC2).

The above-described operation of the input unit 321 for starting the calibration process includes generating a command signal for allowing the work machine controller 26 to output an operation command for operating the boom cylinder 10. The control valve control unit 26C acquires the command signal for starting the calibration process from the input unit 321 and outputs the operation command to the intervention valve 27C (step SC3).

That is, in the present embodiment, with the operation of the input unit 321 by the operator, a command signal for allowing the control valve control unit 26 to output an operation command for allowing the boom cylinder 10 to operate in the extending direction (for allowing the boom 6 to perform the raising operation) among the plurality of hydraulic cylinders 60 (the boom cylinder 10, the arm cylinder 11, and the bucket cylinder 12) is generated. The control valve control unit 26C acquires the command signal generated by the operation of the input unit 321 and outputs an operation command for allowing the boom cylinder 10 to operate in the extending direction (for allowing the boom 6 to perform the raising operation) among the plurality of hydraulic cylinders 60 (the boom cylinder 10, the arm cylinder 11, and the bucket cylinder 12) to the intervention valve 27C.

The control valve control unit 26C outputs an operation command to the intervention valve 27C so as to open the intervention valve 27C which is a calibration subject. That is, the control valve control unit 26C controls the intervention valve 27C so as to open the intervention oil passage 501 through which the pilot oil for allowing the boom cylinder 10 to operate in the extending direction (for allowing the boom 6 to perform the raising operation) flows. Moreover, the control valve control unit 26C controls the boom pressure-reducing valve 270B so as to close the boom operating oil passage 4510B. Moreover, the control valve control unit 26C controls the boom pressure-reducing valve 270A so as to close the boom operating oil passage 4510A through which the pilot oil for allowing the boom cylinder 10 to operate in the extending direction (for allowing the boom 6 to perform the lowering operation) flows. Moreover, the control valve control unit 26C controls the arm control valve 271 (271A and 271B) so as to close the pilot oil passage (4511A, 4511B, 4521A, and 4521B) for the arm cylinder 11. Moreover, the control valve control unit 26C controls the bucket control valve 272 (272A and 272B) so as to close the pilot oil passage (4512A, 4512B, 4522A, and 4522B) for the bucket cylinder 12.

That is, the control valve control unit 26C outputs a command current of the operation command (EPC current) so as to open the intervention valve 27C which is a calibration subject and close all the control valves 27 (the boom pressure-reducing valves 270A and 270B, the arm pressure-reducing valves 271A and 271B, and the bucket pressure-reducing valves 272A and 272B) which are not calibration subjects.

In the present embodiment, the operation command for the intervention valve 27C includes current. The control valve control unit 26C determines a current value (operation command value) supplied to the intervention valve 27C and supplies (outputs) the determined current value to the intervention valve 27C.

In a state where the operation command (EPC current) is output to the intervention valve 27C, the data acquisition unit 26A acquires data on the operation command value (current value) of the operation command and the cylinder speed of the boom cylinder 10 that performs the raising operation (step SC4).

The deriving unit 26B of the work machine controller 26 derives the operation characteristics in the extending direction of the boom cylinder 10 with respect to the operation command value based on the data acquired by the data acquisition unit 26A. In the present embodiment, the deriving unit 26B derives the operation start operation command value (operation start operation current value) when the boom cylinder 10 in the stopped state starts operating and the slow-speed operation characteristics indicating the relation between the operation command value and the cylinder speed of the boom cylinder 10 in the slow-speed area based on the data acquired by the data acquisition unit 26A as the operation characteristics of the boom cylinder 10.

Figure 34:
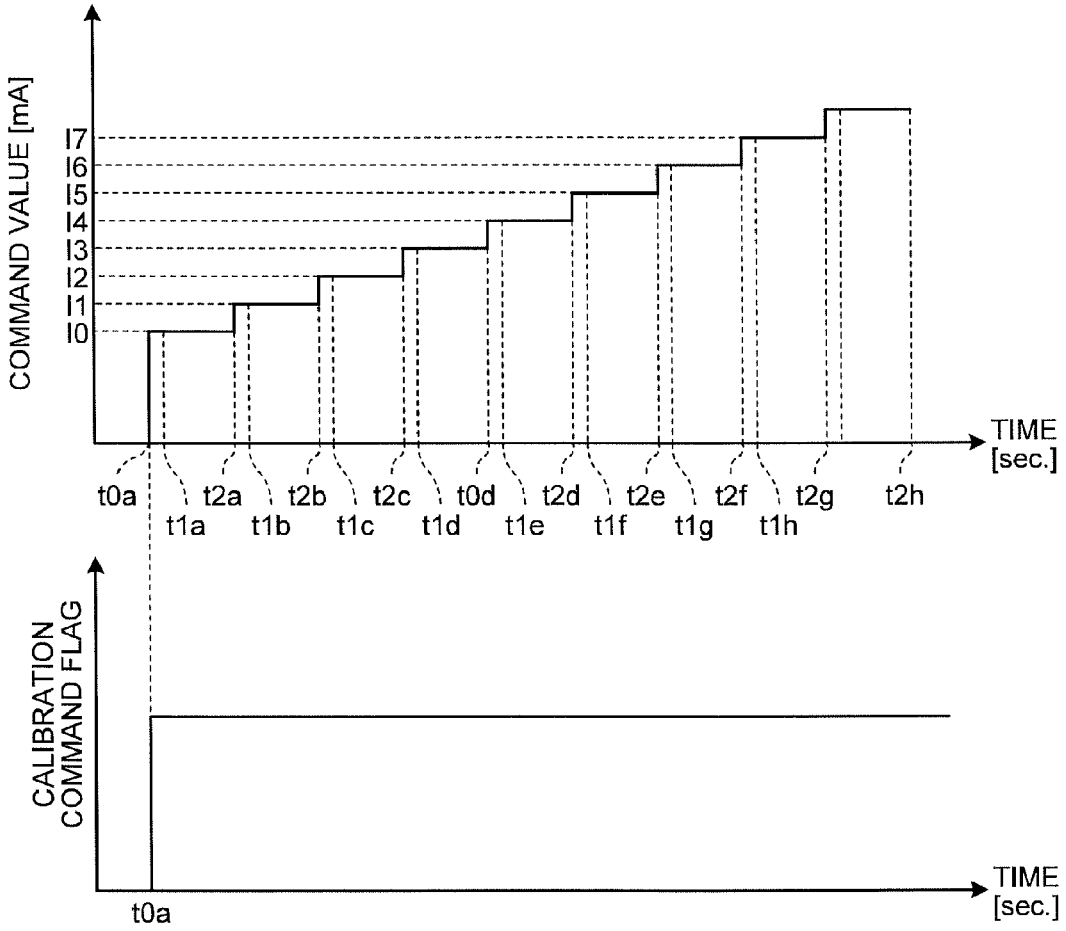
FIG. 34 is a timing chart for describing an example of a calibration process.

FIG. 34 is a timing chart for describing an example of the calibration process according to the present embodiment. In FIG. 34, the horizontal axis of the lower graph represents time, and the vertical axis represents a command signal output to the control valve control unit 26C from the input unit 321 of the man machine interface with the operation of the input unit 321 of the man machine interface. In FIG. 34, the horizontal axis of the upper graph represents time, and the vertical axis represents an operation command value (current value) output (supplied) to the intervention valve 27C from the work machine controller 26.

As illustrated in FIG. 34, at time t0*a*, the input unit 321 is operated in order to start the calibration process, and a command signal is output from the input unit 321 to the control valve control unit 26C. At a time point t0*a*, the control valve control unit 26C closes all of the plurality of control valves 27 and then outputs (supplies) an operation command (EPC current) to the intervention valve 27C. The operation command (EPC current) is not output to the control valves 27 other than the intervention valve 27C. Moreover, at the time point t0*a*, the boom cylinder 10 has not started operating. The arm cylinder 11 and the bucket cylinder 12 have not moved.

First, the control valve control unit 26C outputs an operation command of an operation command value I0 to the intervention valve 27C. A point lower than that of activation is set in advance as the operation command value I0. The control valve control unit 260 continuously outputs the operation command value I0 to the intervention valve 27C during a predetermined time interval from the time point t0*a* to the time point t2*a*.

In a state where the operation command value I0 is output, the cylinder speed of the boom cylinder 10 is detected by the boom cylinder stroke sensor 16. More specifically, the cylinder stroke sensor detects a displacement of the cylinder and outputs the same to the sensor controller. The sensor controller derives a cylinder stroke and outputs the same to the work machine controller. The work machine controller derives the cylinder speed from the cylinder stroke and the time elapsed. The detection result of the boom cylinder stroke sensor 16 is output to the work machine controller 26. The data acquisition unit 26A of the work machine controller 26 acquires the operation command value I0 and the data on the cylinder speed of the boom cylinder 10 when the operation command value I0 is output.

The deriving unit 26B determines whether the boom cylinder 10 in the stopped state has started operating (has been activated) in a state where the operation command value I0 is output to the intervention valve 27C. The deriving unit 26B has the determining unit 26Ba that determines whether the boom cylinder 10 in the stopped state has started operating based on the data on the cylinder stroke of the boom cylinder 10.

In the present embodiment, the determining unit 26Ba compares the cylinder stroke of the boom cylinder 10 at a time point t1*a* and the cylinder stroke of the boom cylinder 10 at a time point t2*a*. The time point t1*a* is a time point occurring after a first predetermined time interval has elapsed from the time point t0*a*, for example. The time point t2*a* is a time point occurring after a third predetermined time interval has elapsed from the time point t0*a*, for example, (a time point occurring after a second predetermined time interval has elapsed from the time point t1*a*). However, the second predetermined time interval is assumed to be longer than the first predetermined time interval. The third predetermined time interval is assumed to be a time interval obtained by adding the first predetermined time interval and the second predetermined time interval.

The determining unit 26Ba derives a difference between the detection value of the cylinder stroke at the time point t1*a* and the detection value of the cylinder stroke at the time point t2*a*. When determining that the derived difference value is smaller than a predetermined threshold, the determining unit 26Ba determines that the boom cylinder 10 has not started operating. When determining that the derived difference value is equal to or more than the predetermined threshold, the determining unit 26Ba determines that the boom cylinder 10 has started operating.

When the operation command value I0 is output and the determining unit 26Ba determines that the boom cylinder 10 has started operating, the operation command value I0 serves as an operation start operation command value (operation start operation current value) when the boom cylinder 10 in the stopped state starts operating.

When it is determined that the boom cylinder 10 has not started operating under the operation command value I0, the control valve control unit 26C increases the operation command value output to the intervention valve 27C. The control valve control unit 26C increases the operation command value I0 to an operation command value I1 at the time point t2*a* without decreasing the operation command value I0 and outputs the operation command value I1 to the intervention valve 27C. The control valve control unit 26C continuously outputs the operation command value I1 to the intervention valve 27C from the time point t2*a* to the time point t2*b*. The time interval from the time point t2*a* and the time point t2*b* is a third predetermined time interval, for example.

In a state where the operation command value I1 is output, the cylinder stroke of the boom cylinder 10 is detected by the cylinder stroke sensor 16. The detection result of the cylinder stroke sensor 16 is input to the work machine controller 26. The data acquisition unit 26A of the work machine controller 26 acquires the operation command value I1 and the data on the cylinder stroke of the boom cylinder 10 when the operation command value I1 is output.

The determining unit 26Ba of the deriving unit 26B determines whether the boom cylinder 10 in the stopped state has started operating (has been activated) in a state where the operation command value I1 is output to the intervention valve 27C.

The determining unit 26Ba compares the cylinder stroke of the boom cylinder 10 at a time point t1*b* and the cylinder stroke of the boom cylinder 10 at a time point t2*b*. The time point t1*b* is a time point occurring after a first predetermined time interval has elapsed from the time point t2*a*, for example. The time point t2*b* is a time point occurring after a third predetermined time interval has elapsed from the time point t2*a*, for example (a time point occurring after a second predetermined time interval has elapsed from the time point t1*b*).

The determining unit 26Ba derives a difference between the detection value of the cylinder stroke at the time point t1*b* and the detection value of the cylinder stroke at the time point t2*b*. When determining that the derived difference value is smaller than a predetermined threshold, the determining unit 26Ba determines that the boom cylinder 10 has not started operating. When determining that the derived difference value is equal to or more than the predetermined threshold, the determining unit 26Ba determines that the boom cylinder 10 has started operating.

When the operation command value I1 is output and the determining unit 26Ba determines that the boom cylinder 10 has started operating, the operation command value I1 serves as an operation start operation command value (operation start operation current value) when the boom cylinder 10 in the stopped state starts operating.

Subsequently, the same process is performed and the operation start operation command value is derived. That is, after the operation command value I1 is increased to the operation command value I2, the determining unit 26Ba compares the cylinder stroke of the boom cylinder 10 at a time point t1*c* and the cylinder stroke of the boom cylinder 10 at a time point t2*c*. The time point t1*c* is a time point occurring after a first predetermined time interval has elapsed from the time point t2*b*, for example. The time point t2*c* is a time point occurring after a third predetermined time interval has elapsed from the time point t2*b*, for example, (a time point occurring after a second predetermined time interval has elapsed from the time point t1*c*). In the present embodiment, the amount of increase in the current from the operation command value I0 to the operation command value I1 is the same as the amount of increase in the current from the operation command value I1 to the operation command value I2.

The determining unit 26Ba derives a difference between the detection value of the cylinder stroke at the time point t1*c* and the detection value of the cylinder stroke at the time point t2*c*. When determining that the derived difference value is smaller than a predetermined threshold, the determining unit 26Ba determines that the boom cylinder 10 has not started operating. When determining that the derived difference value is equal to or more than the predetermined threshold, the determining unit 26Ba determines that the boom cylinder 10 has started operating.

In the present embodiment, the operation start operation command value is assumed to be the operation command value I2. In this way, the operation start operation command value is derived (step SC5).

After the operation start operation command value is derived, the control valve control unit 26C further increases the operation command value output to the intervention valve 27C. The control valve control unit 26C increases the operation command value I2 to an operation command value I3 at the time point t2*c* without decreasing the operation command value I2 and outputs the operation command value I3 to the intervention valve 27C (step SC6). The operation command value I3 is larger than the operation start operation command value I2. The control valve control unit 26C continuously outputs the operation command value I3 to the intervention valve 27C from the time point t2*c* to a time point t0*d*. The time interval from the time point t2*c* to the time point t0*d* is the third predetermined time interval, for example.

In a state where the operation command value I3 is output, the cylinder stroke of the boom cylinder 10 is detected by the cylinder stroke sensor 16. The detection result of the cylinder stroke is input to the work machine controller 26 via the sensor controller 30. The data acquisition unit 26A of the work machine controller 26 acquires the cylinder stroke L1. The calculation unit 26Bb acquires the operation command value I3 and the data on the cylinder speed of the boom cylinder 10 when the operation command value I3 is output (step SC7).

The operation command value I3 is larger than the operation start operation command value I2. In a state where the operation command value I3 is output, the boom cylinder 10 operates continuously (extends continuously).

The deriving unit 26B has the calculation unit 26Bb that derives the operation characteristics indicating the relation between the operation command value I3 and the cylinder speed of the boom cylinder 10 in a state where the operation command value I3 is output to the intervention valve 27C. The calculation unit 26Bb derives the relation between the operation command value I3 and the cylinder stroke of the boom cylinder 10 in a state where the operation command value I3 is output to the intervention valve 27C.

The calculation unit 26Bb calculates an average value of the cylinder stroke from a time point t1*d* to the time point t0*d*. The time point t1*d* is a time point occurring after a first predetermined time interval has elapsed from the time point t2*c*. The time interval from the time point t1*d* to the time point t0*d* is a second predetermined time interval. In the present invention, the cylinder stroke when the operation command value I3 is output is assumed to be the average value of the cylinder strokes from the time point t1*d* to the time point t0*d*.

After the cylinder stroke when the operation command value I3 is input is derived, the control valve control unit 26C further increases the operation command value output to the intervention valve 27C. The control valve control unit 26C increases the operation command value I3 to an operation command value I4 at the time point t0*d* without decreasing the operation command value I3 and outputs the operation command value I4 to the intervention valve 27C (step SC6). The operation command value I4 is larger than the operation command value I3. The control valve control unit 260 continuously outputs the operation command value I4 to the intervention valve 27C from the time point t0*d* to a time point t2*d*. The time interval from the time point t0*d* to the time point t2*d* is a third predetermined time interval, for example.

In a state where the operation command value I4 is output, the cylinder stroke of the boom cylinder 10 is detected by the cylinder stroke sensor 16. The detection result of the cylinder stroke sensor 16 is output to the work machine controller 26 via the sensor controller 30. The data acquisition unit 26A of the work machine controller 26 acquires the operation command value I4 and the data on the cylinder stroke of the boom cylinder 10 when the operation command value I4 is output (step SC7).

In a state where the operation command value I4 is output, the boom cylinder 10 operates continuously (extends continuously).

The calculation unit 26Bb derives the relation between the operation command value I4 and the cylinder stroke of the boom cylinder 10 in a state where the operation command value I4 is output to the intervention valve 27C. In the present invention, the cylinder stroke when the operation command value I4 is output is assumed to be the average value of the cylinder strokes from a time point t1*e* to the time point t2*d*. The time point t1*e* is a time point occurring after a first predetermined time interval has elapsed from the time point t0*d*. The time interval from the time point t1*e* to the time point t2*d* is a second predetermined time interval.

Subsequently, the same process is performed under an operation command value I5 larger than the operation command value I4, an operation command value I6 larger than the operation command value I5, and an operation command value I7 larger than the operation command value I6.

The operation command value I5 is output from the time point t2*d* to the time point t2*e*. The cylinder stroke when the operation command value I5 is output is the average value of the cylinder strokes from a time point t1*f* to the time point t2*e*. The time point t1*f* is a time point occurring after a first predetermined time interval has elapsed from the time point t2*d*. The time point t2*e* is a time point occurring after a third predetermined time interval from the time point t2*d* (a time interval occurring after a second predetermined time interval from the time point t1*f*). The calculation unit 26Bb derives the relation between the operation command value I5 and the cylinder stroke of the boom cylinder 10.

The operation command value I6 is output from the time point t2*e* to a time point t2*f*. The cylinder speed when the operation command value I6 is output is the average value of the cylinder strokes from a time point t1*g* to the time point t2*f*. The time point t1*g* is a time point occurring after a first predetermined time interval has elapsed from the time point t2*e*. The time point t2*f* is a time point occurring after a third predetermined time interval has elapsed from the time point t2*e* (a time point occurring after a second predetermined time interval has elapsed from the time point t1*g*). The calculation unit 26Bb derives the relation between the operation command value I6 and the cylinder speed of the boom cylinder 10.

The operation command value I7 is output from the time point t2*f* to a time point t2*g*. The cylinder stroke when the operation command value I7 is output is the average value of the detection values output from the cylinder stroke sensor 16 from a time point t1*h* to the time point t2*g*. The time point t1*h* is a time point occurring after a first predetermined time interval has elapsed from the time point t2*f*. The time point t2*g* is a time point occurring after a third predetermined time interval has elapsed from the time point t2*f* (a time point occurring after a second predetermined time interval has elapsed from the time point t1*h*). The calculation unit 26Bb derives the relation between the operation command value I7 and the cylinder speed of the boom cylinder 10.

In a state where the operation command values (I3, I4, I5, I6, and I7) are output, the boom cylinder 10 operates at a slow speed. That is, in the state where the operation command values (I3, I4, I5, I6, and I7) are output, the cylinder speed of the boom cylinder 10 is a slow speed (low speed).

The deriving unit 26B derives the slow-speed operation characteristics indicating the relation between the operation command value (I3, I4, I5, I6, and I7) and the cylinder speed in the slow-speed area based on the plurality of operation command values (I3, I4, I5, I6, and I7) and the plurality of cylinder strokes of the boom cylinder 10 when the operation command values (I3, I4, I5, I6, and I7) are output, acquired in step SC7 (step SC8).

As described above, in the present embodiment, steps SC1 to SC8 serve as the first sequence of the calibration process. In the first sequence, the operation start operation command value and the slow-speed operation characteristics are derived.

In the first sequence, when the progress rate is 0%, a display content illustrated in FIG. 31 is displayed on the display unit 322. In the first sequence, when the progress rate is 1% or more and 99% or less, the display content illustrated in FIG. 32 is displayed on the display unit 322. In the first sequence, when the progress rate is 100%, a display content illustrated in FIG. 33 is displayed on the display unit 322.

After the progress rate of the first sequence reaches 100% and the slow-speed operation characteristics are derived, the operator operates the "NEXT" switch illustrated in FIG. 33 in order to start the process for deriving the normal-speed operation characteristics. As described above, in the present embodiment, the process for deriving the normal-speed operation characteristics includes the second, third, and fourth sequences of the calibration process. After the first sequence ends, the second sequence starts.

When the second to fourth sequences start, the calibration conditions of the excavator 100 including the attitude of the work machine 2 are determined (step SC9). The control valve control unit 26C opens the plurality of control valves 27 so that the work machine 2 can be driven by the operation of the operating device 25.

In this manner, in the present embodiment, the control valve control unit 26C controls the plurality of control valves 27 to open the plurality of pilot oil passages 450 during the determination of calibration conditions (step SC9) until the data for deriving the normal-speed operation characteristics (second operation characteristics) is acquired (step SC11) after the data for deriving the slow-speed operation characteristics (first operation characteristics) is acquired (step SC7) and the slow-speed operation characteristics are derived (step SC8).

As described with reference to FIG. 30, the attitude adjustment request information of requesting adjustment of the attitude of the work machine 2 is displayed on the display unit 322 of the man machine interface 32. In the present embodiment, a display content illustrated in FIG. 30 is displayed according to the operation of the "NEXT" switch of FIG. 33. The operator operates the operating device 25 according to the display on the display unit 322 to adjust the attitude of the work machine 2 to the attitude (initial attitude) displayed by the attitude adjustment request information. The operator operates the operating device 25 to adjust the attitude of the work machine 2 while viewing the display unit 322 so that the arm 7 is disposed along the guidance 2G.

During the adjustment of the attitude of the work machine 2, all the pressure-reducing valves of the plurality of control valves 27 enter into the open state. Therefore, the operator can drive the work machine 2 by operating the operating device 25. With the operation of the operating device 25, the work machine 2 is driven so as to be in the initial attitude.

After the attitude of the work machine 2 is adjusted to the initial attitude, the process for deriving the normal-speed operation characteristics starts. When the "NEXT" switch of FIG. 30 is operated by the operator, the display content illustrated in FIG. 31 is displayed on the display unit 322. The operator operates the "START" switch illustrated in FIG. 31. In this way, a command signal for starting the process for deriving the normal-speed operation characteristics is generated. After acquiring the command signal from the input unit 321, the control valve control unit 26C closes all of the plurality of control valves 27 (step SC10). Here, "lever full" displayed in FIG. 31 means a state where the operating device 25 is tilted to its full tilt angle. Moreover, "engine rotation Hi" means a state where the throttle of an engine is set to its largest number of rotations.

The control valve control unit 26C outputs an operation command to the intervention valve 27C in a state where the control valves 27 (the control valves 27 other than the intervention valve 27C) which are not calibration subjects are closed (step SC11).

The control valve control unit 26C outputs an operation command value Ia sufficiently larger than the operation command value I7. In this way, the intervention valve 27C opens sufficiently and the boom 6 in the initial attitude is raised greatly.

The data acquisition unit 26A acquires the cylinder stroke L1. The calculation unit 26Bb acquires data on the operation command value Ia and the cylinder speed of the boom cylinder 10 when the operation command value Ia is output (step SC12).

In the present embodiment, the processes of outputting the operation command value Ia after the work machine 2 is adjusted to the initial attitude and acquiring the operation command value Ia and the data on the cylinder stroke when the operation command value Ia is output serve as the second sequence of the calibration process.

In the second sequence, when the progress rate is 0%, an image in which a display content indicating that the boom 6 is raised is added to FIG. 31 is displayed on the display unit 322. In the second sequence, when the progress rate is 1% or more and 99% or less, the display content illustrated in FIG. 32 is displayed on the display unit 322. In the second sequence, when the progress rate is 100%, the display content illustrated in FIG. 33 is displayed on the display unit 322.

After the progress rate of the second sequence reaches 100% and the data on the operation command value Ia and the cylinder stroke is acquired, the third sequence of the calibration process in the process for deriving the normal-speed operation characteristics starts. The operator operates the "NEXT" switch illustrated in FIG. 33 in order to start the third sequence.

With the operation of the "NEXT" switch of FIG. 33, as described with reference to FIG. 30, the attitude adjustment request information of requesting adjustment of the attitude of the work machine 2 is displayed on the display unit 322 of the man machine interface 32. The control valve control unit 26C opens all the pressure-reducing valves of the plurality of control valves 27 so that the work machine 2 can be driven by the operation of the operating device 25. The operator operates the operating device 25 according to the display on the display unit 322 to adjust the attitude of the work machine 2 to the initial attitude. In this way, the attitude of the work machine 2 is adjusted to the initial attitude (step S9).

After the attitude of the work machine 2 is adjusted to the initial attitude, the process for deriving the normal-speed operation characteristics starts. When the "NEXT" switch illustrated in FIG. 30 is operated by the operator, the display content illustrated in FIG. 31 is displayed on the display unit 322. The operator operates the "START" switch illustrated in FIG. 31. In this way, a command signal for starting the process for deriving the normal-speed operation characteristics is generated. After acquiring the command signal from the input unit 321 of the man machine interface 32, the control valve control unit 260 closes all of the plurality of control valves 27 (step SC10).

The control valve control unit 26C outputs the operation command to the intervention valve 27C in a state where the control valves 27 (the control valves 27 other than the intervention valve 27C) which are not calibration subjects are closed (step SC11).

The control valve control unit 26C outputs an operation command value Ib larger than the operation command value Ia. In this way, the intervention valve 27C opens sufficiently and the boom 6 in the initial attitude is raised greatly.

The data acquisition unit 26A acquires the cylinder stroke L1. The calculation unit 26Bb acquires the operation command value Ib and the data on the cylinder speed of the boom cylinder 10 when the operation command value Ib is output (step SC12).

In the present embodiment, the processes of outputting the operation command value Ib after the work machine 2 is adjusted to the initial attitude and acquiring the operation command value Ib and the data on the cylinder stroke when the operation command value Ib is output serve as the third sequence of the calibration process.

In the third sequence, when the progress rate is 0%, an image in which a display content indicating that the boom 6 is raised is added to FIG. 31 is displayed on the display unit 322. In the third sequence, when the progress rate is 1% or more and 99% or less, the display content illustrated in FIG. 32 is displayed on the display unit 322. In the third sequence, when the progress rate is 100%, the display content illustrated in FIG. 33 is displayed on the display unit 322.

After the progress rate of the third sequence reaches 100% and the data on the operation command value Ib and the cylinder stroke is acquired, the fourth sequence of the calibration process in the process for deriving the normal-speed operation characteristics starts. The operator operates the "NEXT" switch illustrated in FIG. 33 in order to start the fourth sequence.

With the operation of the "NEXT" switch of FIG. 33, as described with reference to FIG. 30, the attitude adjustment request information of requesting adjustment of the attitude of the work machine 2 is displayed on the display unit 322 of the man machine interface 32. The control valve control unit 26C opens all the control valves 27 so that the work machine 2 can be driven by the operation of the operating device 25. The operator operates the operating device 25 according to the display content on the display unit 322 to adjust the attitude of the work machine 2 to the initial state (initial attitude). In this way, the attitude of the work machine 2 is adjusted to the initial attitude (step SC9).

After the attitude of the work machine 2 is adjusted to the initial attitude, the process for deriving the normal-speed operation characteristics starts. When the "NEXT" switch illustrated in FIG. 30 is operated by the operator, the display content illustrated in FIG. 31 is displayed on the display unit 322. The operator operates the "START" switch illustrated in FIG. 31 in order to start the process for deriving the normal-speed operation characteristics. In this way, a command signal for starting the process for deriving the normal-speed operation characteristics is generated. After acquiring the command signal from the input unit 321, the control valve control unit 26C closes all the control valves 27 (step SC10).

The control valve control unit 26C outputs the operation command to the intervention valve 27C in a state where the control valves 27 (the control valves 27 other than the intervention valve 27C) which are not calibration subjects are closed (step SC11).

The control valve control unit 26C outputs an operation command value Ic larger than the operation command value Ib. In this way, the intervention valve 27C opens sufficiently and the boom 6 in the initial attitude is raised greatly.

The data acquisition unit 26A acquires the cylinder stroke L1. The calculation unit 26Bb acquires the operation command value Ic and the data on the cylinder speed of the boom cylinder 10 when the operation command value Ic is output (step SC12).

In the present embodiment, the processes of outputting the operation command value Ic after the work machine 2 is adjusted to the initial attitude and acquiring the operation command value Ic and the data on the cylinder speed when the operation command value Ic is output serve as the fourth sequence of the calibration process.

In the fourth sequence, when the progress rate is 0%, an image in which a display content indicating that the boom 6 is raised is added to FIG. 31 is displayed on the display unit 322. In the fourth sequence, when the progress rate is 1% or more and 99% or less, the display content illustrated in FIG. 32 is displayed on the display unit 322. In the fourth sequence, when the progress rate is 100%, the display content illustrated in FIG. 33 is displayed on the display unit 322. Although not illustrated in FIG. 33, actually, the PPC pressure and a numerical value at each command value Ic of the spool stroke are described based on the measurement results of the first to fourth sequences.

The deriving unit 26B derives the normal-speed operation characteristics indicating the relation between the operation command values (Ia, Ib, and Ic) and the cylinder strokes in the normal-speed area based on the relation between the operation command value Ia and the cylinder speed acquired in the second sequence of the calibration process, the relation between the operation command value Ib and the cylinder speed acquired in the third sequence of the calibration process, and the relation between the operation command value Ic and the cylinder speed acquired in the fourth sequence of the calibration process (step SC13).

The normal-speed area is a speed area higher than the slow-speed area. The slow-speed area may be referred to as a low-speed area and the normal-speed area may be referred to as a high-speed area. The slow-speed area is a speed area where the cylinder speed is lower than a predetermined speed, for example. The normal-speed area is a speed area where the cylinder speed is equal to or higher than the predetermined speed, for example.

FIG. 35 illustrates an example of the display unit 322 after the operation start operation command value, the slow-speed operation characteristics, and the normal-speed operation characteristics are derived by the deriving unit 26B. After the operation start operation command value, the slow-speed operation characteristics, and the normal-speed operation characteristics are derived, a switch 321P illustrated in FIG. 35 is displayed. With the operation of the switch 321P, the operation start operation command value, the slow-speed operation characteristics, and the normal-speed operation characteristics derived by the deriving unit 26B are decided. In the following description, the switch 321P will be appropriately referred to as a final decision switch 321P.

The operation start operation command value, the slow-speed operation characteristics, and the normal-speed operation characteristics derived by the deriving unit 26B are stored in the storage unit 26G (step SC14). In the present embodiment, when the switch 321P illustrated in FIG. 35 is operated, the operation start operation command value, the slow-speed operation characteristics, and the normal-speed operation characteristics are stored in the storage unit 26G.

When characteristics are stored in advance, the operation start operation command value, the slow-speed operation characteristics, and the normal-speed operation characteristics that are newly derived by the updating unit 26F are read from the storage unit 26G, and respective correlation data of the deriving unit 26B is updated.

In the present embodiment, in the acquisition of the data on the operation command value and the cylinder speed (steps SC4, SC7, and SC12), the data acquisition unit 26A acquires data on the spool stroke input from the spool stroke sensor 65 of the direction control valve 640 and the data on the pilot pressure input from the boom pressure sensor 670B as well as the data on the operation command value (current value) output from the control valve control unit 26C and the data on the cylinder speed input from the cylinder speed sensor.

The cylinder speed, the spool stroke, the pilot pressure, and the operation command value are correlated with one another. When the operation command value changes, each of the pilot pressure, the spool stroke, and the cylinder speed changes.

The deriving unit 26B derives first correlation data indicating the relation between the cylinder speed of the boom cylinder 10 and the spool stroke of the direction control valve 640, second correlation data indicating the relation between the spool stroke of the direction control valve 640 and the pilot pressure adjusted by the intervention valve 27C, and third correlation data indicating the relation between the pilot pressure adjusted by the intervention valve 27C and the operation command value (current value) output to the intervention valve 27C based on the data acquired by the data acquisition unit 26A and stores the same in the storage unit 26G.

Note that although in the present embodiment the operation command value is the current value output to the control valve 27, the operation command value is a concept that includes the pilot pressure value (pressure value of the pilot oil) adjusted by the control valve 27 and the spool stroke value (movement amount value of the spool 80). For example, the data on the pilot pressure value and the cylinder speed may be acquired by the data acquisition unit 26A, and based on the acquired data, the deriving unit 26B may derive the operation start pilot pressure value when the hydraulic cylinder 60 in the stopped state starts operating and the operation characteristics (including the slow-speed operation characteristics and the normal-speed operation characteristics) indicating the relation between the pilot pressure value and the cylinder speed. For example, the data on the spool stroke value and the cylinder speed may be acquired by the data acquisition unit 26A, and based on the acquired data, the deriving unit 26B may derive the operation start spool stroke value when the hydraulic cylinder 60 in the stopped state starts operating and the operation characteristics (including the slow-speed operation characteristics and the normal-speed operation characteristics) indicating the relation between the spool stroke value and the cylinder speed. The same is true for the following embodiment.

Figure 36:
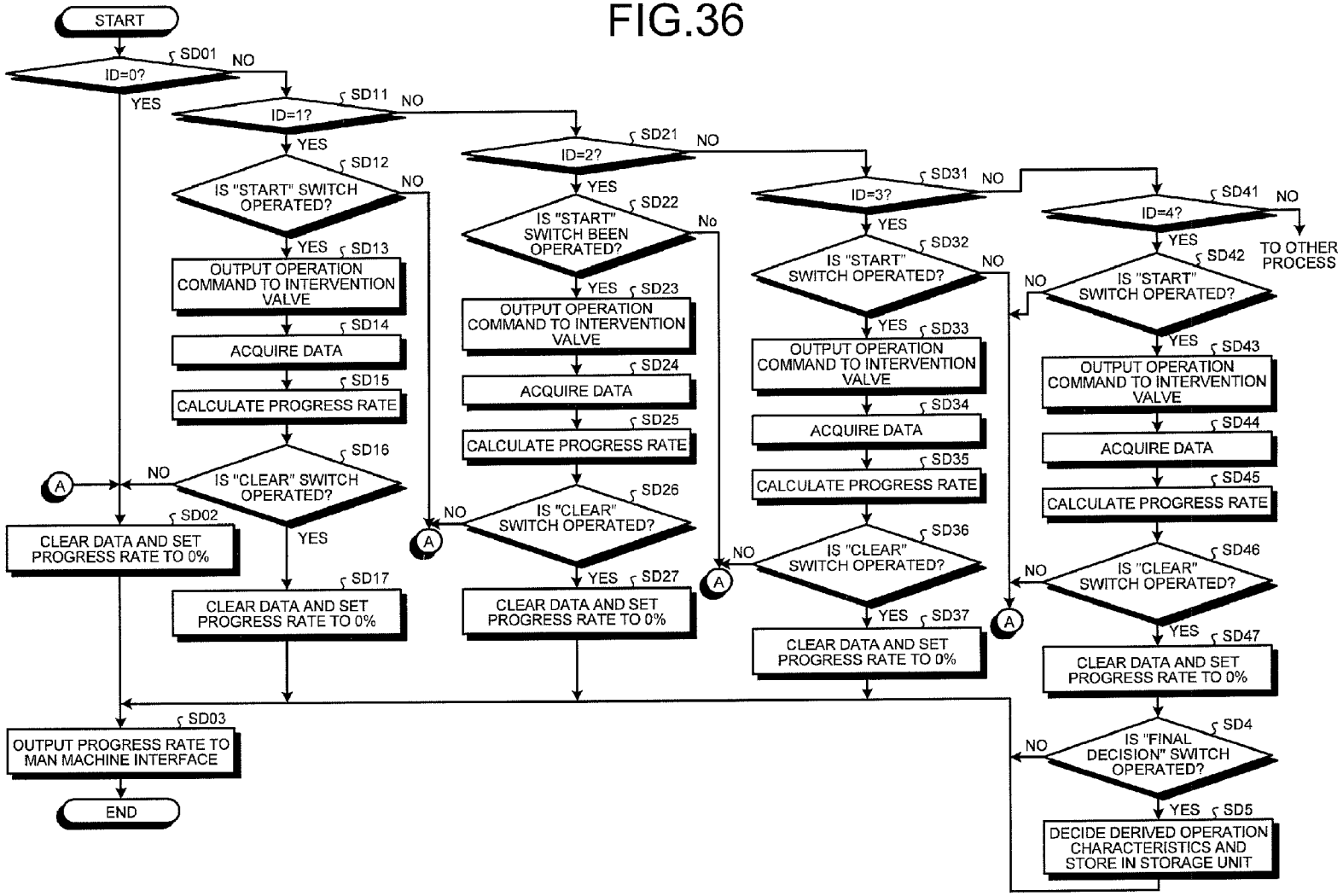
FIG. 36 is a flowchart for describing an example of a calibration process.

FIG. 36 is a flowchart illustrating more specifically the process of the work machine controller 26 for deriving the operation start operation command value, the slow-speed operation characteristics, and the normal-speed operation characteristics. In the present embodiment, the man machine interface 32 outputs an identification signal (ID) corresponding to the display content (screen) on the display unit 322 to the work machine controller 26. When the display content for executing the first sequence is displayed on the display unit 322, "1" is output from the man machine interface 32 to the work machine controller 26 as the ID. When the display content for executing the second sequence is displayed on the display unit 322, "2" is input as the ID. When the display content for executing the third sequence is displayed on the display unit 322, "3" is input as the ID. When the display content for executing the fourth sequence is displayed on the display unit 322, "4" is output as the ID.

The work machine controller 26 acquires the ID input from the man machine interface 32 and identifies the type of the ID (step SD01).

When it is determined in step SD01 that the acquired ID is "0" (step SD01: Yes), the work machine controller 26 determines that the mode is not the calibration mode, clears (initializes) the data acquired from the cylinder speed sensor and the like and resets the progress rate to 0% (step SD02). Moreover, the work machine controller 26 outputs the progress rate to the man machine interface 32 (step SD03).

When it is determined in step SD01 that the mode is any one of the calibration modes corresponding to IDs other than the acquired ID "0" (step SD01: No), the work machine controller 26 determines whether the acquired ID is "1" (step SD11).

When it is determined in step SD11 that the acquired ID is "1" (step SD11: Yes), the work machine controller 26 determines whether the "START" switch illustrated in FIG. 31 is operated (step SD12). That is, the work machine controller 26 determines whether the input unit 321 (the "START" switch) for starting the first sequence is operated and a command signal for starting the first sequence is input by the "START" switch.

When it is determined in step SD12 that the "START" switch is not operated (step SD12: No), the processes of steps SD02 and SD03 are performed.

When it is determined in step SD12 that the "START" switch is operated (step SD12: Yes), the work machine controller 26 (the control valve control unit 26C) closes the control valves 27 other than the intervention valve 27C and then outputs the operation command to the intervention valve 26C (step SD13). The process of step SD13 corresponds to the process of step SC3 of FIG. 27.

The work machine controller 26 (the data acquisition unit 26A) acquires data including the detection value of the cylinder stroke sensor 16, the detection value of the spool stroke sensor 65 of the direction control valve 640, the detection value of the boom pressure sensor 670B, and the current value output to the intervention valve 26C (step SD14). The process of step SD14 corresponds to step SC4 of FIG. 27.

Moreover, the work machine controller 26 calculates the progress rate of the first sequence (step SD15). The progress rate is calculated by "the number of items of acquired data/a target number of items of acquired data".

Moreover, the work machine controller 26 determines whether the "CLEAR" switch illustrated in FIG. 32 is operated (step SD16). That is, the work machine controller 26 determines whether the input unit 321 ("CLEAR" switch) for interrupting (ending) the first sequence is operated and a command signal for interrupting the first sequence is output by the "CLEAR" switch.

When it is determined in step SD16 that the "CLEAR" switch is not operated (step SD16: No), the processes of steps SD02 and SD03 are performed.

When it is determined in step SD16 that the "CLEAR" switch is operated (step SD16: Yes), the work machine controller 26 clears (initializes) the data acquired from the cylinder speed sensor and the like and resets the progress rate to 0% (step SD17). Moreover, the work machine controller 26 outputs the progress rate to the man machine interface 32 (step SD03).

When it is determined in step SD11 that the acquired ID is not "1" (step SD11: No), the work machine controller 26 determines whether the acquired ID is "2" (step SD21).

When it is determined in step SD21 that the acquired ID is "2" (step SD21: Yes), the work machine controller 26 determines whether the "START" switch illustrated in FIG. 31 is operated (step SD22). That is, the work machine controller 26 determines whether the input unit 321 (the "START" switch) for starting the second sequence is operated and the command signal for starting the second sequence is output by the "START" switch.

When it is determined in step SD22 that the "START" switch is not operated (step SD22: No), the processes of steps SD02 and SD03 are performed.

When it is determined in step SD22 that the "START" switch is operated (step SD22: Yes), the work machine controller 26 (the control valve control unit 26C) closes the control valves 27 other than the intervention valve 27C and then outputs the operation command to the intervention valve 26C (step SD23). The process of step SD23 corresponds to the process of step SC11 of FIG. 27.

The work machine controller 26 (the data acquisition unit 26A) acquires data including the detection value of the cylinder stroke sensor 16, the detection value of the spool stroke sensor 65 of the direction control valve 640, the detection value of the boom pressure sensor 670B, and the current value output to the intervention valve 26C (step SD24). The process of step SD24 corresponds to step SC12 of FIG. 27.

Moreover, the calculation unit 26Bb calculates the progress rate of the second sequence (step SD25). The progress rate is calculated by "the number of items of acquired data/a target number of items of acquired data".

Moreover, the sequence control unit 26H determines whether the "CLEAR" switch illustrated in FIG. 32 is operated (step SD26). That is, the sequence control unit 26H determines whether the input unit 321 ("CLEAR" switch) for interrupting (ending) the second sequence is operated and a command signal for interrupting the second sequence is output by the "CLEAR" switch.

When the sequence control unit 26H determines in step SD26 that the "CLEAR" switch is not operated (step SD26: No), the processes of steps SD02 and SD03 are performed.

When it is determined in step SD26 that the "CLEAR" switch is operated (step SD26: Yes), the sequence control unit 26H clears (initializes) the data acquired from the cylinder speed sensor and the like and resets the progress rate to 0% (step SD27). Moreover, the sequence control unit 26H outputs the progress rate to the man machine interface 32 (step SD03).

When it is determined in step SD21 that the acquired ID is not "2" (step SD21: No), the sequence control unit 26H determines whether the acquired ID is "3" (step SD31).

When it is determined in step SD31 that the acquired ID is "3" (step SD31: Yes), the sequence control unit 26H determines whether the "START" switch illustrated in FIG. 31 is operated (step SD32). That is, the sequence control unit 26H determines whether the input unit 321 (the "START" switch) for starting the third sequence is operated and the command signal for starting the third sequence is input by the "START" switch.

When it is determined in step SD32 that the "START" switch is not operated (step SD32: No), the sequence control unit 26H performs the processes of steps SD02 and SD03.

When the sequence control unit 26H determines in step SD32 that the "START" switch is operated (step SD32: Yes), the work machine controller 26 (the control valve control unit 26C) closes the control valves 27 other than the intervention valve 27C and then outputs the operation command to the intervention valve 26C (step SD33). The process of step SD33 corresponds to the process of step SC11 of FIG. 27.

The work machine controller 26 (the data acquisition unit 26A) acquires data including the detection value of the cylinder speed sensor 16, the detection value of the spool stroke sensor 65 of the direction control valve 640, the detection value of the boom pressure sensor 670B, and the current value output to the intervention valve 26C (step SD34). The process of step SD34 corresponds to step SC12 of FIG. 27.

Moreover, the sequence control unit 26H calculates the progress rate of the third sequence (step SD35). The progress rate is calculated by "the number of items of acquired data/a target number of items of acquired data".

Moreover, the sequence control unit 26H determines whether the "CLEAR" switch illustrated in FIG. 32 is operated (step SD36). That is, the work machine controller 26 determines whether the input unit 321 ("CLEAR" switch) for interrupting (ending) the third sequence is operated and a command signal for interrupting the third sequence is input by the "CLEAR" switch.

When it is determined in step SD36 that the "CLEAR" switch is not operated (step SD36: No), the sequence control unit 26H performs the processes of steps SD02 and SD03.

When it is determined in step SD36 that the "CLEAR" switch is operated (step SD36: Yes), the sequence control unit 26H clears (initializes) the data acquired from the cylinder speed sensor and the like and resets the progress rate to 0% (step SD37). Moreover, the sequence control unit 26H outputs the progress rate to the man machine interface 32 (step SD03).

When it is determined in step SD31 that the acquired ID is not "3" (step SD31: No), the sequence control unit 26H determines whether the acquired ID is "4" (step SD41).

When it is determined in step SD41 that the acquired ID is "4" (step SD41: Yes), the sequence control unit 26H determines whether the "START" switch illustrated in FIG. 31 is operated (step SD42). That is, the work machine controller 26 determines whether the input unit 321 (the "START" switch) for starting the fourth sequence is operated and the command signal for starting the fourth sequence is input by the "START" switch.

When the sequence control unit 26H determines in step SD42 that the "START" switch is not operated (step SD42: No), the processes of steps SD02 and SD03 are performed.

When the sequence control unit 26H determines in step SD42 that the "START" switch is operated (step SD42: Yes), the work machine controller 26 (the control valve control unit 26C) closes the control valves 27 other than the intervention valve 27C and then outputs the operation command to the intervention valve 26C (step SD43). The process of step SD43 corresponds to the process of step SC11 of FIG. 27.

The work machine controller 26 (the data acquisition unit 26A) acquires data including the detection value of the cylinder speed sensor 16, the detection value of the spool stroke sensor 65 of the direction control valve 640, the detection value of the boom pressure sensor 670B, and the current value output to the intervention valve 26C (step SD44). The process of step SD44 corresponds to step SC12 of FIG. 27.

Moreover, the sequence control unit 26H calculates the progress rate of the fourth sequence (step SD45). The progress rate is calculated by "the number of items of acquired data/a target number of items of acquired data".

Moreover, the sequence control unit 26H determines whether the "CLEAR" switch illustrated in FIG. 32 is operated (step SD46). That is, the sequence control unit 26H determines whether the input unit 321 ("CLEAR" switch) for interrupting (ending) the fourth sequence is operated and a command signal for interrupting the fourth sequence is input by the "CLEAR" switch.

When it is determined in step SD46 that the "CLEAR" switch is not operated (step SD46: No), the sequence control unit 26H performs the processes of steps SD02 and SD03.

When it is determined in step SD46 that the "CLEAR" switch is operated (step SD46: Yes), the sequence control unit 26H clears (initializes) the data acquired from the cylinder speed sensor and the like and resets the progress rate to 0% (step SD47). Moreover, the work machine controller 26 outputs the progress rate to the man machine interface 32 (step SD03).

When it is determined in step SD41 that the acquired ID is not "4" (step SD41: No), the sequence control unit 26H executes other processes.

After the first, second, third, and fourth sequences end and the operation start operation command value, the slow-speed operation characteristics, and the normal operation characteristics are derived, the sequence control unit 26H determines whether the final decision switch 321P illustrated in FIG. 35 is operated (step SD04).

When the sequence control unit 26H determines in step SD04 that the final decision switch 321P is not operated in a predetermined time (step SD04: No), the process of step SD03 is performed.

When the sequence control unit 26H determines in step SD04 that the final decision switch 321P is operated (step SD04: Yes), the work machine controller 26 (the updating unit 26F) stores the derived operation start operation command value, slow-speed operation characteristics, and normal operation characteristics in the storage unit 26G.

Figure 37:
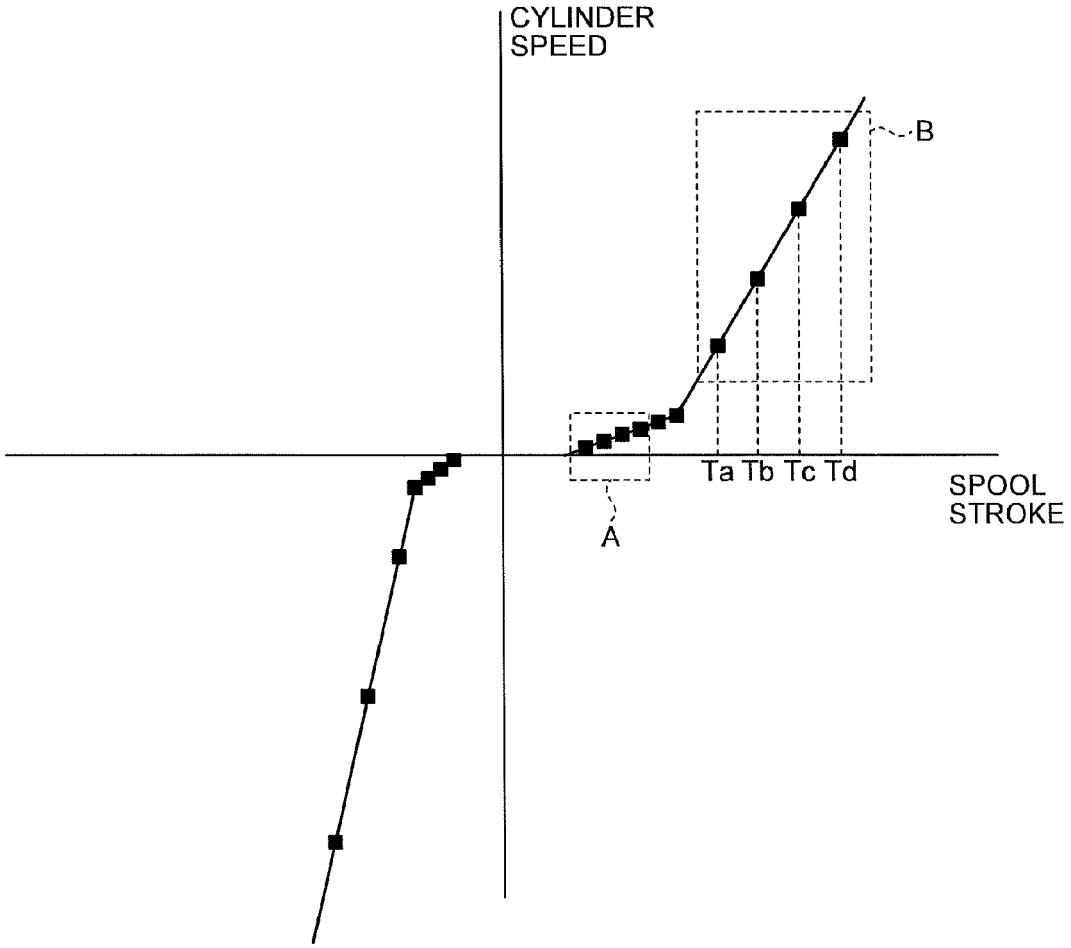
FIG. 37 is a diagram illustrating the relation between a spool stroke and a cylinder speed.
Figure 38:
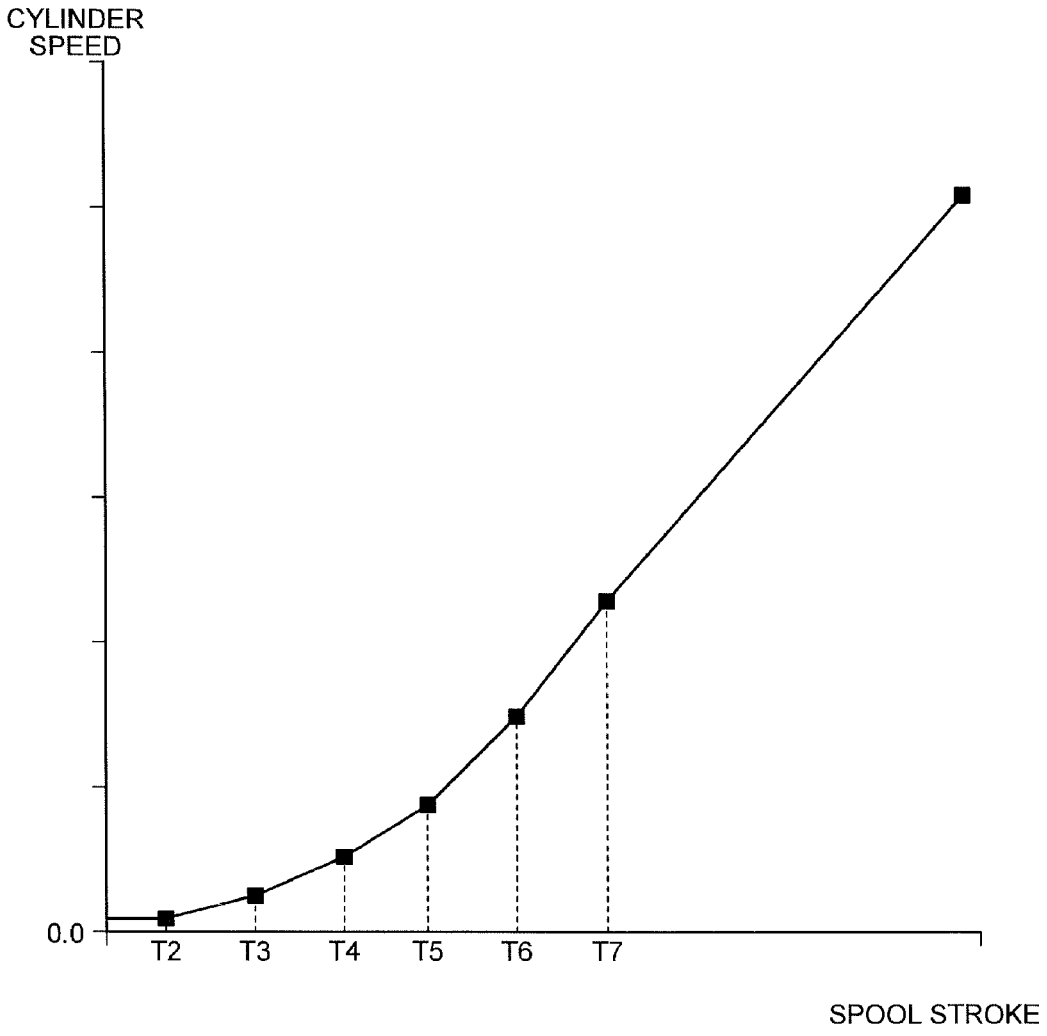
FIG. 38 is an enlarged view of a portion of FIG. 37.

FIG. 37 is a diagram illustrating an example of the first correlation data indicating the relation between the movement amount (spool stroke) of the spool determined by the boom intervention and the cylinder speed. FIG. 38 is an enlarged view of a portion A in FIG. 37. In FIGS. 37 and 38, the horizontal axis represents the spool stroke value as the operation command value, and the vertical axis represents the cylinder speed. A state where the spool stroke value is zero (at the origin) is a state where the spool is present in the initial position.

In FIG. 37, the portion A indicates a slow-speed area where the cylinder speed of the boom cylinder 10 is a slow speed. A portion B indicates a normal-speed area where the cylinder speed of the boom cylinder 10 is a normal speed higher than the slow speed. The normal-speed area indicated by the portion B is a speed area higher than the slow-speed area indicated by the portion A.

As illustrated in FIG. 37, the inclination of the graph in the portion A is smaller than the inclination of the graph in the portion B. That is, the amount of change in the cylinder speed with respect to the spool stroke value (the operation command value) in the normal-speed area is larger than that in the slow-speed area.

In FIG. 38, a spool stroke value T2 is a spool stroke value when the operation command I2 (see FIG. 34 and the like) which is an operation start operation command value is output to the intervention valve 27C. A spool stroke value T3 is a spool stroke value when the operation command I3 is output to the intervention valve 27C. A spool stroke value T4 is a spool stroke value when the operation command I4 is output to the intervention valve 27C. A spool stroke value T5 is a spool stroke value when the operation command I5 is output to the intervention valve 27C. A spool stroke value T6 is a spool stroke value when the operation command I6 is output to the intervention valve 27C. A spool stroke value T7 is a spool stroke value when the operation command I7 is output to the intervention valve 27C.

In FIG. 37, a spool stroke value Ta is a spool stroke value when the operation command Ia is output to the intervention valve 27C. A spool stroke value Tb is a spool stroke value when the current value Ib is output to the intervention valve 27C. A spool stroke value Tc is a spool stroke value when the operation command Ic is output to the intervention valve 27C.

In this manner, the work machine controller 26 can derive the slow-speed operation characteristics indicated by the line L2 in the portion A and the normal-speed operation characteristics indicated by the line L2 in the portion B by the calibration process described above with reference to steps SC1 to SC14.

The cylinder speed changes according to the weight of the bucket 8. For example, even if the same amount of operating oil is supplied to the hydraulic cylinder 60, when the weight of the bucket 8 changes, the cylinder speed changes.

Figure 39:
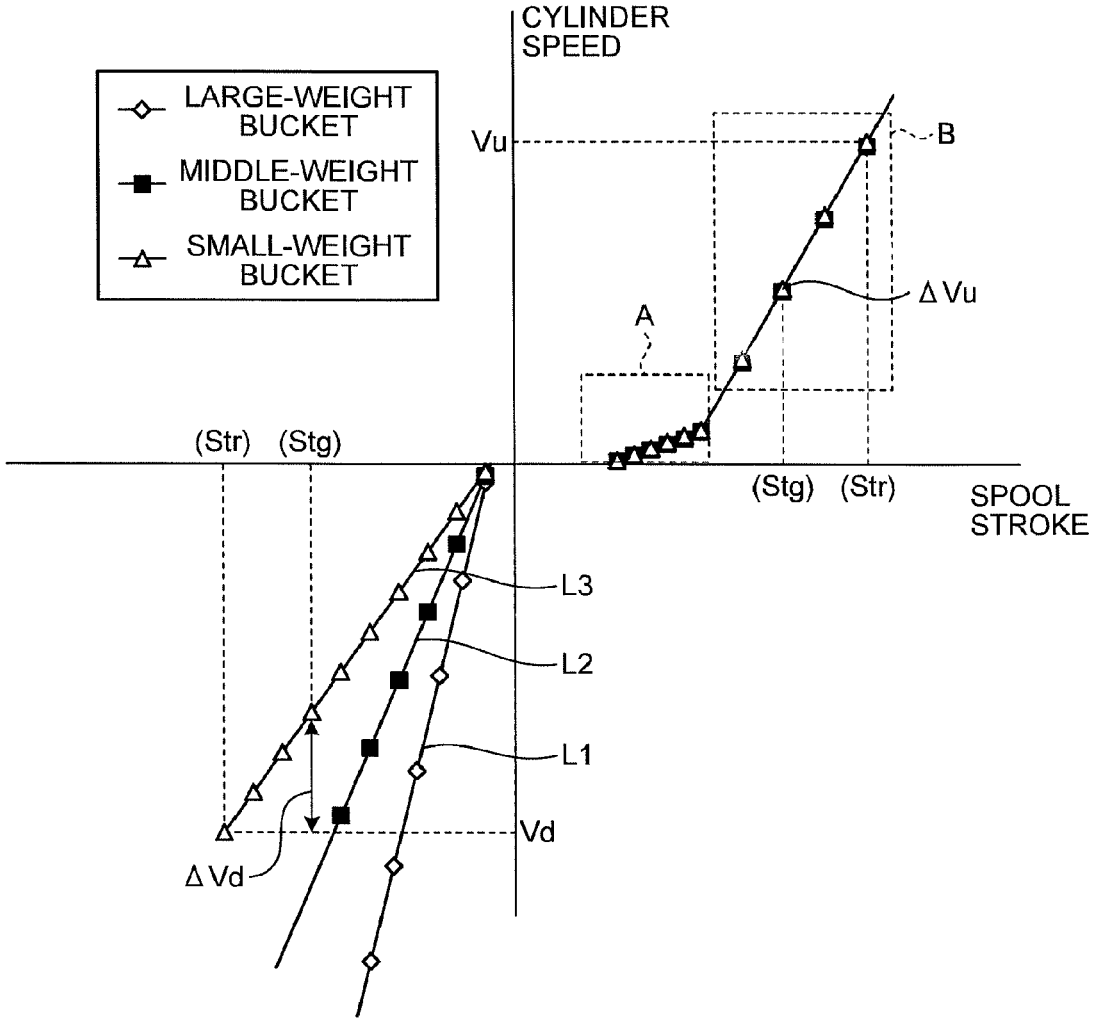
FIG. 39 is a diagram illustrating the relation between a spool stroke and a cylinder speed.
Figure 40:
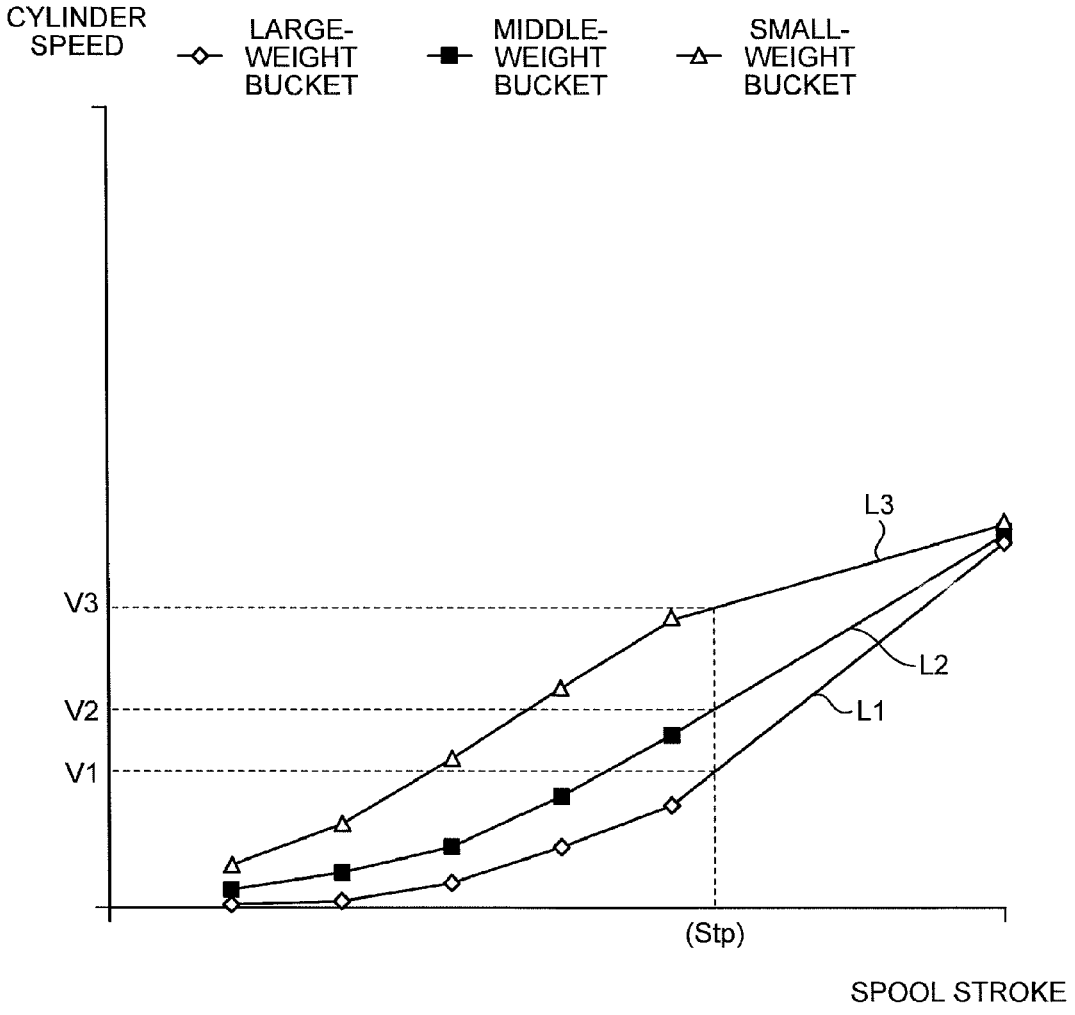
FIG. 40 is an enlarged view of a portion of FIG. 37.

FIG. 39 is a diagram illustrating an example of the first correlation data indicating the relation between the movement amount (spool stroke) of the spool in the boom 6 and the cylinder speed. FIG. 40 is an enlarged view of a portion A in FIG. 39. In FIGS. 39 and 40, the horizontal axis represents the spool stroke, and the vertical axis represents the cylinder speed. A state where the spool stroke is zero (at the origin) is a state where the spool is present in the initial position. A line L1 indicates the first correlation data when the bucket 8 has a large weight. A line L2 indicates the first correlation data when the bucket 8 has a middle weight. A line L3 indicates the first correlation data when the bucket 8 has a small weight.

As illustrated in FIGS. 39 and 40, when the weight of the bucket 8 is different, the first correlation data changes according to the weight of the bucket 8.

The hydraulic cylinder 60 operates so that the raising operation and the lowering operation of the work machine 2 are executed. In FIG. 39, when the spool moves so that the spool stroke becomes positive, the work machine 2 performs the raising operation. When the spool moves so that the spool stroke becomes negative, the work machine 2 performs the lowering operation. As illustrated in FIGS. 39 and 40, the first correlation data includes the relation between the cylinder speed and the spool stroke in each of the raising operation and the lowering operation.

As illustrated in FIG. 39, the amount of change in the cylinder speed is different between the raising operation and the lowering operation of the work machine 2. That is, an amount of change Vu in the cylinder speed when the spool stroke has changed by a predetermined amount Str from the origin so that the raising operation is executed is different from an amount of change Vd in the cylinder speed when the spool stroke has changed by the predetermined amount Str from the origin so that the lowering operation is executed. In the example illustrated in FIG. 39, when the predetermined amount Str is set, the amount of change Vu is the same value for each of the large, middle, and small buckets 8, whereas the amount of change Vd (absolute value) is a different value for each of the large, middle, and small buckets 8.

The hydraulic cylinder 60 is capable of moving the work machine 2 at a high speed by the action of gravity (the weight) of the work machine 2 during the lowering operation of the work machine 2. On the other hand, the hydraulic cylinder 60 needs to operate while resisting against the weight of the work machine 2 during the raising operation of the work machine 2. Therefore, when the spool stroke is the same in the raising operation and the lowering operation, the cylinder speed during the lowering operation is higher than the cylinder speed during the raising operation.

As illustrated in FIG. 39, during the lowering operation of the work machine 2, the larger the gravity of the bucket 8, the higher the cylinder speed. Moreover, a difference ΔVd between the cylinder speed in relation to the middle-weight bucket 8 and the cylinder speed in relation to the small-weight bucket 8 when the spool has moved by a predetermined amount Stg from the origin during the lowering operation is larger than a difference ΔVu between the cylinder speed in relation to the middle-weight bucket 8 and the cylinder speed in relation to the small-weight bucket 8 when the spool has moved by the predetermined amount Stg from the origin during the raising operation. In the example illustrated in FIG. 39, ΔVu is approximately zero. Similarly, a difference between the cylinder speed in relation to the large-weight bucket 8 and the cylinder speed in relation to the middle-weight bucket 8 when the spool has moved by the predetermined amount Stg from the origin during the lowering operation is larger than a difference between the cylinder speed in relation to the large-weight bucket 8 and the cylinder speed in relation to the middle-weight bucket 8 when the spool has moved by the predetermined amount Stg from the origin during the raising operation.

A load acting on the hydraulic cylinder 60 is different between the raising operation and the lowering operation of the work machine 2. The cylinder speed during the lowering operation of the work machine 2, in particular of the boom 6, changes greatly according to the weight of the bucket 8. The larger the weight of the bucket 8, the higher the cylinder speed during the lowering operation. Thus, a speed profile of the cylinder speed during the lowering operation of the boom 6 (the work machine 2) changes greatly according to the weight of the bucket 8.

As illustrated in FIG. 40, when the hydraulic cylinder 60 is operated so that the raising operation of the work machine 2 is executed in an initial state where the cylinder speed of the hydraulic cylinder 60 is zero, an amount of change V1 in the cylinder speed from the initial state in relation to the large-weight bucket 8 is different from an amount of change V2 in the cylinder speed from the initial state in relation to the middle-weight bucket 8. That is, when the hydraulic cylinder 60 is operated so that the raising operation of the work machine 2 is executed from the initial state where the cylinder speed is zero, the amount of change (the amount of change from the zero-speed state) V1 in the cylinder speed in relation to the large-weight bucket 8 when the spool stroke has changed by a predetermined amount Stp from the origin is different from the amount of change (the amount of change from the zero-speed state) V2 in the cylinder speed in relation to the middle-weight bucket 8 when the spool stroke has changed by the predetermined amount Stp from the origin. Similarly, when the hydraulic cylinder 60 is operated so that the raising operation of the work machine 2 is executed from the initial state where the cylinder speed of the hydraulic cylinder 60 is zero, the amount of change V2 in the cylinder speed from the initial state in relation to the middle-weight bucket 8 is different from an amount of change V3 in the cylinder speed from the initial state in relation to the small-weight bucket 8.

When the intervention control is executed, the boom cylinder 10 executes the raising operation of the boom 6 as described above. Thus, the boom cylinder 10 is controlled based on such first correlation data as illustrated in FIG. 40, whereby the bucket 8 can be moved with high accuracy based on the designed landform Ua even when the weight of the bucket 8 changes. That is, the hydraulic cylinder 60 is finely controlled even when the weight of the bucket 8 is changed during the activation of the hydraulic cylinder 60, whereby highly accurate limited excavation control is executed.

As described above, in the present embodiment, the operation start operation command value, the slow-speed operation characteristics, and the normal-speed operation characteristics are derived for the intervention valve 27C. On the other hand, although the operation start operation command value is derived for the pressure-reducing valve 27A (270A, 271A, and 272A) and the pressure-reducing valve 27B (270B, 271AB, and 272B), the slow-speed operation characteristics are not derived for these pressure-reducing valves. Note that the normal-speed operation characteristics are derived for the pressure-reducing valves 27A and 27B.

[Calibration of Pressure-Reducing Valve]

Figure 41:
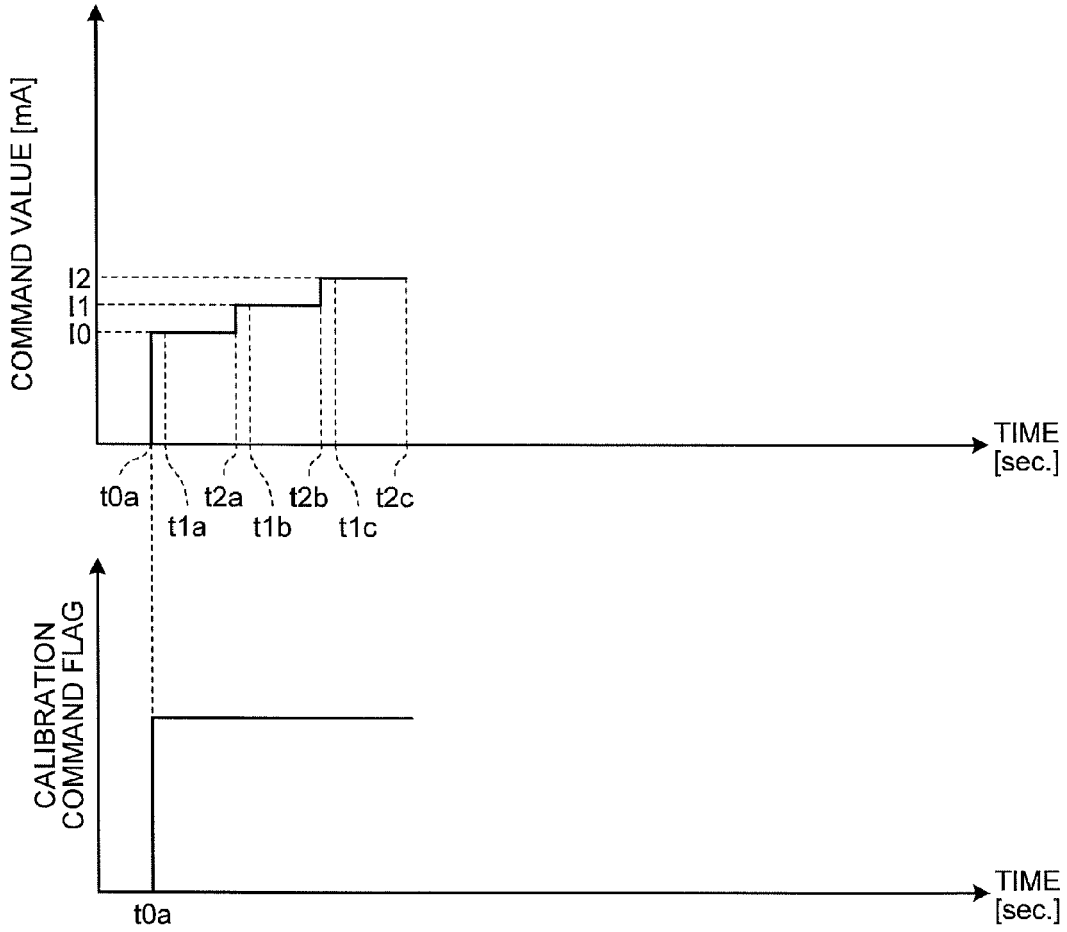
FIG. 41 is a timing chart for describing an example of a calibration process.

FIG. 41 is a timing chart for describing a procedure of deriving the operation start operation command value for the pressure-reducing valves 27A and 27B. In FIG. 41, the horizontal axis of the lower graph represents time, and the vertical axis represents a command signal output from the input unit 321 to the control valve control unit 26C with the operation of the input unit 321. In FIG. 41, the horizontal axis of the upper graph represents time, and the vertical axis represents an operation command value (current value) output (supplied) to the pressure-reducing valves 27A and 27B.

Hereinafter, as an example, an operation command (current) is output (supplied) to the arm pressure-reducing valve 271A disposed in the arm operating oil passage 4511A through which the pilot oil flows so that the arm cylinder 11 operates in the retracting direction (the arm 7 performs the raising operation), among the pressure-reducing valves 27A and 27B. The operation command (current) is not output to the control valves 27 other than the arm pressure-reducing valve 271A. Moreover, at a time point t0*a*, the arm cylinder 11 has not started operating. The boom cylinder 10 and the bucket cylinder 12 have not moved.

As illustrated in FIG. 41, at the time point t0*a*, the input unit 321 is operated and a command signal is output from the input unit 321 to the control valve control unit 26C. At the time point t0*a*, the control valve control unit 26C closes all of the plurality of control valves 27 and then outputs (supplies) an operation command (current) to the arm pressure-reducing valve 271A. The operation command (current) is not output to the control valves 27 other than the arm pressure-reducing valve 271A. Moreover, at the time point t0*a*, the arm cylinder 11 has not started operating. The boom cylinder 10 and the bucket cylinder 12 have not moved.

In the present embodiment, the second operating lever 25L of the pilot hydraulic-type operating device 25 is operated to a full-lever state so that the pilot pressure of the arm operating oil passage 4511A increases when the arm pressure-reducing valve 271A to which the current is supplied opens. For example, when the second operating lever 25L is operated so as to be tilted in the backward direction whereby the arm 7 performs the raising operation (when the pilot pressure of the arm operating oil passage 4511A increases), the second operating lever 25L is operated so as to be in the full-lever state in relation to the backward direction.

First, the control valve control unit 26C outputs an operation command of an operation command value I0 to the arm pressure-reducing valve 271A. The control valve control unit 26C continuously outputs the operation command value I0 to the arm pressure-reducing valve 271A from the time point t0*a* to a time point t2*a*. The time interval from the time point t0*a* to the time point t2*a* is a third predetermined time interval, for example.

In a state where the operation command value I0 is output, the cylinder stroke of the arm cylinder 11 is output from the sensor controller 30 to the work machine controller 26 based on the detection value of the cylinder stroke sensor 17. The data acquisition unit 26A of the work machine controller 26 acquires the operation command value I0 and the cylinder stroke L2 in relation to the cylinder of the arm cylinder 11 when the operation command value I0 is output.

The deriving unit 26B determines whether the arm cylinder 11 in the stopped state has started operating (has been activated) in a state where the operation command value I0 is output to the arm pressure-reducing valve 271A. The determining unit 26Ba of the deriving unit 26B determines whether the arm cylinder 11 in the stopped state has started operating based on the data on the cylinder speed of the arm cylinder 11.

The determining unit 26Ba compares the cylinder speed of the arm cylinder 11 at a time point t1*a* and the cylinder speed of the arm cylinder 11 at a time point t2*a*. The time point t1*a* is a time point occurring after a first predetermined time interval has elapsed from the time point t0*a*, for example. The time point t2*a* is a time point occurring after a third predetermined time interval has elapsed from the time point t0*a*, for example, (a time point occurring after a second predetermined time interval has elapsed from the time point t1*a*).

The determining unit 26Ba derives a difference in the cylinder stroke based on the detection value of the cylinder stroke sensor 17 at the time point t1*a* and the detection value of the cylinder stroke sensor 17 at the time point t2*a*. When determining that the derived difference value is smaller than a predetermined threshold, the determining unit 26Ba determines that the arm cylinder 11 has not started operating. When determining that the derived difference value is equal to or more than the predetermined threshold, the determining unit 26Ba determines that the arm cylinder 11 has started operating.

When the operation command value I0 is output and the determining unit 26Ba determines that the arm cylinder 11 has started operating, the operation command value I0 serves as an operation start operation command value (operation start operation current value) when the arm cylinder 11 in the stopped state starts operating.

When it is determined that the arm cylinder 11 has not started operating under the operation command value I0, the control valve control unit 26C increases the operation command value output to the arm pressure-reducing valve 271A. The control valve control unit 26C increases the operation command value I0 to an operation command value I1 at the time point t2*a* without decreasing the operation command value I0 and outputs the operation command value I1 to the arm pressure-reducing valve 271A. The control valve control unit 26C continuously outputs the operation command value I1 to the arm pressure-reducing valve 271A from the time point t2*a* to the time point t2*b*. The time interval from the time point t2*a* and the time point t2*b* is a third predetermined time interval, for example.

In a state where the operation command value I1 is output, the cylinder stroke of the arm cylinder 11 is output from the sensor controller 30 to the work machine controller 26 based on the detection value of the cylinder stroke sensor 17. The data acquisition unit 26A of the work machine controller 26 acquires the operation command value I1 and the cylinder stroke L2 in relation to the cylinder speed of the arm cylinder 11 when the operation command value I1 is output.

The determining unit 26Ba of the deriving unit 26B determines whether the arm cylinder 11 in the stopped state has started operating (has been activated) in a state where the operation command value I1 is output to the arm pressure-reducing valve 271A.

The determining unit 26Ba compares the cylinder speed of the arm cylinder 11 at a time point t1*b* and the cylinder speed of the arm cylinder 11 at a time point t2*b*. The time point t1*b* is a time point occurring after a first predetermined time interval has elapsed from the time point t2*a*, for example. The time point t2*b* is a time point occurring after a third predetermined time interval has elapsed from the time point t2*a*, for example, (a time point occurring after a second predetermined time interval has elapsed from the time point t1*b*).

The determining unit 26Ba derives a difference in the cylinder stroke based on the detection value of the cylinder stroke sensor 17 at the time point t1*b* and the detection value of the cylinder stroke sensor 17 at the time point t2*a*. When determining that the derived difference value is smaller than a predetermined threshold, the determining unit 26Ba determines that the arm cylinder 11 has not started operating. When determining that the derived difference value is equal to or more than the predetermined threshold, the determining unit 26Ba determines that the arm cylinder 11 has started operating.

When the operation command value I1 is output and the determining unit 26Ba determines that the arm cylinder 11 has started operating, the operation command value I1 serves as an operation start operation command value (operation start operation current value) when the arm cylinder 11 in the stopped state starts operating.

Subsequently, the same process is performed and the operation start operation command value is derived. That is, after the operation command value I1 is increased to the operation command value I2, the determining unit 26Ba compares the cylinder speed of the arm cylinder 11 at a time point t1*c* and the cylinder speed of the arm cylinder 11 at a time point t2*c*. The time point t1*c* is a time point occurring after a first predetermined time interval has elapsed from the time point t2*b*, for example. The time point t2*c* is a time point occurring after a third predetermined time interval has elapsed from the time point t2*b*, for example, (a time point occurring after a second predetermined time interval has elapsed from the time point t1*c*).

The determining unit 26Ba derives a difference between the detection value of the cylinder stroke sensor 17 at the time point t1*c* and the detection value of the cylinder speed sensor 17 at the time point t2*c*. When determining that the derived difference value is smaller than a predetermined threshold, the determining unit 26Ba determines that the arm cylinder 11 has not started operating. When determining that the derived difference value is equal to or more than the predetermined threshold, the determining unit 26Ba determines that the arm cylinder 11 has started operating.

In the present embodiment, the operation start operation command value is assumed to be the operation command value I2. The operation command value I2 is 320 [mA], for example. In this way, the operation start operation command value is derived. Here, calibration conditions in the present embodiment include output pressure of the main hydraulic pump, temperature conditions of operating oil, no-failure conditions of the control valve 27, and attitude conditions of the work machine 2, for example, in a similar manner to other calibration conditions. In the present embodiment, during the calibration, the locking lever is operated so that operating oil is supplied to the pilot oil passage 50. Moreover, the attitude of the work machine at the start of the calibration work may be the same attitude as the working attitude illustrated in FIG. 31.

Hereinabove, the procedure of deriving the operation start operation command value for the arm pressure-reducing valve 271A among the pressure-reducing valves 27A and 28B has been described. A procedure of deriving the operation start operation command value for the other pressure-reducing valves is the same, and description thereof will be omitted.

[Calibration Method of Pressure Sensor]

Figure 42:
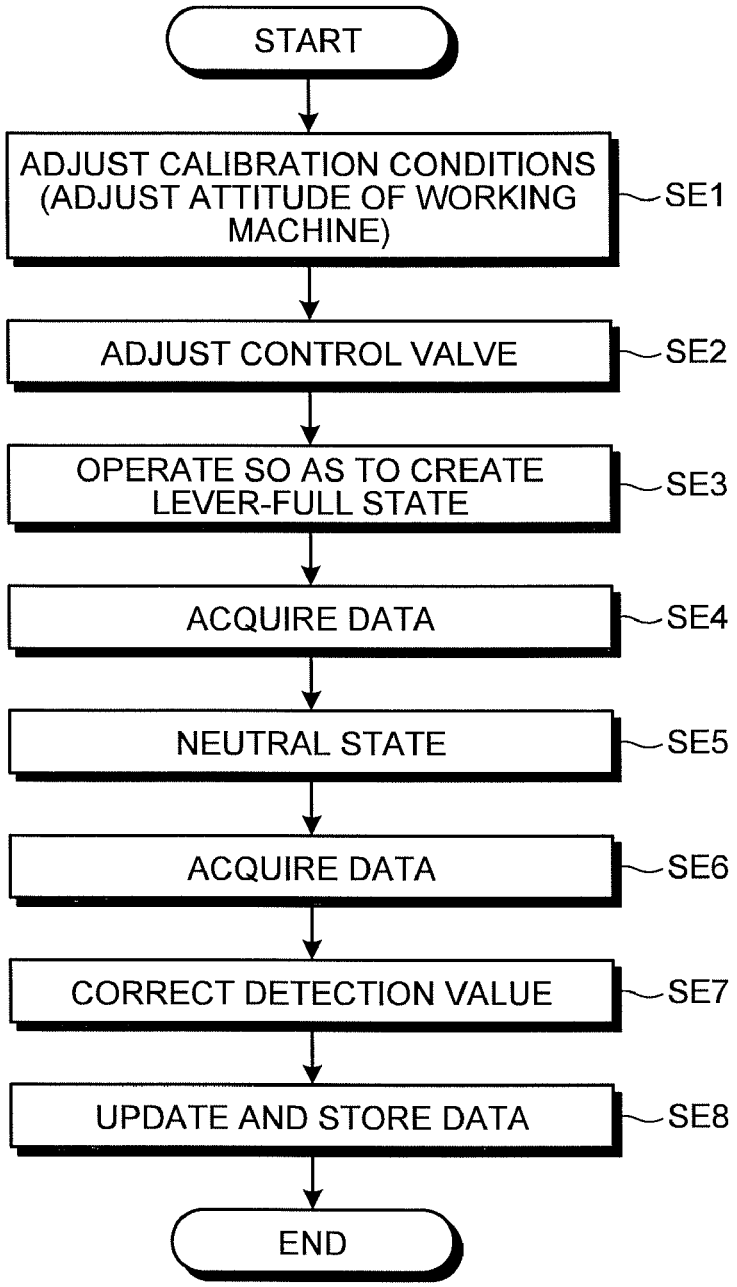
FIG. 42 is a flowchart illustrating an example of a calibration method.

Next, a calibration method of the pressure sensors 66 and 67 will be described with reference to FIG. 42. FIG. 42 is a flowchart illustrating an example of a calibration method according to the present embodiment.

In FIG. 25, the pressure sensor 66 detects the pilot pressure adjusted by the operating device 25. That is, the pressure sensor 66 detects the pilot pressure corresponding to the amount of operation of the operating device 25. When the control valve 27 is closed, the pressure sensor 67 detects the pilot pressure adjusted by the control valve 27. When the control valve 27 is opened (fully opened), the pilot pressure acting on the pressure sensor 66 is equal to the pilot pressure acting on the pressure sensor 67. Therefore, when the control valve 27 is fully opened, the detection value of the pressure sensor 66 and the detection value of the pressure sensor 67 are to be the same value. However, since the detection value for each pressure sensor varies, even when the control valve 27 is fully opened, the detection value of the pressure sensor 66 and the detection value of the pressure sensor 67 may have different values.

If the detection value of the pressure sensor 66 and the detection value of the pressure sensor 67 when the control valve 27 is fully opened are different values and are left as they are, the excavation control accuracy may decrease. Specifically, the pressure sensor 67 detects the pilot pressure acting on the direction control valve 64 when an operation command value is output to the control valve 27. The work machine controller 26 can derive the relation between the operation command value output to the control valve 27 and the pilot pressure acting on the direction control valve 64 based on the detection value of the pressure sensor 67. When the pilot pressure acting on the direction control valve 64 is adjusted using the control valve 27, the work machine controller 26 determines an operation command value based on the derived relation (the correlation data) so that a target pilot pressure acts on the direction control valve 64 and outputs the operation command value to the control valve 27. The pressure sensor 66 detects the pilot pressure corresponding to the amount of operation of the operating device 25. For example, when the operating device 25 is operated in order to drive the arm 7, the pilot pressure corresponding to the amount of operation of the operating device 25 is detected by the pressure sensor 66 (661A). When the work machine controller 26 outputs an operation command based on the detection result of the pressure sensor 66 in order to perform the excavation control (the intervention control, the stop control, and the like), if the detection value of the pressure sensor 66 is different from the detection value of the pressure sensor 67, the amount of operation of the operating device 25 may be different from a parameter (pilot pressure) included in the above-described correlation data. As a result, the work machine controller 26 cannot output an appropriate operation command value and the excavation accuracy may decrease.

In the present embodiment, the detection value of the pressure sensor 66 is corrected so that the detection value of the pressure sensor 66 is identical to the detection value of the pressure sensor 67 when the pressure-reducing valve of the control valve 27 is fully opened. That is, the detection value of the pressure sensor 66 is corrected so that the detection value (pilot pressure) of the pressure sensor 66 is identical to the parameter (pilot pressure) included in the correlation data that is derived based on the detection value of the pressure sensor 67.

In the present embodiment, an example of calibrating the boom pressure sensors 660B and 670B provided in the boom operating oil passage 4510B and the boom adjustment oil passage 4520B through which the pilot oil for raising the boom 6 flows will be described as an example.

As illustrated in FIG. 28, the "PPC pressure sensor calibration" and the "control map calibration" are provided as the calibration menu. When the calibration of the boom pressure sensors 660B and 670B is performed, the "PPC pressure sensor calibration" is selected.

Figure 43:
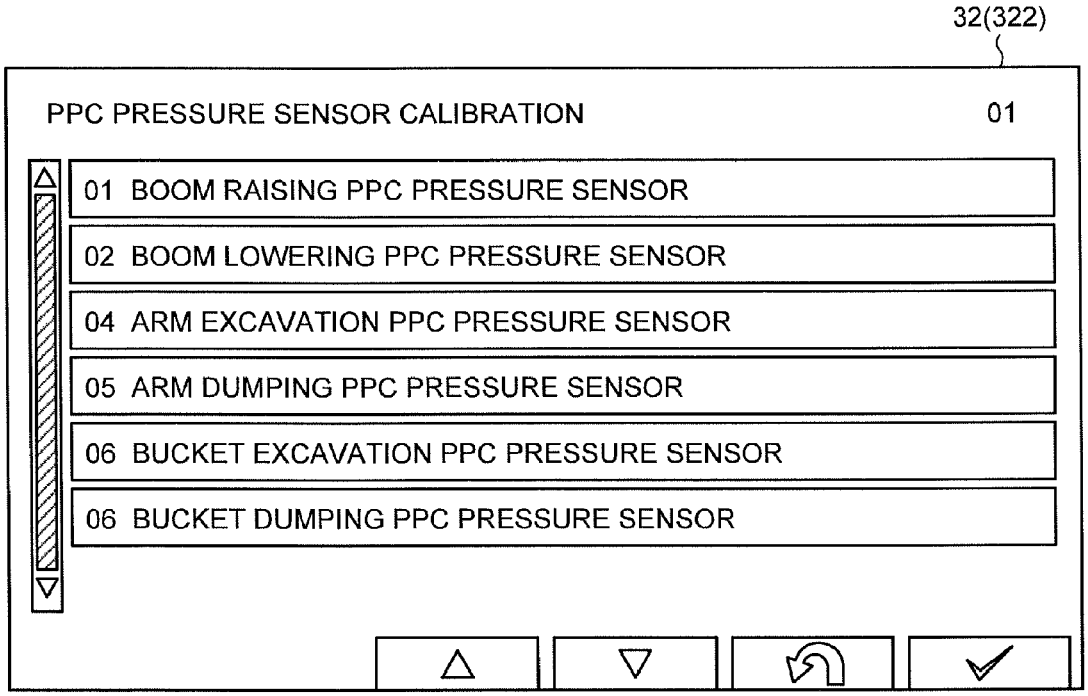
FIG. 43 is a diagram illustrating an example of the display unit.

When the "PPC pressure sensor calibration" is selected, a screen illustrated in FIG. 43 is displayed on the display unit 322. Here, since the boom pressure sensors 660B and 670B that detect the pilot pressure of the pilot oil for allowing the boom 6 to perform the raising operation are calibration subjects, a "boom raising PPC pressure sensor" is selected.

In the present embodiment, "calibration of boom pressure sensors 660A and 670A" that detect the pilot pressure for allowing the boom 6 to perform the lowering operation, "calibration of arm pressure sensors 661A and 671A" that detect the pilot pressure for allowing the arm 7 to perform the raising operation (excavating operation), "calibration of arm pressure sensors 661B and 671B" that detect the pilot pressure for allowing the arm 7 to perform the lowering operation (dumping operation), "calibration of bucket pressure sensors 662A and 672A" that detect the pilot pressure for allowing the bucket 8 to perform the raising operation (dumping operation), and "calibration of bucket pressure sensors 662B and 672B" that detect the pilot pressure for allowing the bucket 8 to perform the lowering operation (excavating operation) can be also executed as well as "calibration of boom pressure sensors 660B and 670B" that detect the pilot pressure for allowing the boom 6 to perform the raising operation.

When the "calibration of boom pressure sensors 660A and 670A" is executed, a "boom lowering PPC pressure sensor" is selected. When the "calibration of arm pressure sensors 661B and 671B" is executed, an "arm excavation PPC pressure sensor" is selected. When the "calibration of arm pressure sensors 661A and 671A" is executed, an "arm dumping PPC pressure sensor" is selected. When the "calibration of bucket pressure sensor 662B and arm pressure sensor 672B" is executed, a "bucket excavation PPC pressure sensor" is selected. When the "calibration of bucket pressure sensors 662A and 672A" is executed, a "bucket dumping PPC pressure sensor" is selected.

After the man machine interface 32 is operated for the calibration of the boom pressure sensors 660B and 670B, the sequence control unit 26H determines calibration conditions (step SE1). The calibration conditions includes pressure of the main hydraulic pump, temperature conditions of operating oil, failure conditions of the control valve 27, and the attitude conditions of the work machine 2, for example. In the present embodiment, during the calibration, the locking lever is operated so that the pilot oil passage 450 opens. Moreover, the output of the main hydraulic pump is adjusted so as to have a predetermined value (constant value). In the present embodiment, the output of the main hydraulic pump is adjusted so as to be maximized (at the full throttle in which the pump swash plate is in its largest tilt angle state). Moreover, commands are output to an engine controller that drives an engine not illustrated and to a pump controller that drives the hydraulic pump so that the amount of operating oil delivered to the boom cylinder 10 reaches its largest value in an allowable range of the pilot pressure in the boom operating oil passage 4510B and the boom adjustment oil passage 4520B, and the output of the main hydraulic pump is adjusted based on the commands of the engine controller and the pump controller.

Adjustment of the calibration conditions includes adjustment of the attitude of the work machine 2. In the present embodiment, attitude adjustment request information of requesting adjustment of the attitude of the work machine 2 is displayed on the display unit 322 of the man machine interface 32. The operator operates the operating device 25 according to the display on the display unit 322 to adjust the attitude of the work machine 2 to a predetermined state (predetermined attitude).

Figure 44:
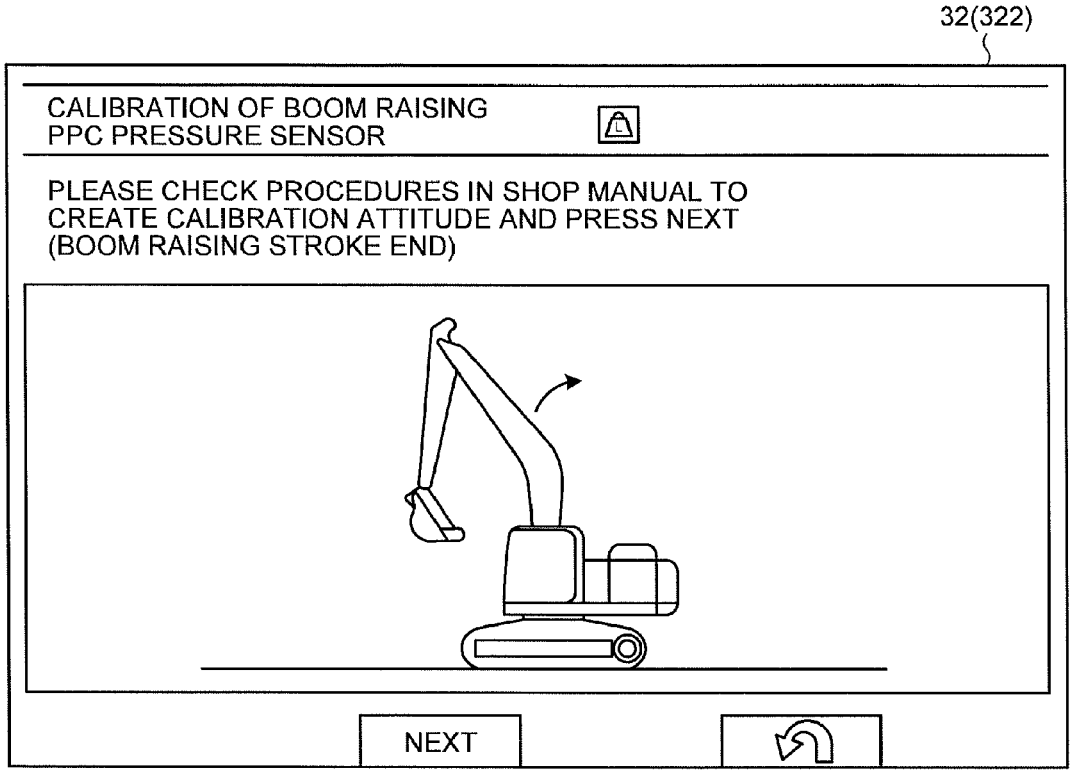
FIG. 44 is a diagram illustrating an example of the display unit.

FIG. 44 is a diagram illustrating an example of the attitude adjustment request information displayed on the display unit 322 according to the present embodiment. As illustrated in FIG. 44, a guidance for adjusting the work machine 2 to the predetermined attitude is displayed on the display unit 322.

In the present embodiment, when the boom pressure sensors 660B and 670B that detect the pilot pressure for allowing the boom 6 to perform the raising operation are calibrated, the attitude of the work machine 2 is adjusted by the operation of the operator so that the boom 6 is disposed at an end (upper end) of the movable range of the boom 6 in relation to the raising direction. Here, "stroke end" described in FIG. 44 means the stroke end of the cylinder.

With the operation of the boom cylinder 10, the boom 6 moves in the up-down direction in the working plane MP. As described above, the boom 6 performs the raising operation when the boom cylinder 10 operates in the first operating direction (for example, the extending direction), and the boom 6 performs the lowering operation when the boom cylinder 10 operates in the second operating direction (for example, the retracting direction) opposite to the first operating direction. In the present embodiment, when the boom pressure sensors 660B and 670B that detect the pilot pressure for allowing the boom 6 to perform the raising operation (for allowing the boom cylinder 10 to operate in the first operating direction) are calibrated, the boom pressure sensors 660B and 670B are calibrated in a state where the boom 6 is disposed at the end (upper end) of the movable range of the boom 6 in relation to the upward direction.

The operator operates the operating device 25 while viewing the display unit 322 so that the boom 6 is disposed at the upper end of the movable range of the boom 6. During the adjustment of the attitude of the work machine 2, each of all the pressure-reducing valves of the plurality of control valves 27 enters into the open state based on the operation command from the control valve control unit 26C. Therefore, the operator can drive the work machine 2 by operating the operating device 25. With the operation of the operating device 25, the work machine 2 (the boom 6) is driven so as to be in a predetermined attitude.

After the attitude of the work machine 2 is adjusted to the predetermined attitude, the input unit 321 of the man machine interface 32 is operated by the operator in order to start the calibration process. For example, when a "NEXT" switch illustrated in FIG. 44 is operated, the calibration process starts. The "NEXT" switch functions as the input unit 321.

When the input unit 321 is operated, the calibration process starts. A command signal generated according to the operation of the input unit 321 is input to the work machine controller 26.

The control valve control unit 26C of the work machine controller 26 controls each of the plurality of control valves 27. After acquiring the command signal for starting the calibration process from the input unit 321, the control valve control unit 26C controls the boom pressure-reducing valve 270B of the pilot oil passage (the boom operating oil passage 4510B and the boom adjustment oil passage 4520B) in which the boom pressure sensors 660B and 670B which are calibration subjects are disposed to open the pilot oil passage and controls the control valves 27 of the other pilot oil passages (the boom operating oil passage 4510A, the boom adjustment oil passage 4520A, the arm operating oil passages 4511A and 4511B, the arm adjustment oil passages 4521A and 4521B, the bucket operating oil passages 4512A and 4512B, the bucket adjustment oil passages 4522A and 4522B, and the intervention oil passage 501) to close the other pilot oil passages. That is, the control valve control unit 26C opens only the boom pressure-reducing valve 270B between the boom pressure sensors 660B and 670B which are calibration subjects and closes the other control valves 27 (step SE2).

Next, in a state where the boom operating oil passage 4510B and the boom adjustment oil passage 4520B are opened (fully open state) by the boom pressure-reducing valve 270B, the first operating lever 25R of the operating device 25 is operated by the operator to the full-lever state (first state) where the first operating lever 25R is tilted to its largest tilt angle state so that the pilot pressure of the boom operating oil passage 4510B and the boom adjustment oil passage 4520B reaches its largest value (step SE3).

For example, when the first operating lever 25R is operated so as to be tilted in the backward direction whereby the boom 6 performs the raising operation (when the pilot pressure of the boom operating oil passage 4510B increases), the first operating lever 25R is operated so as to be in the full-lever state in relation to the backward direction.

The data acquisition unit 26A of the work machine controller 26 acquires data on the detection value of the boom pressure sensor 660B and the detection value of the boom pressure sensor 670B in a state where the boom operating oil passage 4510B and the boom adjustment oil passage 4520B are opened (fully open state) by the boom pressure-reducing valve 270B (step SE4).

In step SE4, the data acquisition unit 26A acquires data in a state where the first operating lever 25R is in the full-lever state and the boom 6 is disposed at the upper end of the movable range of the boom 6 in relation to the up-down direction. Since the boom 6 is disposed at the upper end of the movable range, even when the boom pressure-reducing valve 270B opens in a state where the first operating lever 25R is in the full-lever state, the boom 6 is suppressed from moving in the upward direction.

Next, the first operating lever 25R of the operating device 25 is maintained in the neutral state (second state) so that the pilot pressure of the boom operating oil passage 4510B and the boom adjustment oil passage 4520B reaches its smallest value in a state where the boom operating oil passage 4510B and the boom adjustment oil passage 4520B are opened (fully open state) by the boom pressure-reducing valve 270B (step SE5).

The data acquisition unit 26A of the work machine controller 26 acquires data on the detection value of the boom pressure sensor 660B and the detection value of the boom pressure sensor 670B in a state where the boom operating oil passage 4510B and the boom adjustment oil passage 4520B are opened (fully open state) by the boom pressure-reducing valve 270B (step SE6). In step SE6, the data acquisition unit 26A acquires data in a state where the first operating lever 25R is in the neutral state and the boom 6 is disposed at the upper end of the movable range of the boom 6 in relation to the up-down direction.

In addition, in the present embodiment, the data acquisition unit 26A acquires the detection value of the pressure sensor 66 in a predetermined time interval (for example, the second predetermined time interval) and uses the average value of the detection values in the predetermined time interval as the detection value of the pressure sensor 66. Similarly, the data acquisition unit 26A acquires the detection value of the pressure sensor 67 in a predetermined time interval (for example, the second predetermined time interval) and uses the average value of the detection values in the predetermined time interval as the detection value of the pressure sensor 67.

Next, the correction unit 26E of the work machine controller 26 corrects (calibrates or adjusts) the detection value of the boom pressure sensor 660B so that the detection value of the boom pressure sensor 660B is identical to the detection value of the boom pressure sensor 670B based on the data acquired by the data acquisition unit 26A (step SE7). That is, the correction unit 26E adjusts the detection value of the boom pressure sensor 660B so as to be identical to the detection value of the boom pressure sensor 670B without adjusting the detection value of the boom pressure sensor 670B.

In the present embodiment, the detection value of the boom pressure sensor 660B is corrected so that the detection value of the boom pressure sensor 660B is identical to the detection value of the boom pressure sensor 670B in each of the full-lever state and the neutral state of the first operating lever 25R.

In the present embodiment, the correction unit 26E obtains a difference between the detection value of the boom pressure sensor 660B and the detection value of the boom pressure sensor 670B. The correction unit 26E derives the difference as a correction value. The correction unit 26E corrects the detection value of the boom pressure sensor 60B with the correction value whereby the detection value (corrected detection value) of the boom pressure sensor 660B is made identical to the detection value of the boom pressure sensor 670B. The acquired corrected data is stored in the storage unit 26G and updated by the updating unit 26F (step SE8).

In this way, the calibration of the boom pressure sensors 660B and 670B ends.

In the present embodiment, the pressure sensors 66 and 67 are calibrated in a state where the pilot oil passage (the pressure-reducing valve) between the pressure sensors 66 and 67 which are calibration subjects is open. In the above example, the boom pressure sensors 660B and 670B that detect the pilot pressure for allowing the boom 6 to perform the raising operation are calibrated. Therefore, the boom pressure-reducing valve 270B between the boom pressure sensors 660B and 670B is opened.

Since the boom pressure-reducing valve 270B is open, the boom 6 may move unexpectedly during the calibration process. For example, the operator touches the operating device 25 unintentionally, and as a result the boom 6 may move upward unexpectedly. In the present embodiment, for example, when the boom pressure sensors 660B and 670B that detect the pilot pressure for allowing the boom 6 to perform the raising operation are calibrated, since the boom 6 is disposed at the end (upper end) of the movable range of the boom 6 in relation to the raising direction, the boom 6 is suppressed from moving upward unexpectedly.

The "calibration of boom pressure sensors 660A and 670A," the "calibration of arm pressure sensors 661A and 671A," the "calibration of arm pressure sensors 661B and 671B," the "calibration of bucket pressure sensor 662A and arm pressure sensor 672A," and the "calibration of bucket pressure sensors 662B and 672B" can be executed in the same procedure as the above-described "calibration of boom pressure sensors 660B and 670B".

Figure 45:
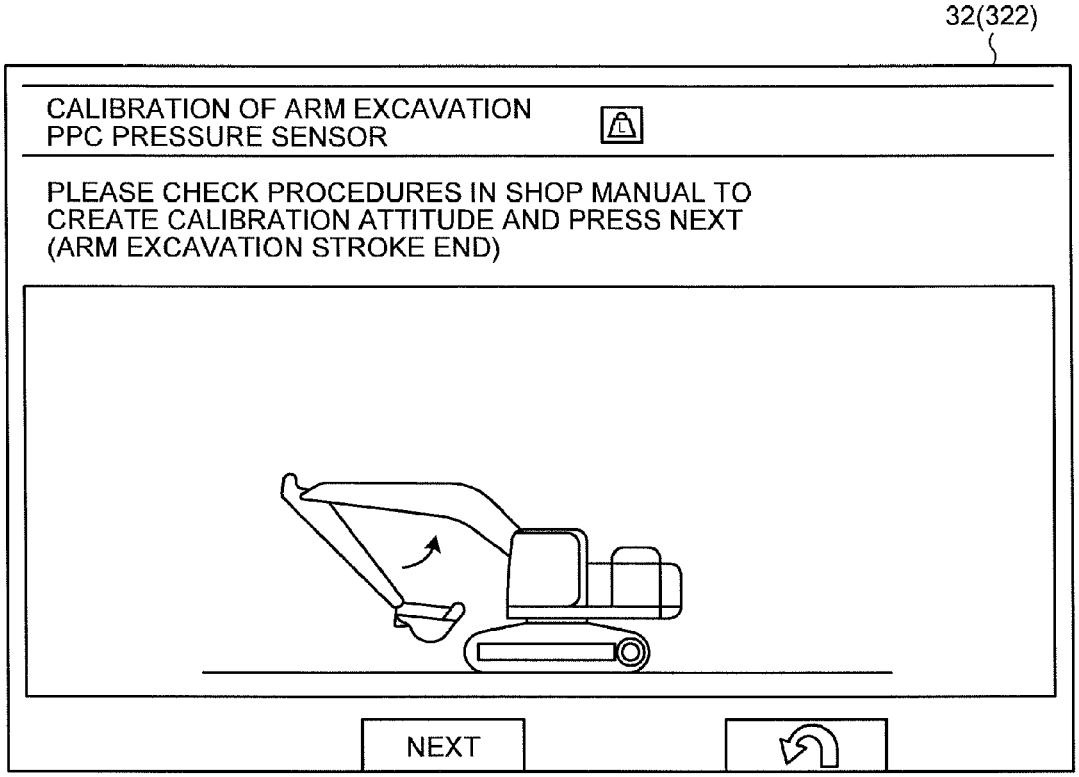
FIG. 45 is a diagram illustrating an example of the display unit.

For example, when the "calibration of arm pressure sensors 661B and 671B" that detect the pilot pressure for allowing the arm 7 to perform the lowering operation (excavating operation) is executed, an "arm excavation PPC pressure sensor" is selected in a display content on the display unit 322 illustrated in FIG. 43. By the selection, such attitude adjustment request information as illustrated in FIG. 45 is displayed on the display unit 322.

When the arm pressure sensors 661B and 671B that detect the pilot pressure for allowing the arm 7 to perform the lowering operation are calibrated, the attitude of the work machine 2 is adjusted so that the arm 7 is disposed at an end (lower end) of the movable range of the arm 7 in relation to the lowering direction. In this way, the arm 7 is suppressed from moving downward unexpectedly.

After the attitude of the work machine 2 is adjusted to the predetermined attitude, the control valve control unit 26C opens only the arm pressure-reducing valve 271B between the arm pressure sensors 661B and 671B which are calibration subjects and closes the other control valves 27. Since the arm 7 is disposed at the lower end of the movable range, even when the arm pressure-reducing valve 271B opens in a state where the second operating lever 25L is in the full-lever state, the arm 7 is suppressed from moving downward.

In a state where the arm pressure-reducing valve 271B is open, the second operating lever 25L capable of operating the arm 7 is operated so that the state thereof changes to each of the full-lever state where the pressure of the pilot oil passage reaches its largest value and the neutral state where the pressure of the pilot oil passage reaches its smallest value. The data acquisition unit 26A acquires data on the detection value of the arm pressure sensor 661B and the detection value of the arm pressure sensor 671B in each of the full-lever state and the neutral state of the second operating lever 25L. The correction unit 26E corrects the detection value of the arm pressure sensor 661B so that the detection value of the arm pressure sensor 661B is identical to the detection value of the arm pressure sensor 671B in each of the full-lever state and the neutral state.

Figure 46:
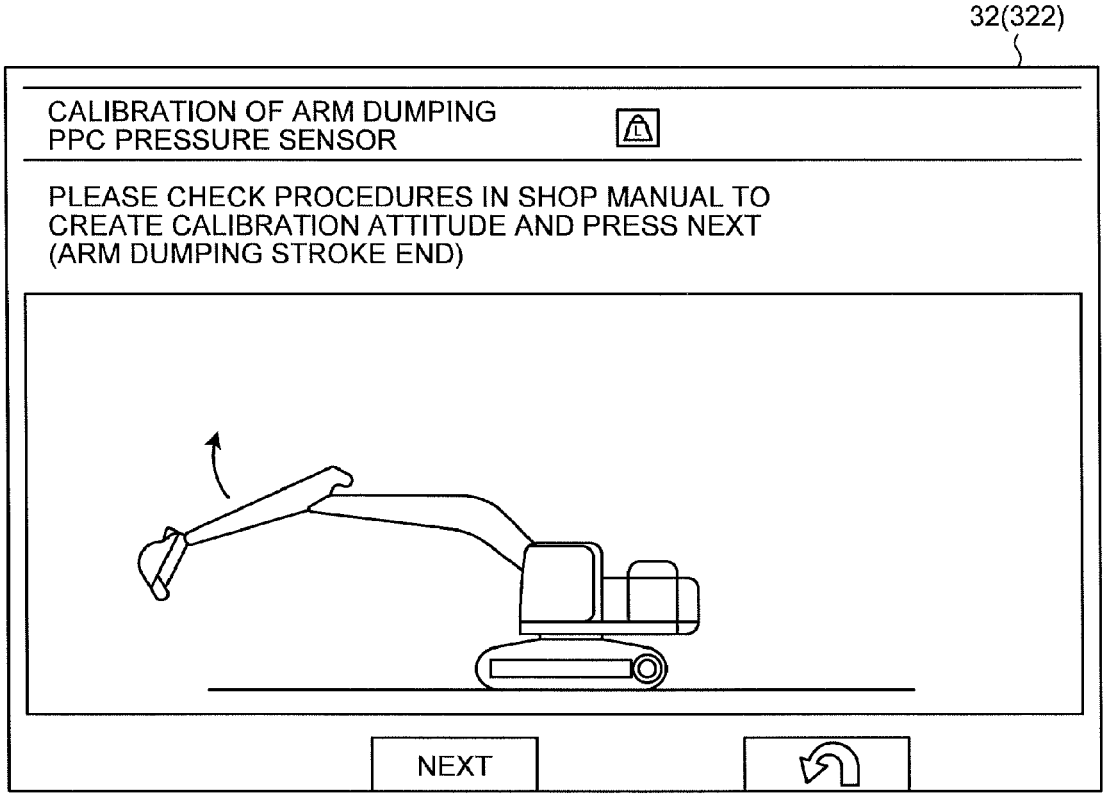
FIG. 46 is a diagram illustrating an example of the display unit.

When the "calibration of the arm pressure sensors 661A and 671A" that detect the pilot pressure for allowing the arm 7 to perform the raising operation (dumping operation) is executed, an "arm dumping PPC pressure sensor" is selected in the display content on the display unit 322 illustrated in FIG. 43. By the selection, such attitude adjustment request information as illustrated in FIG. 46 is displayed on the display unit 322.

When the arm pressure sensors 661A and 671A that detect the pilot pressure for allowing the arm 7 to perform the raising operation are calibrated, the attitude of the work machine 2 is adjusted so that the arm 7 is disposed at an end (upper end) of the movable range of the arm 7 in relation to the raising direction. In this way, the arm 7 is suppressed from moving upward unexpectedly.

After the attitude of the work machine 2 is adjusted to the predetermined attitude, the control valve control unit 26C opens only the arm pressure-reducing valve 271A between the arm pressure sensors 661A and 671A which are calibration subjects and closes the other control valves 27. Since the arm 7 is disposed at the upper end of the movable range, even when the arm pressure-reducing valve 271A opens in a state where the second operating lever 25L is in the full-lever state, the arm 7 is suppressed from moving upward.

In a state where the arm pressure-reducing valve 271A is open, the second operating lever 25L capable of operating the arm 7 is operated so that the state thereof changes to each of the full-lever state where the pressure of the pilot oil passage reaches its largest value and the neutral state where the pressure of the pilot oil passage reaches its smallest value. The data acquisition unit 26A acquires data on the detection value of the arm pressure sensor 661A and the detection value of the arm pressure sensor 671A in each of the full-lever state and the neutral state of the second operating lever 25L. The correction unit 26E corrects the detection value of the arm pressure sensor 661A so that the detection value of the arm pressure sensor 661A is identical to the detection value of the arm pressure sensor 671A in each of the full-lever state and the neutral state.

Figure 47:
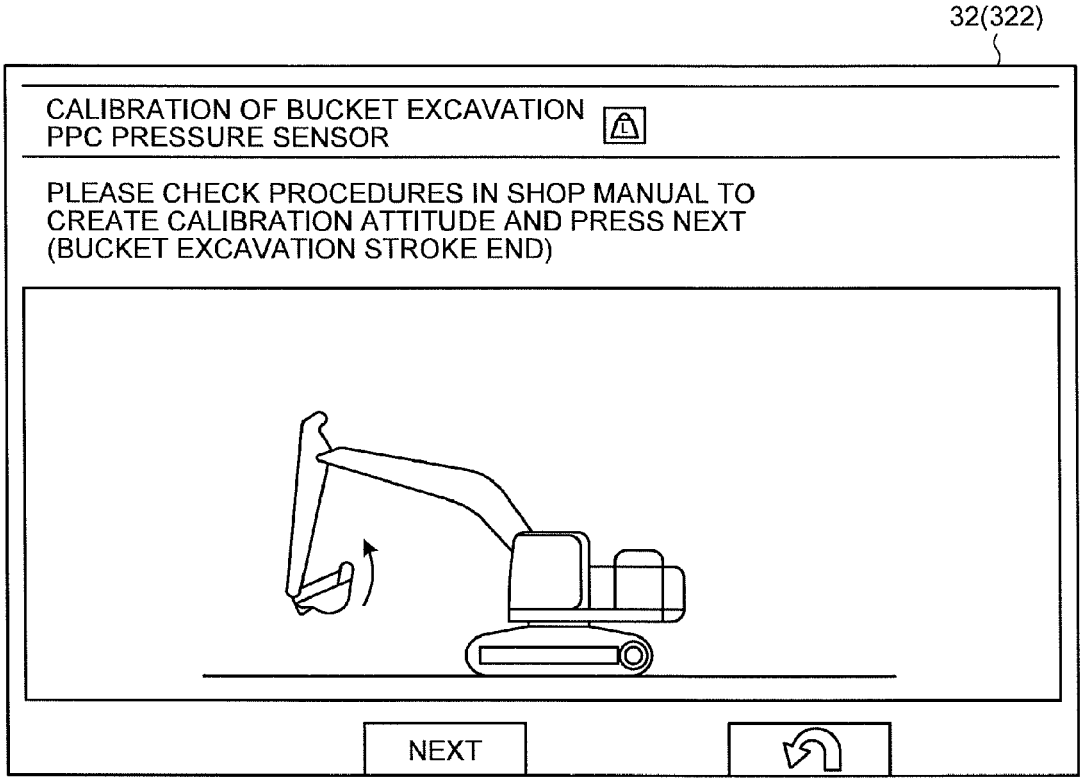
FIG. 47 is a diagram illustrating an example of the display unit.

When the "calibration of the bucket pressure sensors 662B and 672B" that detect the pilot pressure for allowing the bucket 8 to perform the lowering operation (excavating operation) is executed, a "bucket excavation PPC pressure sensor" is selected in the display content on the display unit 322 illustrated in FIG. 43. By the selection, such attitude adjustment request information as illustrated in FIG. 47 is displayed on the display unit 322.

When the bucket pressure sensors 6625 and 672B that detect the pilot pressure for allowing the bucket 8 to perform the lowering operation are calibrated, the attitude of the work machine 2 is adjusted so that the bucket 8 is disposed at an end (lower end) of the movable range of the bucket 8 in relation to the lowering direction. In this way, the bucket 8 is suppressed from moving downward unexpectedly.

After the attitude of the work machine 2 is adjusted to the predetermined attitude, the control valve control unit 26C opens only the bucket pressure-reducing valve 272B between the bucket pressure sensors 662B and 672B which are calibration subjects and closes the other control valves 27. Since the bucket 8 is disposed at the lower end of the movable range, even when the bucket pressure-reducing valve 272B opens in a state where the first operating lever 25R is in the full-lever state, the bucket 8 is suppressed from moving downward.

In a state where the bucket pressure-reducing valve 272B is open, the first operating lever 25R capable of operating the bucket 8 is operated so that the state thereof changes to each of the full-lever state where the pressure of the pilot oil passage reaches its largest value and the neutral state where the pressure of the pilot oil passage reaches its smallest value. The data acquisition unit 26A acquires data on the detection value of the bucket pressure sensor 662B and the detection value of the bucket pressure sensor 672B in each of the full-lever state and the neutral state of the first operating lever 25R. The correction unit 26E corrects the detection value of the bucket pressure sensor 662B so that the detection value of the bucket pressure sensor 662B is identical to the detection value of the bucket pressure sensor 672B in each of the full-lever state and the neutral state.

Figure 48:
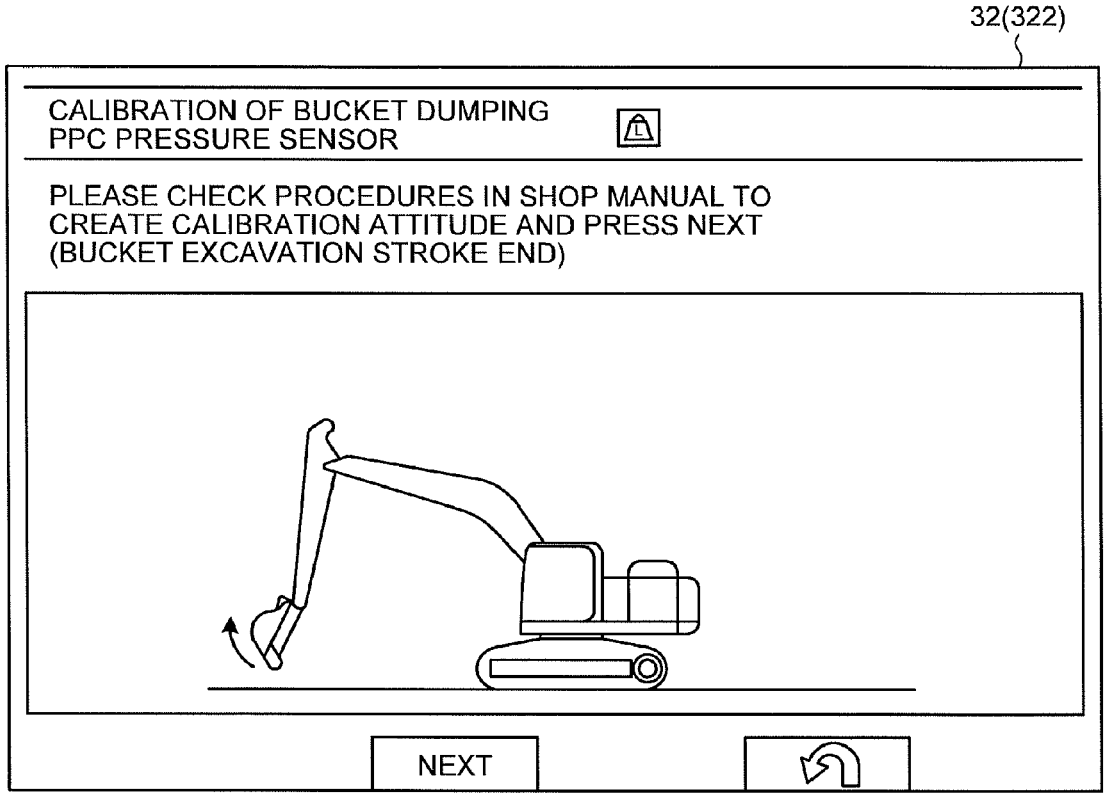
FIG. 48 is a diagram illustrating an example of the display unit.

When the "calibration of the bucket pressure sensors 662A and 672A" that detect the pilot pressure for allowing the bucket 8 to perform the raising operation (dumping operation) is executed, a "bucket dumping PPC pressure sensor" is selected in the display content on the display unit 322 illustrated in FIG. 43. By the selection, such attitude adjustment request information as illustrated in FIG. 48 is displayed on the display unit 322.

When the bucket pressure sensors 662A and 672A that detect the pilot pressure for allowing the bucket 8 to perform the raising operation are calibrated, the attitude of the work machine 2 is adjusted so that the bucket 8 is disposed at an end (upper end) of the movable range of the bucket 8 in relation to the raising direction. In this way, the bucket 8 is suppressed from moving upward unexpectedly.

After the attitude of the work machine 2 is adjusted to the predetermined attitude, the control valve control unit 26C opens only the bucket pressure-reducing valve 272A between the bucket pressure sensors 662A and 672A which are calibration subjects and closes the other control valves 27. Since the bucket 8 is disposed at the upper end of the movable range, even when the bucket pressure-reducing valve 272A opens in a state where the first operating lever 25R is in the full-lever state, the bucket 8 is suppressed from moving upward.

In a state where the bucket pressure-reducing valve 272A is open, the first operating lever 25R capable of operating the bucket 8 is operated so that the state thereof changes to each of the full-lever state where the pressure of the pilot oil passage reaches its largest value and the neutral state where the pressure of the pilot oil passage reaches its smallest value. The data acquisition unit 26A acquires data on the detection value of the bucket pressure sensor 662A and the detection value of the bucket pressure sensor 672A in each of the full-lever state and the neutral state of the first operating lever 25R. The correction unit 26E corrects the detection value of the bucket pressure sensor 662A so that the detection value of the bucket pressure sensor 662A is identical to the detection value of the bucket pressure sensor 672A in each of the full-lever state and the neutral state.

When the "calibration of the boom pressure sensors 660A and 670A" that detect the pilot pressure for allowing the boom 6 to perform the lowering operation (excavating operation) is executed, a "boom lowering PPC pressure sensor" is selected in the display content on the display unit 322 illustrated in FIG. 43.

When the boom pressure sensors 660A and 670A that detect the pilot pressure for allowing the boom 6 to perform the lowering operation are calibrated, the boom 6 is disposed above the lower end of the movable range of the boom 6. That is, the position of the boom 6 in relation to the up-down direction when the calibration process starts is defined so that the work machine 2 does not make contact with the ground surface. At the start of the calibration process of the boom pressure sensors 660A and 670A, the boom 6 may be disposed at the upper end of the movable range of the boom 6 and may be disposed at an intermediate position between the upper end and the lower end.

When the work machine 2 makes contact with the ground surface, it may be difficult to dispose the boom 6 at the lower end of the movable range. Therefore, in the present embodiment, at the start of the calibration process of the boom pressure sensors 660A and 670A, the boom 6 is disposed at the upper end or the intermediate position rather than at the lower end of the movable range.

After the attitude of the work machine 2 is adjusted, the control valve control unit 26C opens only the boom pressure-reducing valve 270A between the boom pressure sensors 660A and 670A which are calibration subjects and closes the other control valves 27. Since the boom 6 is disposed at the upper end or the intermediate position of the movable range, when the boom pressure-reducing valve 270A opens in a state where the first operating lever 25R is in the full-lever state, the boom 6 moves downward (performs the lowering operation).

In a state where the boom pressure-reducing valve 270A is open, the first operating lever 25R capable of operating the boom 6 is operated so that the state thereof changes to each of the full-lever state where the pressure of the pilot oil passage reaches its largest value and the neutral state where the pressure of the pilot oil passage reaches its smallest value. The data acquisition unit 26A acquires data on the detection value of the boom pressure sensor 660A and the detection value of the boom pressure sensor 670A in each of the full-lever state and the neutral state of the first operating lever 25R. The correction unit 26E corrects the detection value of the boom pressure sensor 660A so that the detection value of the boom pressure sensor 660A is identical to the detection value of the boom pressure sensor 670A in each of the full-lever state and the neutral state.

That is, in the present embodiment, the data acquisition unit 26A acquires data on the detection value of the boom pressure sensor 660B of the boom raising oil passage and the detection value of the boom pressure sensor 670B in a state where the boom 6 is disposed at the upper end of the movable range of the boom 6 and acquires data on the detection value of the boom pressure sensor 660A of the boom lowering oil passage and the detection value of the boom pressure sensor 670A in a state where the lowering operation of the boom 6 is performed.

[Control Method]

Next, an example of an operation of the excavator 100 according to the present embodiment will be described. As described above, the operation start operation command value, the slow-speed operation characteristics, and the normal-speed operation characteristics are stored in the storage unit 26G. Moreover, the first correlation data, the second correlation data, and the third correlation data are stored in the storage unit 26G. The work machine control unit 57 of the work machine controller 26 controls the work machine 2 based on the information stored in the storage unit 26G.

The operating device 25 is operated by the operator in order to perform the excavation work. For example, during the intervention control, the work machine control unit 57 generates an operation command (control signal) based on the information (the operation start operation command value, the slow-speed operation characteristics, the normal-speed operation characteristics, the first correlation data, the second correlation data, and the third correlation data) stored in the storage unit 26G so that the hydraulic cylinder 60 moves at a target cylinder speed and outputs the operation command to the control valve 27. In this way, the work machine control unit 57 performs control of the work machine 2 including the movement amount of the spool.

For example, referring to FIG. 25, the work machine control unit 57 determines the pilot pressure based on the third correlation data and the operation command output to the control valve 27. The work machine control unit 57 determines a spool stroke amount of the spool 80 driven with the determined pilot pressure based on the second correlation data. The control device determines the cylinder speed corresponding to the determined spool stroke amount of the spool 80 based on the first correlation data. In this way, it becomes possible to understand the operation characteristics of the hydraulic cylinder 60 at the cylinder speed corresponding to the operation command value. In the present embodiment, although the cylinder speed is obtained from the operation command, the operation command may be derived from the cylinder speed in the reverse order.

During driving of the hydraulic cylinder 60, the detection value of the cylinder stroke sensor (16 and the like) is output to the work machine controller 26. The cylinder stroke sensor (16 and the like) detects the cylinder speed. Moreover, the detection value of the spool stroke sensor 65 is input to the work machine controller 26. The spool stroke sensor 65 detects the spool stroke.

The work machine control unit 57 determines the spool stroke based on the detection value (cylinder speed) of the cylinder stroke sensor and the first correlation data so that the target cylinder speed is obtained. The control valve control unit 26C determines the pilot pressure based on the detection value (spool stroke) of the spool stroke sensor 65 and the second correlation data so that a target spool stroke is obtained. The control valve control unit 26C determines the operation command value (current value) based on the third correlation data so that a target pilot pressure is obtained and outputs the operation command value to the control valve 27.

Note that the bucket 8 may be replaced with another bucket which is then connected to the arm 7. For example, the bucket 8 is appropriately selected according to the content of the excavation work and the selected bucket 8 is connected to the arm 7. When the bucket 8 having a different weight is connected to the arm 7, the load acting on the hydraulic cylinder 60 that drives the work machine 2 may change. When the load acting on the hydraulic cylinder 60 changes, the hydraulic cylinder 60 may be unable to execute an intended operation and the intervention control may not be performed with high accuracy. As a result, the bucket 8 may be unable to move based on the designed landform data U and the excavation accuracy may decrease.

In the present embodiment, a plurality of items of first correlation data indicating the relation between the cylinder speed of the hydraulic cylinder 60 and the movement amount of the spool 80 of the direction control valve 64 corresponding to the weight of the bucket 8 is obtained in advance. The work machine controller 26 controls the movement amount of the spool 80 of the direction control valve 64 based on the first correlation data.

[Effects]

As described above, according to the present embodiment, since the operation start operation command value and the slow-speed operation characteristics are derived, and the work machine 2 is controlled based on the derived results, a decrease in the excavation accuracy is suppressed. For example, the operation characteristics of the hydraulic cylinder 60 (work machine 2) may be different according to a model. In particular, the operation characteristics at the start of operation (activation) and in the slow-speed area of the hydraulic cylinder 60 may differ greatly among models. Moreover, even when the type of the bucket 8 is changed, the operation characteristics at the start of operation (activation) and in the slow-speed area of the hydraulic cylinder 60 may change greatly. For example, when the weight of the bucket 8 is changed, the operation characteristics may change. Moreover, even when the type of the bucket 8 is the same, the characteristics of the buckets may be different. Since the operation start operation command value and the slow-speed operation characteristics are derived, the derived results are stored in the storage unit 26G, the hydraulic cylinder 60 is controlled using the information stored in the storage unit 26G, a decrease in the excavation accuracy is suppressed even different models are used or the weight of the bucket 8 is changed.

In particular, in order to perform the intervention control with high accuracy, the activation characteristics and the operation characteristics in the slow-speed area of the hydraulic cylinder 60 are important. That is, the intervention control is highly likely to be executed in a situation where the work machine 2 moves at a low speed along the target excavation landform U, for example. Moreover, the intervention control is highly likely to be executed in a situation where the work machine 2 moves along the target excavation landform U while the work machine 2 is repeatedly stopped and driven. Therefore, by understanding the activation characteristics and the operation characteristics in the slow-speed area of the hydraulic cylinder 60 in advance, the intervention control can be performed with high accuracy.

Moreover, in the present embodiment, the operation start operation command value and the slow-speed operation characteristics are derived for the intervention valve 27C. The operation start operation command value and the normal-speed operation characteristics are derived for the pressure-reducing valves 27A and 27B but the slow-speed operation characteristics are not derived. As described above, since the activation characteristics and the operation characteristics in the slow-speed area are important in the intervention control, by deriving the operation start operation command value and the slow-speed operation characteristics for the intervention valve 27C, the intervention control can be performed with high accuracy. On the other hand, as described above, the pressure-reducing valves 27A and 27B are usually used in the stop control only. Therefore, by deriving the operation start operation command value and the normal-speed operation characteristics for the pressure-reducing valves 27A and 27B but not deriving the slow-speed operation characteristics, it is possible to shorten the time required for the calibration process.

Moreover, in the present embodiment, the operation characteristics for the current value supplied to the control valve 27 are obtained as the operation command value. The operation command value may be the pressure value of the pilot pressure or may be the spool stroke value (the movement amount value of the spool 80). In this way, the correlation data of at least two values of the current value, the pilot pressure value, the spool stroke value, and the cylinder speed value is acquired, and excavation control can be performed with high accuracy.

Moreover, in the present embodiment, since in the calibration process of deriving the operation characteristics of the hydraulic cylinder 60, only the control valve 27 which is a calibration subject is opened and the other control valves 27 which are not calibration subjects are closed, it is possible to suppress an unexpected operation of the work machine 2 and to perform the calibration process smoothly.

Moreover, in the present embodiment, since in the calibration process of the pressure sensors 66 and 67, the control valve 27 of the pilot oil passage 450 in which the pressure sensors 66 and 67 which are calibration subjects are disposed is opened and the control valves 27 of the other pilot oil passages 450 are closed, it is possible to suppress an unexpected operation of the work machine 2 and to perform the calibration process smoothly.

Moreover, in the present embodiment, the normal-speed operation characteristics as well as the operation start operation command value and the slow-speed operation characteristics are derived. Thus, it is possible to understand each of the activation of the hydraulic cylinder 60, the characteristics of the hydraulic cylinder 60 in the slow-speed area, and the characteristics of the hydraulic cylinder 60 in the normal-speed area and to perform excavation control with high accuracy.

Moreover, in the present embodiment, the intervention control includes controlling the raising operation of the boom 6. In the present embodiment, the arm 7 and the bucket 8 are operated by the operator (the operating device 25) rather than being subjected to the intervention control. Therefore, by deriving the operation start operation command value and the slow-speed operation characteristics for the intervention valve 27C disposed in the boom oil passage and deriving the operation start operation command value for the pressure-reducing valves 27A and 27B disposed in the arm oil passage and the bucket oil passage, respectively, but not deriving the slow-speed operation characteristics, it is possible to shorten the time required for the calibration process.

Moreover, in the present embodiment, the user (operator) of the excavator 100 can monitor the progress of the calibration process with the aid of the man machine interface 32. Therefore, the user can perform the calibration process at the necessary timing. For example, the user can perform the calibration process at the timing when the bucket (attachment) 8 is replaced. Moreover, since during the calibration process, the attitude adjustment request information of the work machine 2 is displayed on the display unit 322, the operator can perform the calibration work smoothly.

Moreover, in the present embodiment, since the detection value of the pressure sensor 66 is corrected so that the detection value of the pressure sensor 66 is identical to the detection value of the pressure sensor 67, it is possible to suppress the occurrence of a difference between the detection value of the pressure sensor 66 corresponding to the amount of the operating device 25 and the pilot pressure of the correlation data derived based on the detection value of the pressure sensor 67. Thus, it is possible to perform the excavation control with high accuracy based on the correlation data.

Moreover, according to the present embodiment, the detection value of the pressure sensor 66 is correct so that the detection value of the pressure sensor 66 and the detection value of the pressure sensor 67 are identical to in each of the full-lever state and the neutral state. In this way, it is possible to make the detection value of the pressure sensor 66 and the detection value of the pressure sensor 67 identical in each of the full-lever state and the neutral state of the operating device 25. Although in the present embodiment the detection value of the pressure sensor 66 is made to be identical to the detection value of the pressure sensor 67, the detection value of the pressure sensor 67 may also be made to be identical to the detection value of the pressure sensor 66.

Moreover, in the present embodiment, the calibration process of the pressure sensors 66 and 67 is performed in a manner such that the work machine 2 is disposed at the end of the movable range of the work machine 2. Thus, for example, even when the calibration process of the pressure sensors 66 and 67 is performed in the full-lever state, the work machine 2 is suppressed from moving.

Moreover, in the present embodiment, the data on the detection value of the pressure sensor 66 of the boom raising oil passage and the detection value of the pressure sensor 67 is acquired in a state where the boom 6 is disposed at the upper end of the movable range of the boom 6, and the data on the detection value of the pressure sensor 66 of the boom lowering oil passage and the detection value of the pressure sensor 67 is acquired in a state where the lowering operation of the boom 7 is performed. In this way, it is possible to perform the calibration process smoothly while suppressing the boom 7 from making contact with the ground surface.

Moreover, in the present embodiment, the control valve control unit 27C opens the plurality of control valves 27 in each of the period between the end of the first sequence and the start of the second sequence, the period between the end of the second sequence and the start of the third sequence, and the period between the end of the third sequence and the start of the fourth sequence. For this reason, the operator can adjust the attitude of the work machine 2 to the initial attitude (predetermined attitude) using the operating device 25.

Moreover, according to the present embodiment, since in the intervention control (limited excavation control) of the boom 6, a plurality of items of first correlation data corresponding to a plurality of weights of the bucket 8, respectively, is obtained, and the first correlation data to be used is selected when the bucket 8 is replaced, and the movement amount of the spool 80 is controlled based on the selected first correlation data, a decrease in the excavation accuracy is suppressed. That is, if a change in the weight of the work machine 2 due to replacement or the like of the bucket 8 is not taken into consideration, the hydraulic cylinder 60 may not operate so as to correspond to the current value output based on the initially intended amount of operation of the operating device 25 and the hydraulic cylinder 60 may be unable to execute an intended operation. In particular, in a fine operation phase for activation of the hydraulic cylinder 60, the activation of the hydraulic cylinder 60 may be delayed and in severe cases, an oscillation may occur.

According to the present embodiment, the first correlation data is used so that the hydraulic cylinder 60 operates at the target cylinder speed by taking a change in the weight of the work machine 2 into consideration. Moreover, the first correlation data sets the speed profile of the activation of the hydraulic cylinder 60 for executing the raising operation according to the weight of the bucket 8. In this way, it is possible to suppress a decrease in the excavation accuracy.

Moreover, according to the present embodiment, the hydraulic cylinder 60 operates so that the raising operation and the lowering operation of the work machine 2 are executed. The load acting on the hydraulic cylinder 60 changes between the raising operation and the lowering operation of the work machine 2, and the amount of change in the cylinder speed is different between the raising operation and the lowering operation. According to the present embodiment, since the first correlation data includes the relation between the cylinder speed and the spool stroke in each of the raising operation and the lowering operation, the movement amount of the spool 80 is controlled appropriately in each of the raising operation and the lowering operation and a decrease in the excavation accuracy is suppressed.

Moreover, a difference between the cylinder speed in relation to the bucket 8 having a first weight and the cylinder speed in relation to the bucket 8 having a second weight when the spool 80 has moved by a predetermined amount from the origin during the lowering operation of the work machine 2 is larger than a difference between the cylinder speed in relation to the bucket 8 having the first weight and the cylinder speed in relation to the bucket 8 having the second weight when the spool 80 has moved by the predetermined amount from the origin during the raising operation of the work machine 2. By controlling the movement amount of the spool 80 appropriately by taking the difference during the lowering operation and the difference during the raising operation into consideration, a decrease in the excavation accuracy is suppressed.

Moreover, according to the present embodiment, the hydraulic cylinder 60 operates so that the raising operation of the work machine 2 is executed in an initial state where the cylinder speed is zero, and an amount of change in the cylinder speed from the initial state in relation to the bucket 8 having the first weight is different from an amount of change in the cylinder speed from the initial state in relation to the bucket 8 having the second weight. By controlling the movement amount of the spool 80 appropriately by taking the amount of change in the cylinder speed when the raising operation is executed from the initial state due to the difference in the weight of the bucket 8 into consideration, a decrease in the excavation accuracy is suppressed.

Moreover, in the present embodiment, the work machine control unit 57 outputs the control signal to the control valve 27. That is, in the limited excavation control, the control signal is output to the control valve 27 which is an electromagnetic proportional control valve. In this way, it is possible to adjust the pilot pressure to accurately adjust the amount of operating oil supplied to the hydraulic cylinder 60 at a high speed.

Moreover, in the present embodiment, the second correlation data indicating the relation between the movement amount of the spool 80 and the pilot pressure and the third correlation data indicating the relation between the pilot pressure and the control signal output from a control unit 262 to the control valve 27 as well as the first correlation data indicating the relation between the cylinder speed and the movement amount of the spool 80 are obtained in advance and are stored in the storage unit 261. Thus, the control unit 262 can move the hydraulic cylinder 60 at the target cylinder speed more accurately by outputting the control signal to the control valve 27 based on the first correlation data, the second correlation data, and the third correlation data.

Note that, in the present embodiment, the example of using the first correlation data indicating the relation between the cylinder speed and the spool stroke, the second correlation data indicating the relation between the spool stroke and the pilot pressure, and the third correlation data indicating the relation between the pilot pressure and the current value has been described. Correlation data indicating the relation between the cylinder speed and the pilot pressure may be stored in the storage unit 26G, and the work machine 2 may be controlled using the correlation data. That is, correlation data including the first correlation data combined with the second correlation data may be obtained in advance through experiments or simulation, and the pilot pressure may be controlled based on the correlation data.

While the embodiment of the present invention have been described above, the present invention is not limited to the above-described embodiment and various modifications can be made without departing from the spirit of the present invention.

For example, in the above-described embodiment, the operating device 25 is a pilot hydraulic-type operating device. The operating device 25 may be an electric lever-type operating device. For example, an operating lever detection unit which detects the amount of operation of the operating lever of the operating device 25 by a potentiometer or the like and outputs a voltage value corresponding to the amount of operation to the work machine controller 26 may be installed. The work machine controller 26 may output the control signal to the control valve 27 based on the detection result of the operating lever detection unit to adjust the pilot pressure. The respective calibration performed by the work machine controller 26 may be performed by the sensor controller 30 or the display controller 28.

Although in the above-described embodiment the excavator has been described as an example of the construction machine, the present invention is not limited to the excavator, and may be applied to other types of construction machines.

The position of the excavator CM in the global coordinate system may be acquired by other position measurement means without being limited to GNSS. Thus, the distance d between the cutting edge 8*a* and the designed landform may be acquired by other position measurement means without being limited to GNSS.

REFERENCE SIGNS LIST

1 VEHICLE BODY
2 WORK MACHINE
3 SWINGING STRUCTURE
4 CAB
5 TRAVELING DEVICE
5Cr CRAWLER BELT
6 BOOM
7 ARM
8 BUCKET
8*a* DISTAL END (CUTTING EDGE)
9 ENGINE ROOM
10 BOOM CYLINDER
11 ARM CYLINDER
12 BUCKET CYLINDER
13 BOOM PIN
14 ARM PIN
15 BUCKET PIN
16 BOOM CYLINDER STROKE SENSOR
17 ARM CYLINDER STROKE SENSOR
18 BUCKET CYLINDER STROKE SENSOR
19 HANDRAIL
20 POSITION DETECTION DEVICE
21 ANTENNA
23 GLOBAL COORDINATE CALCULATING UNIT
24 IMU
25 OPERATING DEVICE
25L SECOND OPERATING LEVER
25R FIRST OPERATING LEVER
26 WORK MACHINE CONTROLLER
27 CONTROL VALVE
27A PRESSURE-REDUCING VALVE
27B PRESSURE-REDUCING VALVE
27C INTERVENTION VALVE
28 DISPLAY CONTROLLER
29 DISPLAY UNIT
30 SENSOR CONTROLLER
32 MAN MACHINE INTERFACE
40A CAP-SIDE OIL CHAMBER
40B ROD-SIDE OIL CHAMBER
47 OIL PASSAGE
48 OIL PASSAGE
51 SHUTTLE VALVE
60 HYDRAULIC CYLINDER
63 SWINGING MOTOR
64 DIRECTION CONTROL VALVE
65 SPOOL STROKE SENSOR
66 PRESSURE SENSOR
67 PRESSURE SENSOR
100 CONSTRUCTION MACHINE (EXCAVATOR)
161 ROTATION ROLLER
162 ROTATION CENTER SHAFT
163 ROTATION SENSOR PORTION
164 CASE
200 CONTROL SYSTEM
250 PRESSURE CONTROL VALVE
270 (270A, 270B) BOOM PRESSURE-REDUCING VALVE
271 (271A, 271B) ARM PRESSURE-REDUCING VALVE
272 (272A, 272B) BUCKET PRESSURE-REDUCING VALVE
300 HYDRAULIC SYSTEM
321 INPUT UNIT
322 DISPLAY UNIT
450 PILOT OIL PASSAGE
451 PILOT OIL PASSAGE
452 PILOT OIL PASSAGE
4510A, 4510B BOOM OPERATING OIL PASSAGE
4511A, 4511B ARM OPERATING OIL PASSAGE
4512A, 4512B BUCKET OPERATING OIL PASSAGE
4520A, 4520B BOOM ADJUSTMENT OIL PASSAGE
4521A, 4521B ARM ADJUSTMENT OIL PASSAGE
4522A, 4522B BUCKET ADJUSTMENT OIL PASSAGE
501 INTERVENTION OIL PASSAGE
660 (660A, 660B) BOOM PRESSURE SENSOR
670 (670A, 670B) BOOM PRESSURE SENSOR
661 (661A, 661B) ARM PRESSURE SENSOR
671 (671A, 671B) ARM PRESSURE SENSOR
662 (662A, 662B) BUCKET PRESSURE SENSOR
672 (672A, 672B) BUCKET PRESSURE SENSOR
AX SWING AXIS
Q SWINGING STRUCTURE DIRECTION DATA
S CUTTING EDGE POSITION DATA
T TARGET CONSTRUCTION INFORMATION
U TARGET EXCAVATION LANDFORM DATA

The invention claimed is:

1. A construction machine control system that includes a work machine including a boom, an arm, and a bucket and an operating device receiving an input of an operator's operation command for driving the work machine, the construction machine control system comprising:

a hydraulic cylinder that drives the work machine;

a direction control valve that has a movable spool and that supplies operating oil to the hydraulic cylinder with movement of the spool to operate the hydraulic cylinder;

a control valve that allows the spool to be movable based on the operation command;

a cylinder speed sensor that detects a cylinder speed of the hydraulic cylinder;

a data acquisition unit that acquires an operation command value indicating a value of an operation command signal for operating the hydraulic cylinder and data indicating the cylinder speed in a state where the operation command signal is output, the data including an initial state where the cylinder speed is zero, a slow-speed area that is a speed area where the cylinder speed is higher than zero and lower than a predetermined speed, and a normal-speed area that is a speed area where the cylinder speed is equal to or higher than the predetermined speed;

a deriving unit that derives an operation start operation command value when the hydraulic cylinder in the initial state starts operating and slow-speed operation characteristics indicating a relation between the operation command value and the cylinder speed in the slow-speed area based on the data acquired by the data acquisition unit;

a storage unit that stores the operation start operation command value and the slow-speed operation characteristics derived by the deriving unit; and a work machine control unit that controls the work machine based on information stored in the storage unit.

2. The construction machine control system according to claim 1, wherein the control valve adjusts pressure of pilot oil for moving the spool and allows the spool to be movable by the pilot oil, the construction machine control system further comprising:

a control valve control unit that determines a current value to be supplied to the control valve;

a pressure sensor that detects a pressure value of the pilot oil; and a spool stroke sensor that detects a movement amount value of the spool, and wherein the operation command value includes at least one of the current value, the pressure value, and the movement amount value.

3. The construction machine control system according to claim 1, wherein the deriving unit derives normal-speed operation characteristics indicating a relation between the operation command value and the cylinder speed in the normal-speed area that is a speed area where an amount of change in the cylinder speed with respect to the operation command value is larger than that in the slow-speed area and the cylinder speed is higher than that in the slow-speed area based on the data acquired by the data acquisition unit, and wherein the storage unit stores the normal-speed operation characteristics.

4. The construction machine control system according to claim 1, wherein the hydraulic cylinder includes a boom cylinder that drives the boom, the construction machine control system further comprising:

a boom raising operation command unit which is connected to one pressure receiving chamber of the direction control valve and is used for allowing the boom to perform a raising operation; and a boom lowering operation command unit which is connected to the other pressure receiving chamber of the direction control valve and is used for allowing the boom to perform a lowering operation, wherein the work machine control unit determines, based on a target excavation landform indicating a target shape of an excavation object and bucket position data indicating a position of the bucket, a speed limit according to a distance between the target excavation landform and the bucket and executes intervention control of limiting a speed of the boom so that the speed in a direction where the bucket approaches the target excavation landform is equal to or lower than the speed limit, and wherein with respect to an intervention control unit that executes the intervention control, the operation start operation command value and the slow-speed operation characteristics are derived.

5. The construction machine control system according to claim 4, wherein the control valve includes an intervention valve disposed in the intervention oil passage, wherein the work machine control unit inputs the operation command value to the intervention valve, and wherein calibration of the slow-speed operation characteristics of the hydraulic cylinder with respect to the operation command value is performed by operator's operation.

6. The construction machine control system according to claim 4, wherein the operation command signal is output by operation of the operating device that is a pilot hydraulic-type operating device, wherein the boom raising operation command unit includes a boom raising oil passage which is connected to the operating device and through which the pilot oil for allowing the boom to perform the raising operation flows, wherein the boom lowering operation command unit includes a boom lowering oil passage through which the pilot oil for allowing the boom to perform the lowering operation flows, wherein the boom raising oil passage includes an operating oil passage through which the pilot oil of which pressure is adjusted according to an amount of operation of the operating device flows and an intervention oil passage which is connected to the operating oil passage via a shuttle valve and through which the pilot oil of which pressure is adjusted in the intervention control flows, wherein the control valve includes a pressure-reducing valve disposed in the operating oil passage and an intervention passage disposed in the intervention oil passage, and wherein with respect to the intervention valve, the operation start operation command value and the slow-speed operation characteristics are derived.

7. The construction machine control system according to claim 4, wherein with respect to the pressure-reducing valve, the operation start operation command value is derived.

8. The construction machine control system according to claim 4, wherein the hydraulic cylinder includes an arm cylinder that drives the arm and a bucket cylinder that drives the bucket, the construction machine control system further comprising:

an arm oil passage through which pilot oil for operating the arm flows; and a bucket oil passage through pilot oil for operating the bucket flows, wherein the control valve includes pressure-reducing valves disposed in the arm oil passage and the bucket oil passage, and wherein with respect to the pressure-reducing valves, the operation start operation command value is derived.

9. The construction machine control system according to claim 1, further comprising a man machine interface that includes an input unit and a display unit, wherein the display unit displays attitude adjustment request information of requesting adjustment of an attitude of the work machine, and wherein the input unit generates a command signal for outputting the operation command signal for operating the hydraulic cylinder.

10. A construction machine comprising:

a lower traveling structure;

an upper swinging structure that is supported by the lower traveling structure;

a work machine that includes a boom, an arm, and a bucket and is supported by the upper swinging structure; and the construction machine control system according to claim 1.

11. A construction machine control method in a construction machine control system for a construction machine that includes a work machine including a boom, an arm, and a bucket and allows the work machine to be driven based on an operator's operation command, wherein the construction machine includes a hydraulic cylinder that drives the work machine, a direction control valve that has a movable spool and that supplies operating oil to the hydraulic cylinder with movement of the spool to operate the hydraulic cylinder, and a control valve that allows the spool to be movable based on the operation command, and the construction machine control method comprising:

adjusting an attitude of the work machine;

generating an operation command signal for operating the hydraulic cylinder;

acquiring an operation command value indicating a value of the operation command signal and data indicating a cylinder speed of the hydraulic cylinder in a state where the operation command signal is output, the data including an initial state where the cylinder speed is zero, a slow-speed area that is a speed area where the cylinder speed is higher than zero and lower than a predetermined speed, and a normal-speed area that is a speed area where the cylinder speed is equal to or higher than the predetermined speed;

deriving an operation start operation command value when the hydraulic cylinder in the initial state starts operating based on the acquired data;

after deriving the operation start operation command value, acquiring the operation command value and the data indicating the cylinder speed in a state where the operation command signal of which the operation command value is larger than the operation start operation command value is output;

deriving slow-speed operation characteristics indicating a relation between the operation command value and the cylinder speed in the slow-speed area based on the acquired data; and storing the derived operation start operation command value and the derived slow-speed operation characteristics.

* * * * *